US006982686B2

(12) United States Patent
Miyachi et al.

(10) Patent No.: US 6,982,686 B2
(45) Date of Patent: Jan. 3, 2006

(54) LIQUID CRYSTAL DISPLAY DEVICE, IMAGE DISPLAY DEVICE, ILLUMINATION DEVICE AND EMITTER USED THEREFORE, DRIVING METHOD OF LIQUID CRYSTAL DISPLAY DEVICE, DRIVING METHOD OF ILLUMINATION DEVICE, AND DRIVING METHOD OF EMITTER

(75) Inventors: Koichi Miyachi, Soraku-gun (JP); Akihito Jinda, Kitakatsuragi-gun (JP); Makoto Shiomi, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 283 days.

(21) Appl. No.: 09/878,358

(22) Filed: Jun. 12, 2001

(65) Prior Publication Data

US 2002/0008694 A1 Jan. 24, 2002

(30) Foreign Application Priority Data

| | | |
|---|---|---|
| Jun. 15, 2000 | (JP) | 2000-180413 |
| Jun. 15, 2000 | (JP) | 2000-180421 |
| Jun. 15, 2000 | (JP) | 2000-180423 |
| Jun. 15, 2000 | (JP) | 2000-180428 |
| Apr. 9, 2001 | (JP) | 2001-110515 |
| Apr. 9, 2001 | (JP) | 2001-110597 |
| Apr. 10, 2001 | (JP) | 2001-111900 |
| Apr. 10, 2001 | (JP) | 2001-111918 |
| May 11, 2001 | (JP) | 2001-142376 |

(51) Int. Cl.
*G09G 3/24* (2006.01)

(52) U.S. Cl. ..... 345/73; 345/77; 345/87; 345/102; 345/103

(58) Field of Classification Search ..... 345/73, 345/77, 87, 102, 103
See application file for complete search history.

(56) References Cited

U.S. PATENT DOCUMENTS

| | | | | |
|---|---|---|---|---|
| 5,093,652 A | * | 3/1992 | Bull et al. | 345/592 |
| 5,103,328 A | * | 4/1992 | Numao | 349/74 |
| 5,387,921 A | * | 2/1995 | Zhang et al. | 345/102 |

(Continued)

FOREIGN PATENT DOCUMENTS

| | | |
|---|---|---|
| JP | 62-035325 | 2/1987 |
| JP | 62-205388 | 9/1987 |
| JP | 64-82019 A | 3/1989 |

(Continued)

OTHER PUBLICATIONS

Japanese Office Action mailed Mar. 16, 2004 (w/English translation thereof).

(Continued)

*Primary Examiner*—Guy J. Lamarre
*Assistant Examiner*—Fritz Alphonse
(74) *Attorney, Agent, or Firm*—Nixon & Vanderhye P.C.

(57) ABSTRACT

A cold cathode tube for illuminating pixels with light which is in accordance with an output signal has luminance which gradually increases at a rise and gradually decreases at a fall per one frame time. In certain example embodiments, illuminating elements respectively illuminate display elements in such a manner that each illuminating element group respectively illuminates a display element group in a second luminance in a period from Time P to Time (P+tb), and illuminates in a first luminance in a period from the Time (P+tb) to Time (P+f), the second luminance being darker than the first luminance, where tb is a predetermined time, f is one vertical period, and the Time P is a time at which a display element band having an earliest scanning time in the display element group the illuminating element group illuminates is scanned.

36 Claims, 46 Drawing Sheets

U.S. PATENT DOCUMENTS

| | | | | | |
|---|---|---|---|---|---|
| 5,592,193 | A | * | 1/1997 | Chen | 345/102 |
| 5,971,567 | A | * | 10/1999 | Van Duijneveldt | 362/296 |
| 6,429,839 | B1 | * | 8/2002 | Sakamoto | 345/87 |
| 6,504,587 | B1 | * | 1/2003 | Morishita et al. | 349/58 |
| 6,636,190 | B2 | * | 10/2003 | Hirakata et al. | 345/74.1 |

FOREIGN PATENT DOCUMENTS

| | | | |
|---|---|---|---|
| JP | 3-66199 | | 6/1991 |
| JP | 03-198026 | | 8/1991 |
| JP | 05-080716 | | 4/1993 |
| JP | 5-38800 | | 5/1993 |
| JP | 06-282231 | | 10/1994 |
| JP | 07-005428 | | 1/1995 |
| JP | 07-159755 | | 6/1995 |
| JP | 07-191298 | | 7/1995 |
| JP | 8-500915 | | 1/1996 |
| JP | 10-010997 | | 1/1998 |
| JP | 10-186310 | | 7/1998 |
| JP | 10-240145 | | 9/1998 |
| JP | 10-254390 | | 9/1998 |
| JP | 10-307284 | A | 11/1998 |
| JP | 10-333591 | | 12/1998 |
| JP | 11-119189 | | 4/1999 |
| JP | 11-119877 | A | 4/1999 |
| JP | 11-194749 | | 7/1999 |
| JP | 11-202285 | A | 7/1999 |
| JP | 11-202286 | A | 7/1999 |
| JP | 11-297485 | | 10/1999 |
| JP | 2000-019487 | | 1/2000 |
| JP | 2000-028984 | | 1/2000 |
| JP | 2000-047208 | | 2/2000 |
| JP | 2000-057832 | | 2/2000 |
| JP | 2000-111871 | | 4/2000 |
| JP | 2000-147454 | | 5/2000 |
| JP | 2000-206486 | | 7/2000 |
| JP | 2000-221469 | | 8/2000 |
| JP | 2000-275605 | | 10/2000 |
| JP | 2001-092370 | | 4/2001 |
| JP | 2001-125067 | | 5/2001 |
| JP | 2001-210122 | | 8/2001 |
| JP | 2001-255507 | | 9/2001 |
| JP | 2001-282117 | | 10/2001 |
| JP | 2001-296838 | | 10/2001 |
| JP | 2001-312241 | | 11/2001 |
| JP | 2001-318614 | | 11/2001 |
| JP | 2002-105447 | | 4/2002 |
| WO | 95/01701 | | 1/1995 |

OTHER PUBLICATIONS

Japanese Office Action mailed Jan. 25, 2005 (w/English translation thereof).

Japanese Office Action mailed Dec. 21, 2004 (w/English translation thereof).

Japanese Office Action mailed Jan. 4, 2005 (w/English translation thereof).

Two Japanese Office Actions mailed Apr. 12, 2005, respectively (w/English translation thereof).

* cited by examiner

FIG. 41

END TIMING OF DIMMING PERIOD

| | | | | | | | | | | |
|---|---|---|---|---|---|---|---|---|---|---|
| 9/10 | ◎ | ○ | △ | △ | △ | △ | △ | △ | △ | × |
| 8/10 | ◎ | ○ | △ | △ | △ | △ | △ | △ | × | ○ |
| 7/10 | ◎ | ○ | △ | △ | △ | △ | △ | × | ○ | ○ |
| 6/10 | ◎ | ○ | △ | △ | △ | △ | × | ○ | ○ | ○ |
| 5/10 | ◎ | ○ | △ | △ | △ | × | ○ | ○ | ○ | ○ |
| 4/10 | ○ | ○ | △ | △ | × | ○ | ○ | ○ | ○ | ○ |
| 3/10 | ○ | ○ | △ | × | ○ | ○ | ○ | ○ | ○ | ○ |
| 2/10 | ○ | ○ | × | ○ | ○ | ○ | ○ | ○ | ○ | ○ |
| 1/10 | ○ | × | ○ | ○ | ○ | ○ | ○ | ○ | ○ | ○ |
| 0/10 | × | ○ | △ | △ | △ | △ | △ | △ | △ | △ |
| f | 0/10 | 1/10 | 2/10 | 3/10 | 4/10 | 5/10 | 6/10 | 7/10 | 8/10 | 9/10 |

START TIMING OF DIMMING PERIOD

LIQUID CRYSTAL DISPLAY DEVICE, IMAGE DISPLAY DEVICE, ILLUMINATION DEVICE AND EMITTER USED THEREFORE, DRIVING METHOD OF LIQUID CRYSTAL DISPLAY DEVICE, DRIVING METHOD OF ILLUMINATION DEVICE, AND DRIVING METHOD OF EMITTER

FIELD OF THE INVENTION

The present invention relates to a liquid crystal display device which displays information by illuminating display elements, an image display device, and an illumination device and an emitter used therefor, and also relates to a driving method of the liquid crystal display device, a driving method of the illumination device, and a driving method of the emitter.

BACKGROUND OF THE INVENTION

One of the problems of liquid crystal display devices, which have been conventionally used as display screens of, for example, lap-top personal computers or word processors, is that a poor image quality results by such a phenomenon as image persistence or image bleeding when displaying a fast-moving image.

In view of this drawback, WO95/01701 (published date: Jan. 12, 1995) (Tokuhyohei 8-500915), Japanese Publication for Unexamined Patent Publication No. 082019/1989 (published date: Mar. 28, 1989) (Tokukaisho 64-082019), and Japanese Publication for Unexamined Patent Publication No. 202286/1999 (Tokukaihei 11-202286) (publication date: Jul. 30, 1999) disclose providing a certain OFF (dark) period per one frame (one vertical synchronize period) for an emitter of a liquid crystal display device, so as to obtain a desirable image quality in fast-moving images.

However, in this conventional technique, a voltage of a rectangular wave is applied to the emitter of the illuminating section. Such application of a rectangular wave to the emitter causes the following problems.

That is, because the applied waveform is a rectangular wave, the emitter has a short life, which is problematic in actual application. For example, when a voltage of a rectangular wave is applied to a common cold cathode tube of a liquid crystal display device, a current flows abruptly through the cold cathode tube at a rise of emission, whereas the current is suddenly shut down in the cold cathode tube at a fall of emission, which may result in a reverse current flow. Such a current behavior is detrimental to life of the cold cathode tube. Further, since the rectangular wave include a high harmonic component, the problem of electromagnetic radiation is posed.

Further, in the foregoing conventional technique, the emitter of the illuminating section is of a white type. In this case, the emitters contain fluorescent materials of at least three colors, corresponding to three primary colors of light. Thus, the emitters have different response times depending on colors, and phases of emission waveforms become different. This causes the coloring phenomenon on image contours in a display of a fast-moving image in particular, thus lowering display quality.

Further, in the foregoing conventional technique, an ON period and an OFF period of the illuminating section exist in one frame. Here, examining temperature of the cold cathode tube, which is the emitter of the illuminating section, the temperature starts to increase from the time of emission, and starts to decrease from the end of emission. Thus, a cooling/heating cycle of a period of one frame is generated on the cold cathode tube.

Such a cooling/heating cycle damages the cold cathode tube and shortens its life. Further, the cooling/heating cycle creates a large temperature difference between the start of emission, at which the temperature of the cold cathode tube is the lowest, and the end of emission, at which the temperature of the cold cathode tube is the highest. It is therefore difficult to maintain the environmental temperature of the cold cathode tube constant. A failure to maintain a constant environmental temperature of the cold cathode tube results in decrease in temperature itself, and luminance is lowered as a result.

The foregoing explained the case of the cold cathode tube, but the same is true for other emitters, for example, such as a light-emitting diode, an electroluminescence element, a hot cathode tube, a mercury lamp, a halogen lamp, and a laser.

Further, Japanese Publication for Unexamined Patent Publication No. 082019/1989 (Tokukaisho 64-082019), Japanese Publication for Unexamined Patent Publication No. 202285/1999 (Tokukaihei 11-202285) (publication date: Jul. 30, 1999), and 202286/1999 (Tokukaihei 11-202286) (publication date: Jul. 30, 1999) teach providing a plurality of emitting areas for the illuminating section in a scanning direction, and having the emitting areas synchronize with a vertical synchronize signal of the image display device. That is, the emitter is adapted so that it is switched ON immediately after scanning of a display section, and is switched OFF after a certain predetermined time period, so as to obtain a desirable display quality.

The illuminating section has a structure wherein cold cathode tubes, etc., are disposed side by side in a scanning direction, parallel to a scanning line, in a back-light section on a back of a display section, and each cold cathode tube illuminates a liquid crystal which corresponds to a predetermined number of scanning lines.

However, when an image is displayed using the foregoing illuminating section, the following problems are posed. That is, in order to improve display quality of a fast-moving image without deficiencies such as image persistence, it is required to illuminate each emitting area with a sufficiently short pulse time width. However, in the foregoing conventional structure, the light from the plurality of cold cathode tubes reaches a display area other than the display area to be illuminated, for example, such as an adjacent display area. Thus, considering a specific display area in an image panel such as a liquid crystal panel, this display area is illuminated by a plurality of cold cathode tubes. As such is the case, even when the area is to be illuminated with a short pulse time width to improve display quality of a fast-moving image as described above, the pulse time width is essentially increased. Thus, the conventional structure fails to improve display quality with a short pulse time width, and the effect of shortening the pulse width time becomes weak.

Further, in the foregoing conventional technique, in successively scanning the illuminating section of the image display device for lighting, each emitter must have an OFF operation. However, this OFF operation poses the following problems.

(1) By the repeated ON and OFF of the emitter at the frame frequency, the emitter is damaged and the life of the emitter becomes short as a result.

(2) By the presence of the OFF period, display luminance is lowered significantly.

SUMMARY OF THE INVENTION

The present invention was made in view of the foregoing problems and it is an object of the present invention to provide a liquid crystal display device, an emitter, and an emitter driving method, all capable of realizing a desirable display quality also in a fast-moving image, while suppressing shortening of life of emitters in an illuminating section and reducing influence of electromagnetic waves.

Another object of the present invention is to provide a liquid crystal display device, a driving method of a liquid crystal display device, and an illumination device, for relieving a coloring phenomenon on image contours, which is caused when the emitters of the illuminating section are controlled to include a certain OFF period or dimming period per one vertical period.

Yet another object of the present invention is to provide an image display device, an illumination device, and a driving method of an illumination device, all capable of illuminating each emitting area with a pulse time width which is practically and sufficiently short, so as to improve display quality by eliminating image persistence in a fast-moving image.

Still another object of the present invention is to provide an image display device, an emitter, and a driving method of the emitter, all capable of obtaining a desirable display quality also in a fast-moving image, and effectively preventing shortening of life and lowering of luminance of the emitter.

Yet another object of the present invention is to provide a liquid crystal display device and an illumination device capable of obtaining a desirable display quality also in a fast-moving image, while suppressing shortening of life of emitters of an illuminating section, and reducing lowering of luminance of the emitters.

In order to achieve the foregoing objects, a liquid crystal display device of the present invention, in a liquid crystal display device which includes an emitter for illuminating pixels with light which is in accordance with a driving signal, includes an emission control section for controlling the driving signal so that a rise and a fall of an emission waveform of the emitter are slacked per one vertical period.

Further, in order to achieve the foregoing objects, a liquid crystal display device of the present invention, in a liquid crystal display device which includes an emitter for illuminating pixels with light which is in accordance with a driving signal, includes an emission control section for controlling the driving signal so that the driving signal makes up a sinusoidal wave whose frequency essentially matches an inverse of a vertical period.

Further, in order to achieve the foregoing objects, a liquid crystal display device of the present invention, in a liquid crystal display device which includes an emitter for illuminating pixels with light which is in accordance with a driving signal, includes an emission control section for controlling the driving signal so that the driving signal makes up a sinusoidal wave whose envelope has a frequency which essentially matches an inverse of a vertical period.

Further, in order to achieve the foregoing objects, a liquid crystal display device of the present invention, in a liquid crystal display device which includes an emitter for illuminating pixels with light which is in accordance with a driving signal, includes an emission control section for controlling the driving signal so that the driving signal makes up a Gaussian distribution waveform whose repetitive period essentially matches a vertical period.

Further, in order to achieve the foregoing objects, a liquid crystal display device of the present invention, in a liquid crystal display device which includes an emitter for illuminating pixels with light which is in accordance with a driving signal, includes an emission control section for controlling the driving signal so that the driving signal makes up a Gaussian distribution waveform whose envelope has a repetitive period which essentially matches a vertical period.

Further, in order to achieve the foregoing objects, a liquid crystal display device of the present invention, in a liquid crystal display device which includes an emitter for illuminating pixels with light which is in accordance with a driving signal, includes an emission control section for controlling the driving signal so that the driving signal makes up a Lorentz distribution waveform whose repetitive period essentially matches a vertical period.

Further, in order to achieve the foregoing objects, a liquid crystal display device of the present invention, in a liquid crystal display device which includes an emitter for illuminating pixels with light which is in accordance with a driving signal, includes an emission control section for controlling the driving signal so that the driving signal makes up a Lorentz distribution waveform whose envelope has a repetitive period which essentially matches a vertical period.

Further, in order to achieve the foregoing objects, a liquid crystal display device of the present invention, in a liquid crystal display device which includes an emitter for illuminating pixels with light which is in accordance with a driving signal, includes an emission control section for controlling the driving signal so that the driving signal makes up a triangular wave whose frequency essentially matches an inverse of a vertical period.

Further, in order to achieve the foregoing objects, a liquid crystal display device of the present invention, in a liquid crystal display device which includes an emitter for illuminating pixels with light which is in accordance with a driving signal, includes an emission control section for controlling the driving signal so that the driving signal makes up a triangular wave whose envelope has a frequency which essentially matches an inverse of a vertical period.

Further, an emitter driving method of the present invention is for slacking a rise and a fall of a driving signal of an emitter provided in a liquid crystal display device.

Further, an emitter driving method of the present invention is for slacking a rise and a fall of an envelope of a driving signal of an emitter provided in a liquid crystal display device.

Further, an emitter driving method of the present invention is for converting a driving signal of an emitter provided in a liquid crystal display device into a periodic waveform which is in synchronism with a vertical synchronize signal.

Further, an emitter driving method of the present invention is for converting an envelope of a driving signal of an emitter provided in a liquid crystal display device into a periodic waveform which is in synchronism with a vertical synchronize signal.

Further, an emitter of the present invention receives a driving signal with slacked rise and fall.

Further, an emitter of the present invention receives a driving signal with slacked rise and fall of its envelope.

Further, an emitter of the present invention receives a driving signal having a periodic waveform which is in synchronism with a vertical synchronize signal.

Further, an emitter of the present invention receives a driving signal having a periodic waveform whose envelope is in synchronism with a vertical synchronize signal.

Further, a liquid crystal display device of the present invention, in a liquid crystal display device including, per one vertical period, a period of reduced luminance of light for illuminating pixels, includes an emitter which independently emits at least one of three primary colors of light.

Further, a liquid crystal display device of the present invention includes a plurality of cold cathode tubes, containing fluorescent materials, for illuminating pixels with light which is in accordance with driving signals; and an emission control section for controlling the driving signals so that changes in luminance of the plurality of cold cathode tubes with respect to time substantially coincide with one another in the vicinity of rise time and fall time per one vertical period, wherein: at least one of the plurality of cold cathode tubes contains only a fluorescent material of one color among three primary colors of light, and the driving signal applied to this cold cathode tube is controlled by the emission control section.

Further, a liquid crystal display device of the present invention includes a first cold cathode tube and a second cold cathode tube, respectively containing fluorescent materials, for illuminating pixels with light which is in accordance with driving signals; and an emission control section for controlling the driving signals so that changes in luminance of the plurality of cold cathode tubes with respect to time substantially coincide with one another in the vicinity of rise time and fall time per one vertical period, wherein: the first cold cathode tube contains only a fluorescent material of green among three primary colors of light, and the second cold cathode tube contains fluorescent materials of red and green among the three primary colors of light, and the driving signals respectively applied to the first and second cold cathode tubes are controlled by the emission control section.

Further, a liquid crystal display device of the present invention includes first through third cold cathode tubes, respectively containing fluorescent materials, for illuminating pixels with light which is in accordance with driving signals; and an emission control section for controlling the driving signals so that changes in luminance of the plurality of cold cathode tubes with respect to time substantially coincide with one another in the vicinity of rise time and fall time per one vertical period, wherein: the first cold cathode tube contains only a fluorescent material of green among three primary colors of light, the second cold cathode tube contains only a fluorescent material of red among three primary colors of light, and the third cold cathode tube contains only a fluorescent material of blue among three primary colors of light, and the driving signals respectively applied to the first through third cold cathode tubes are controlled by the emission control section.

Further, a liquid crystal display device of the present invention includes a first cold cathode tube and a second cold cathode tube, respectively containing fluorescent materials, for illuminating pixels with light which is in accordance with driving signals; and an emission control section for controlling the driving signals so that changes in luminance of the plurality of cold cathode tubes with respect to time substantially coincide with one another in the vicinity of rise time and fall time per one vertical period, wherein: the first cold cathode tube contains fluorescent materials of green and red among three primary colors of light, and the second cold cathode tube contains only a fluorescent material of blue among the three primary colors of light, and the driving signals respectively applied to the first and second cold cathode tubes are controlled by the emission control section.

Further, a driving method of a liquid crystal display device of the present invention is for a liquid crystal display device which is provided with a period of reduced luminance of light for illuminating pixels per one vertical period, and which includes an emitter for independently emitting at least one of three primary colors of light, the method controlling at least one of a period in which luminance of light is not reduced and an amplitude of the luminance of light of the emitter.

Further, a driving method of a liquid crystal display device of the present invention is for a liquid crystal display device which includes a plurality of cold cathode tubes, containing fluorescent materials, for illuminating pixels with light which is in accordance with driving signals, and in which the driving signals are controlled so that changes in luminance of the plurality of cold cathode tubes with respect to time substantially coincide with one another in the vicinity of rise time and fall time per one vertical period, the method controlling the driving signal which is applied to at least one of the plurality of cold cathode tubes which contains only a fluorescent material of one of three primary colors of light.

Further, a driving method of a liquid crystal display device of the present invention, in a liquid crystal display device which includes a first cold cathode tube and a second cold cathode tube, respectively containing fluorescent materials, for illuminating pixels with light which is in accordance with driving signals, and in which the driving signals are controlled so that changes in luminance of the first and second cold cathode tubes with respect to time substantially coincide with one another in the vicinity of rise time and fall time per one vertical period, the first cold cathode tube containing only a fluorescent material of green among three primary colors of light, and the second cold cathode tube containing fluorescent materials of red and blue among the three primary colors of light, the method controlling the driving signals which are respectively applied to the first and second cold cathode tubes.

Further, a driving method of a liquid crystal display device of the present invention is for a liquid crystal display device which includes first through third cold cathode tubes, respectively containing fluorescent materials, for illuminating pixels with light which is in accordance with driving signals, and in which the driving signals are controlled so that changes in luminance of the first through third cold cathode tubes with respect to time substantially coincide with one another in the vicinity of rise time and fall time per one vertical period, the first cold cathode tube containing only a fluorescent material of green among three primary colors of light, and the second cold cathode tube containing only a fluorescent material of red among the three primary colors of light, and the third cold cathode tube containing only a fluorescent material of blue among the three primary colors of light, the method controlling the driving signals which are respectively applied to the first through third cold cathode tubes.

Further, a driving method of a liquid crystal display device of the present invention is for a liquid crystal display device which includes a first cold cathode tube and a second cold cathode tube, respectively containing fluorescent materials, for illuminating pixels with light which is in accordance with driving signals, and in which the driving signals are controlled so that changes in luminance of the first and second cold cathode tubes with respect to time substantially coincide with one another in the vicinity of rise time and fall time per one vertical period, the first cold cathode tube containing fluorescent materials of green and red among three primary colors of light, and the second cold cathode tube containing only a fluorescent material of blue among the three primary colors of light, the method controlling the driving signals which are respectively applied to the first and second cold cathode tubes.

Further, an illumination device of the present invention is for illuminating pixels of a liquid crystal display device, luminance of the illumination device including an emitting period and a dimming period of a certain phase with respect to a vertical synchronize signal, and the dimming period being in a range of 10% to 90% of one vertical period, the illumination device independently controlling the emitting period and the dimming period of an emitter of at least one of three primary colors of light.

Further, an image display device of the present invention includes a plurality of display elements, making up a screen, for modulating light according to image data which is applied while being scanned; and an illuminating section for illuminating the display elements, wherein: when those of the display elements having the same scanning time make up a display element band, the display element band is grouped into display element groups in order of earlier scanning time and to include at least one display element band in one display element group, and the illuminating section includes a plurality of illuminating elements, at least one of which is provided for each display element group, and each illuminating element illuminates the display elements per the display element group while undergoing change between first luminance and second luminance which is darker than the first luminance, at a period of one frame time of the screen and at a timing of change which is different in each display element group, and between the illuminating elements are provided a partition member for parting adjacent illuminating elements.

Further, an image display device of the present invention includes a plurality of display elements, making up a screen, for modulating light according to image data which is applied while being scanned; and an illuminating section for illuminating the display elements, wherein: when those of the display elements having the same scanning time make up a display element band, the display element band is grouped into display element groups in order of earlier scanning time and to include at least one display element band in one display element group, and the illuminating section includes a plurality of illuminating elements, at least one of which is provided for each display element group, and a reflecting plate for reflecting light from the illuminating elements in a direction toward the display elements, and each illuminating element illuminates the display elements per the display element group while undergoing change between first luminance and second luminance which is darker than the first luminance, at a period of one frame time of the screen and at a timing of change which is different in each display element group, and the reflecting plate has concave portions in which the illuminating elements are disposed.

Further, an illumination device of the present invention, in an illumination device for illuminating display elements of a display device of a shutter type which includes display elements for switching ON/OFF transmission of light according to display data, has an arrangement wherein: the illumination device includes a plurality of illuminating elements which undergo change between first luminance and second luminance which is darker than the first luminance within one vertical period while being scanned, so as to illuminate the display elements, and the illuminating elements are grouped into illuminating element groups to include at least one illuminating element in one illuminating element group, and a timing of change of luminance of each illuminating element is different in each illuminating element group, and the illuminating element groups are divided so that illuminating elements of adjacent illuminating element groups illuminate display elements in different areas of the display device of a shutter type.

Further, in a driving method of an illumination device of the present invention, using any of the foregoing illumination devices, the driving method causes change in luminance of the illuminating elements between the first luminance and the second luminance within one vertical period, and a timing of change of luminance has a certain phase with respect to a scanning timing of the display elements which are illuminated by each illuminating element.

Further, an image display device of the present invention, in an image display device which includes a plurality of display elements, making up a screen, for modulating light according to image data which is applied while being scanned; and an illuminating section for illuminating the display elements, has an arrangement wherein: when those of the display elements having the same scanning time make up a display element band, the display element band is grouped into display element groups in order of earlier scanning time and to include at least one display element band in one display element group, and the illuminating section illuminates the display elements per the display element group while undergoing change between first luminance and second luminance which is darker than the first luminance and brighter than an OFF state, at a period of one vertical period of the screen and at a timing of change which is different in each display element group.

Further, an emitter of the present invention includes a period of emitting light at a first luminance level and a period of emitting light at a second luminance level within a vertical period, the first luminance level and the second luminance level being different from each other and brighter than an OFF state.

Further, in a driving method of an emitter of the present invention, a first driving signal and a second driving signal are inputted into an emitter at different timings within a vertical period, so that luminance of the emitter becomes different when the emitter receives the first driving signal and when the emitter receives the second driving signal, and that the luminance by the first driving signal and the luminance by the second driving signal are brighter than an OFF state.

Further, a liquid crystal display device of the present invention, in a liquid crystal display device which includes an emitter for illuminating pixels with light which is in accordance with a driving signal, includes an emission control section for controlling the driving signal so that one vertical synchronize period includes two or more of separate periods of reduced luminance of the emitter, and that luminance of the emitter is changed by a period of one vertical synchronize period.

Further, an illumination device of the present invention, in an illumination device which includes an emitter for emitting light which is in accordance with a driving signal, luminance of the emitter being periodically changed, includes an emission control section for controlling the driving signal so that one period includes two or more separate periods of reduced luminance of the emitter.

For a fuller understanding of the nature and advantages of the invention, reference should be made to the ensuing detailed description taken in conjunction with the accompanying drawings.

BRIEF DESCRIPTION OF THE DRAWINGS

FIG. 41 is an explanatory drawing showing a relationship between dimming timings and a display quality.

DESCRIPTION OF THE EMBODIMENTS

[First Embodiment]

Figure 1:
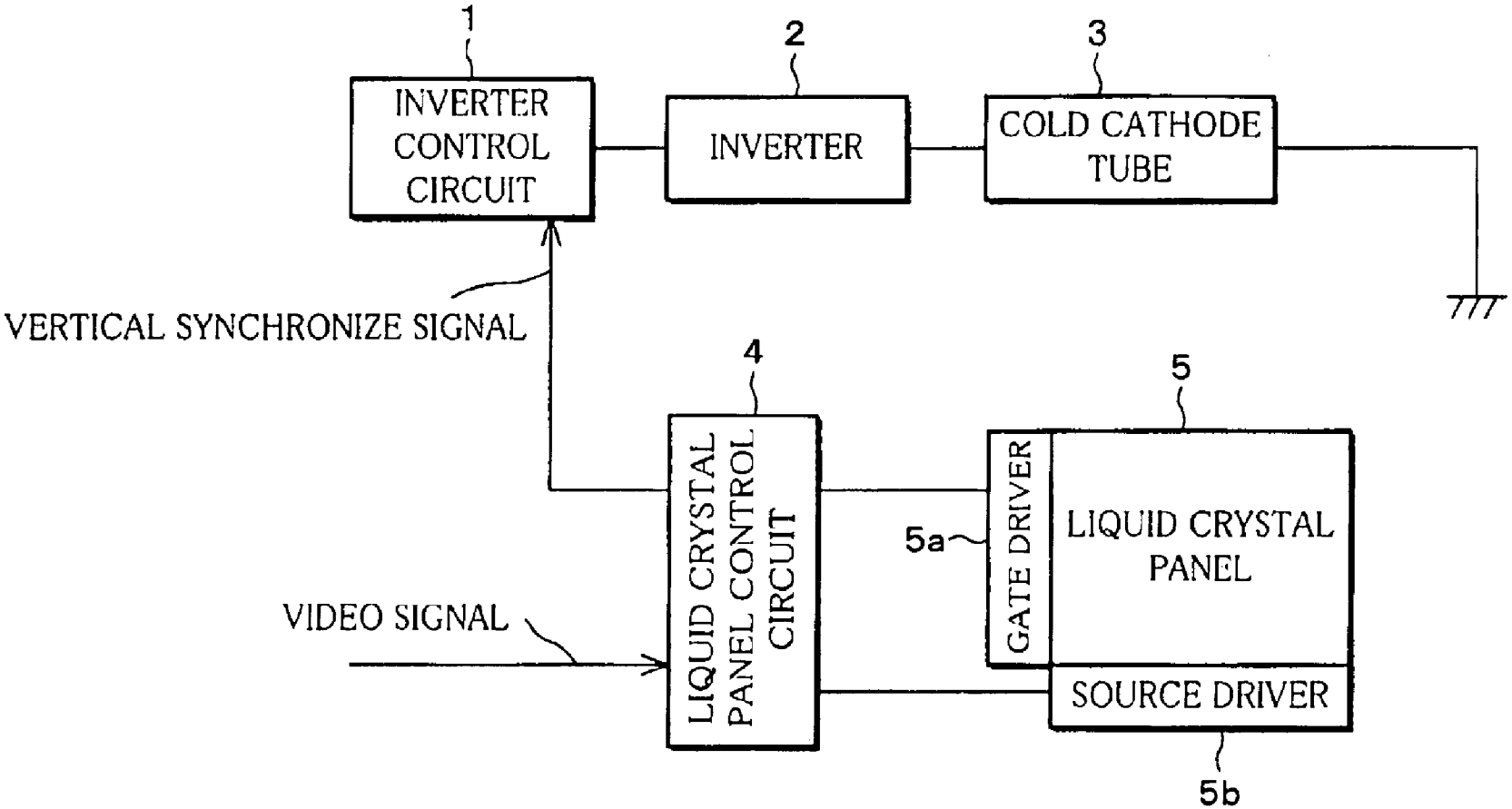
FIG. 1 is an explanatory drawing showing an exemplified structure of a liquid crystal display device of the present invention.
Figure 2:
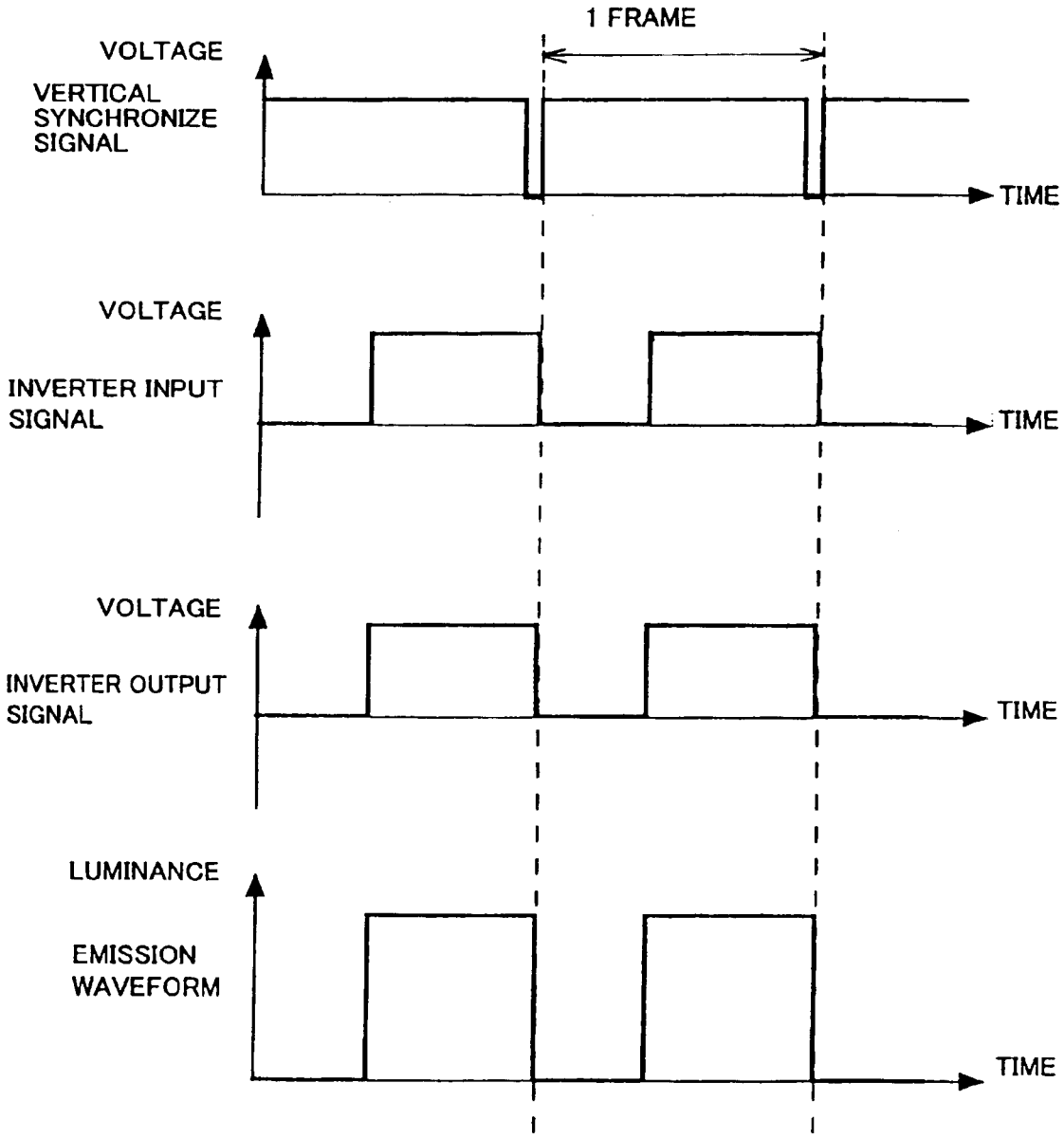
FIG. 2 is a waveform diagram showing examples of applied signal waveforms, explaining operations of the liquid crystal display device.
Figure 3:
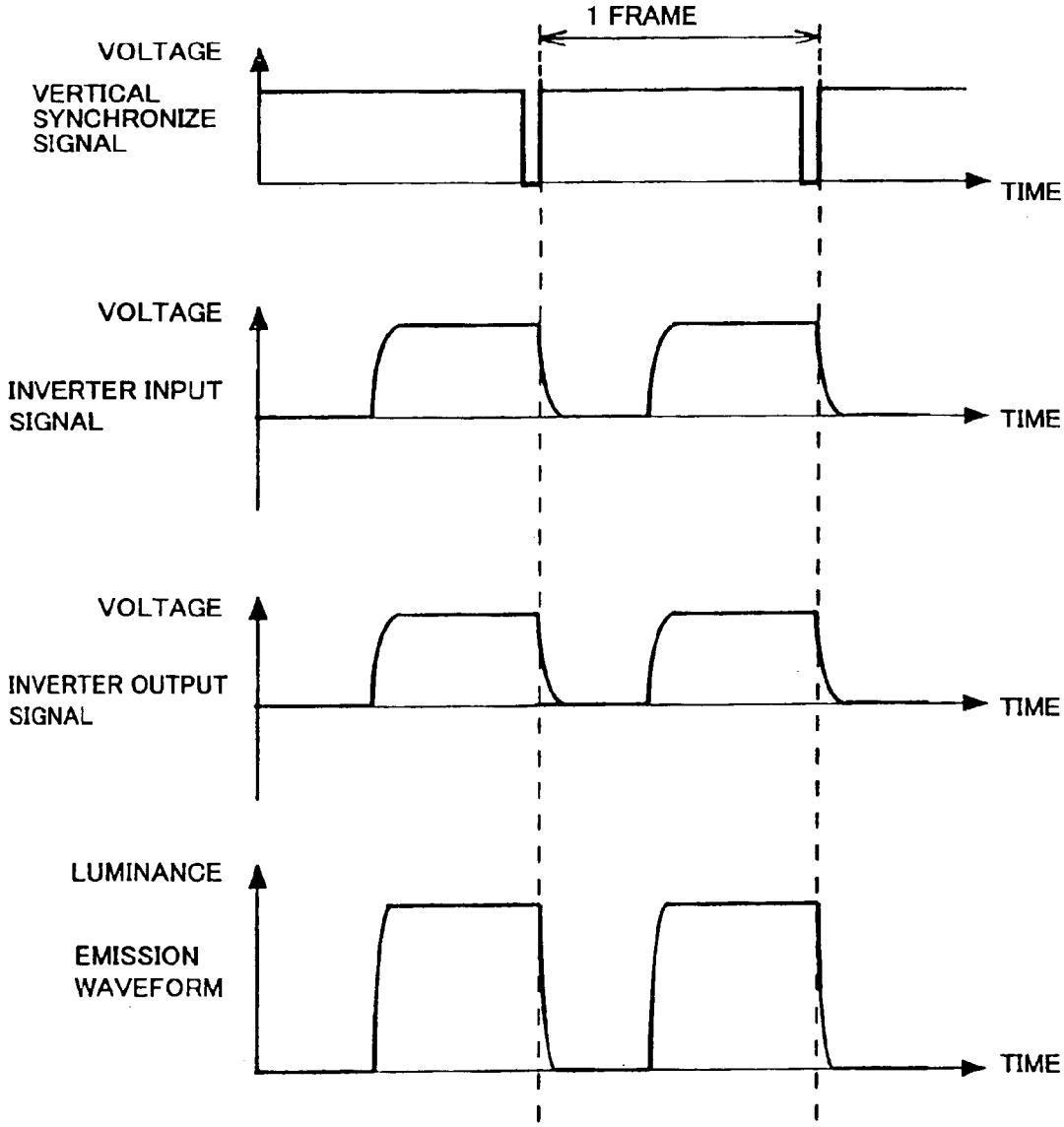
FIG. 3 is a waveform diagram showing examples of applied signal waveforms for overcoming problems caused by the signal waveforms of FIG. 2.

The following will describe one embodiment of the present invention referring to FIG. 1 through FIG. 3.

A liquid crystal display device (active-matrix liquid crystal display device) according to the present embodiment chiefly includes, as shown in FIG. 1, an inverter control circuit 1, an inverter 2, a cold cathode tube 3 (emitter), a liquid crystal panel control circuit 4, and a liquid crystal panel 5.

The inverter control circuit 1 receives a vertical synchronize signal which is outputted from the liquid crystal panel control circuit 4, and outputs an inverter driving signal for driving the inverter 2 to the inverter 2. The inverter 2 applies to the cold cathode tube 3 (white cold cathode tube) a high voltage whose frequency is varied according to the inverter driving signal. The cold cathode tube 3, upon receiving the high voltage, emits light to illuminate the liquid crystal panel 5.

The liquid crystal panel control circuit 4, upon input of a video signal, separates synchronize signals, of which the vertical synchronize signal is sent to the inverter control circuit 1 as described above. Further, a gate driver 5*a* and a source driver 5*b* for driving scanning lines and signal lines (both not shown) are driven based on the video signal to select desired pixels (not shown), such that the light emitted by the cold cathode tube 3 travels through the selected pixels to display the video signal.

The following describes the case where main signals of the liquid crystal display device (vertical synchronize signal, inverter input signal (inverter driving signal), inverter output signal, and emission waveform) have waveforms as shown in FIG. 2.

In this case, by providing an OFF period per one frame, a viewer would see only a moment of high contrast as a persistent image, which is perceived as a clear image with good contrast, thus improving display quality of fast-moving images in particular.

However, when the inverter output signal has a rectangular waveform as shown in FIG. 2, an electromagnetic radiation of high frequency is observed, which can be harmful to the human body. Further, when a high voltage of a rectangular wave is applied to the cold cathode tube 3, a current flows through the cold cathode tube 3 abruptly at the rise of emission (luminance), whereas the current of the cold cathode tube 3 is shut down abruptly at the fall of the emission. This may cause a reverse current flow through the cold cathode tube 3, and such a current behavior is detrimental to life of the cold cathode tube 3.

In view of this drawback, in the present embodiment, as shown in FIG. 3, the rise and fall of the waveform of the inverter input signal (inverter driving signal) are slacked in the inverter control circuit 1. Accordingly, the rise and fall of the waveform of the inverter output signal applied to the cold cathode tube 3 from the inverter 2 are slacked as well.

In this manner, by applying a high voltage with the slacked raise and fall to the cold cathode tube 3, the light emitted by the cold cathode tube 3 also has the slacked rise and fall. That is, the rise of emission is slacked by the application of the inverter output signal as shown in FIG. 3 to the cold cathode tube 3. This prevents a sudden current flow through the cold cathode tube 3, and since the fall of emission is slacked, the current of the cold cathode tube 3 will not be shut down abruptly, thus avoiding a reverse current flow through the cold cathode tube 3. This current behavior ensures preventing the detrimental effect to the life of the cold cathode tube 3.

Further, since the inverter output signal applied to the cold cathode tube 3 has the slacked rise and fall, the high harmonic component can be reduced or relieved to effectively reduce the harmful electromagnetic wave to the human body, thereby overcoming the problem of electromagnetic wave.

Further, by the provision of a period of reduced luminance of the cold cathode tube 3 per one frame, a viewer would see only a moment of high contrast as a persistent image, which is perceived as a clear image with good contrast, thus improving display quality of fast-moving images in particular.

Figure 4:
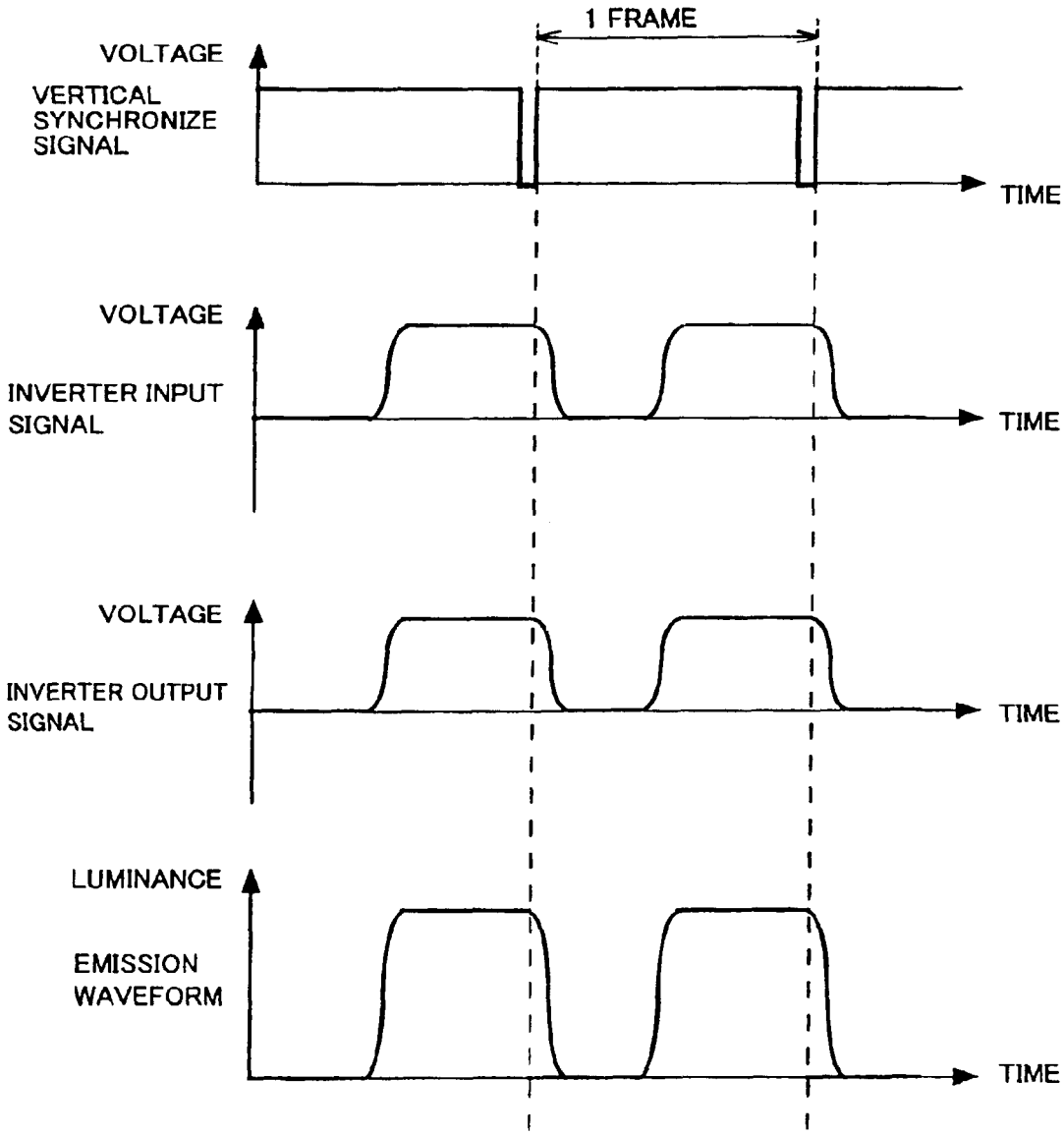
FIG. 4 is a waveform diagram showing different examples of applied signal waveforms for overcoming problems caused by the signal waveforms of FIG. 2.

The following will describe another embodiment of the present invention referring to FIG. 4. According to this embodiment, the inverter control circuit 1 of the liquid crystal display device of FIG. 1 has a waveform, as shown in FIG. 4, whose rise and fall are slacked to be part of a sinusoidal wave. Accordingly, the inverter output signal applied to the cold cathode tube 3 from the inverter 2 also has a waveform whose rise and fall are slacked to make up a part of a sinusoidal wave.

In this manner, by applying a high voltage with the slacked rise and fall making up a part of a sinusoidal wave to the cold cathode tube 3, the light emitted by the cold cathode tube 3 also has a rise and fall which are slacked to be part of a sinusoidal wave. That is, by applying the inverter output signals as shown in FIG. 3 and FIG. 4 to the cold cathode tube 3, there will be no sudden current flow in the cold cathode tube 3, and the current of the cold cathode tube 3 will not be shut down abruptly at the fall of emission, thus preventing a reverse current flow through the cold cathode tube 3. This current behavior ensures preventing the detrimental effect to the life of the cold cathode tube 3.

Further, since the inverter output signal applied to the cold cathode tube 3 has the rise and fall which are slacked to be a part of a sinusoidal wave, the high harmonic component can be reduced or relieved to effectively reduce the harmful electromagnetic wave to the human body, thereby overcoming the problem of electromagnetic wave.

Further, by the provision of a period of reduced luminance of the cold cathode tube 3 per one frame, a viewer would see only a moment of high contrast as a persistent image, which is perceived as a clear image with good contrast, thus improving display quality of fast-moving images in particular.

Figure 5:
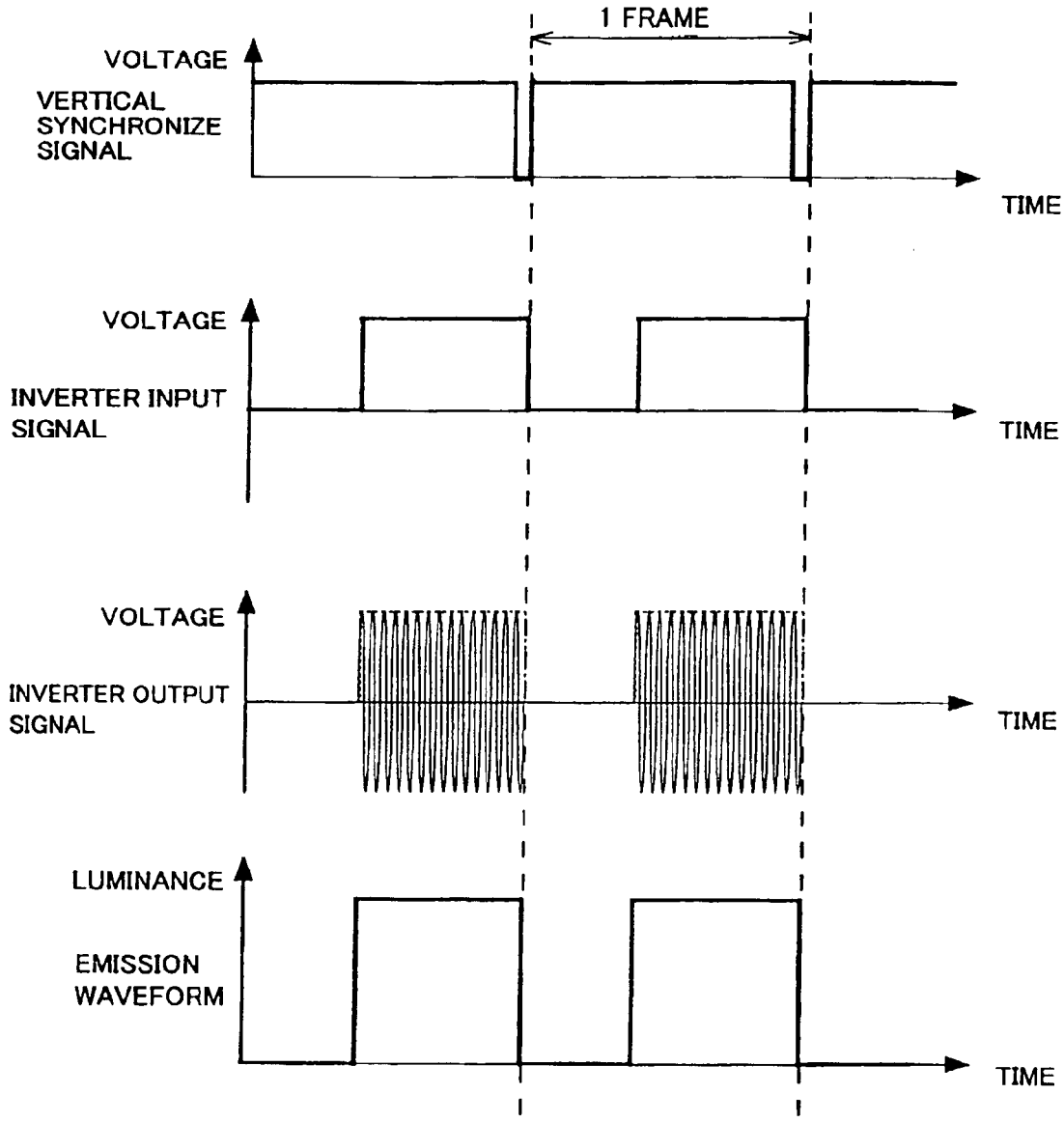
FIG. 5 is a waveform diagram showing another examples of applied signal waveforms, explaining operations of the liquid crystal display device.
Figure 6:
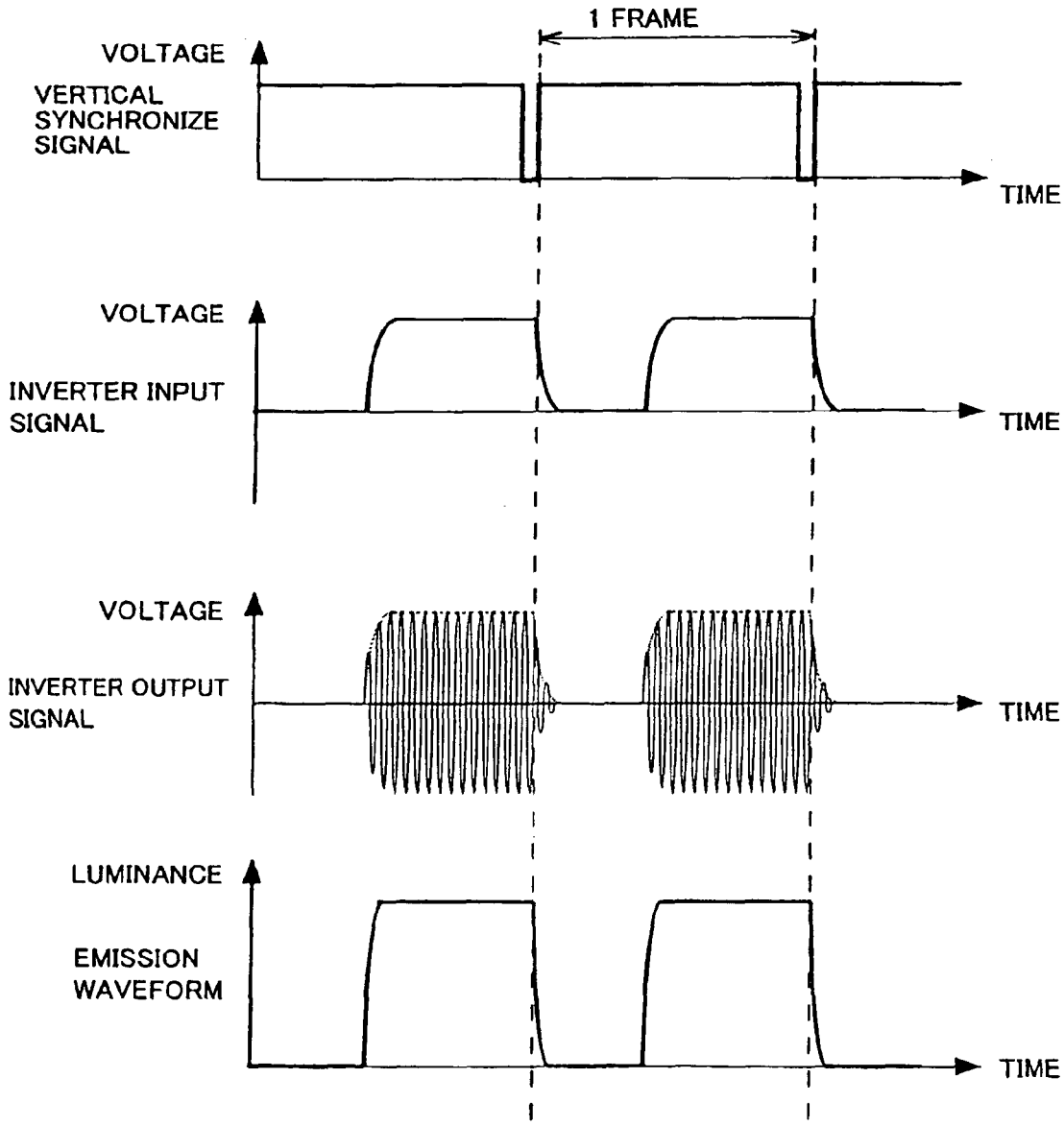
FIG. 6 is a waveform diagram showing examples of applied signal waveforms for overcoming problems caused by the signal waveforms of FIG. 5.

The following will describe still another embodiment of the present invention referring to FIG. 5 and FIG. 6. According to this embodiment, the inverter 2 of the liquid crystal display device of FIG. 1 receives a driving waveform outputted from the inverter control circuit 1, and applies a predetermined high-frequency and high-voltage waveform to the cold cathode tube 3.

The following description is based on the case where main signals of the liquid crystal display device (vertical synchronize signal, inverter input signal (inverter driving signal), inverter output signal, and emission waveform) have waveforms as shown in FIG. 5.

By thus providing an OFF period per one frame, a viewer would see only a moment of high contrast as a persistent image, which is perceived as a clear image with good contrast, thus improving display quality of fast-moving images in particular. However, here, a high-harmonic electromagnetic wave of the inverter driving signal is observed, which can be harmful to the human body. Further, this is even more detrimental to the life of the cold cathode tube, compared with the case where the cold cathode tube is continuously ON.

In view of this drawback, as shown in FIG. 6, the inverter control circuit 1 is adapted such that the rise and fall of the inverter input signal (inverter driving signal) are slacked, so that the rise and fall of the envelope of the waveform of the inverter output signal are also slacked.

To this end, a driving signal line of the inverter control circuit 1 is grounded via a capacitor (not shown). The capacitor was selected to have a capacitance of 1 $\mu$F. This created a circuit time constant by an inverter input resistance and the capacitance of the capacitor, allowing the inverter input signal of a rectangular waveform to be slacked with the time constant of about 1 ms to 2 ms.

The same result was obtained when the capacitor was provided in the inverter 2. However, in the case where the cold cathode tube is driven by a high-frequency alternating current to be described later, it is preferable to insert the capacitor before the inverter 2 generates a waveform of a high-frequency alternating current.

By applying the high-frequency high voltage with the slacked rise and fall of its envelope to the cold cathode tube 3, the light emitted by the cold cathode tube 3 also has the envelope whose rise and fall are slacked. That is, by applying the inverter output signal as shown in FIG. 6 to the cold cathode tube 3, there will be no sudden current flow in the cold cathode tube 3, and the current of the cold cathode tube 3 will not be shut down abruptly at the fall of emission, thus preventing a reverse current flow through the cold cathode tube 3. This current behavior ensures preventing the detrimental effect to the life of the cold cathode tube 3.

Further, since the inverter output signal applied to the cold cathode tube 3 has the envelope with the slacked rise and fall, the high harmonic component can be reduced or relieved to effectively reduce the harmful electromagnetic wave to the human body, thereby overcoming the problem of electromagnetic wave.

Further, by the provision of a period of reduced luminance of the cold cathode tube 3 per one frame, a viewer would see only a moment of high contrast as a persistent image, which is perceived as a clear image with good contrast, thus improving display quality of fast-moving images in particular.

Figure 7:
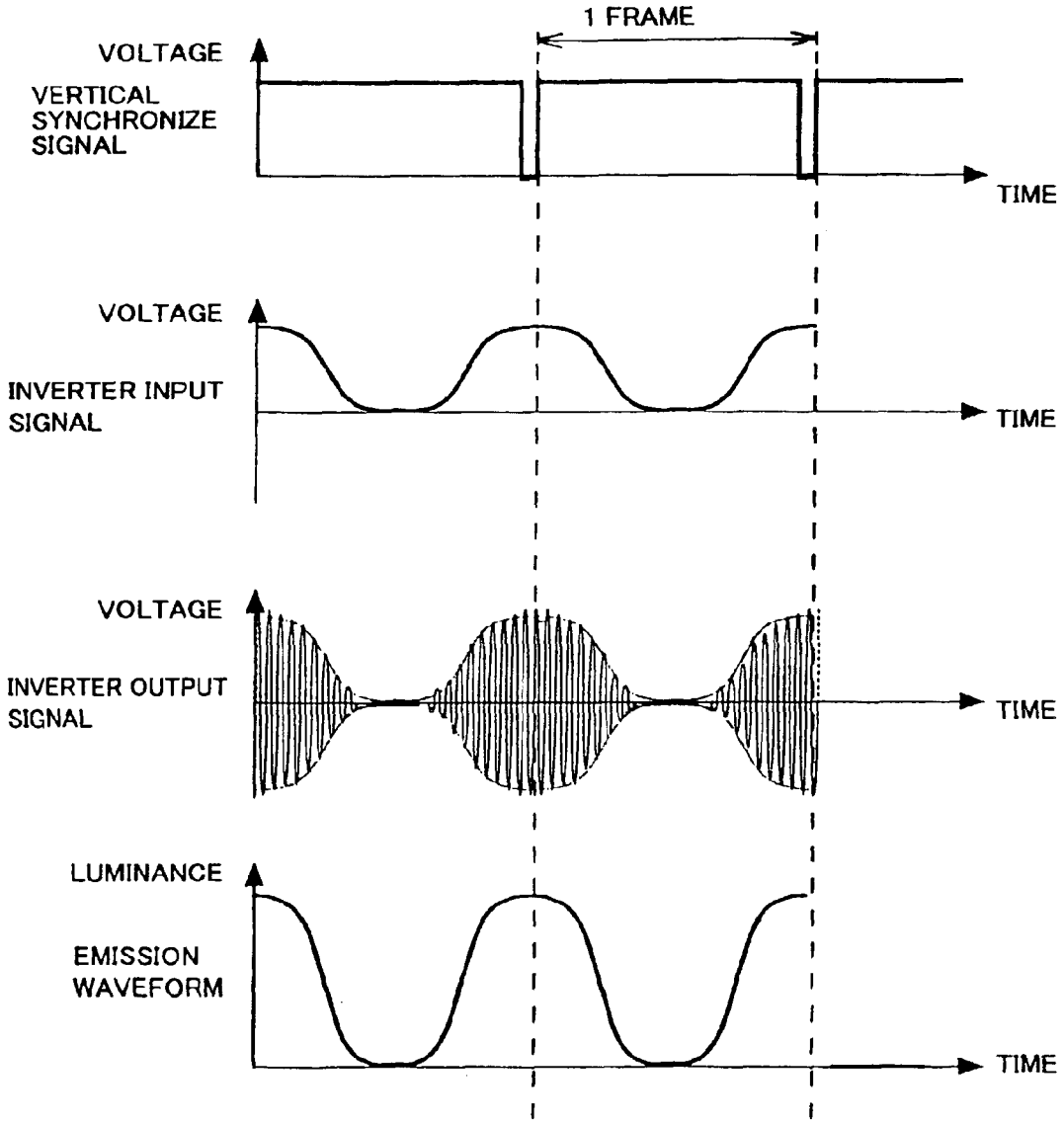
FIG. 7 is a waveform diagram showing different examples of applied signal waveforms for overcoming problems caused by the signal waveforms of FIG. 5.

The following will describe yet another embodiment of the present invention referring to FIG. 7. According to this embodiment, the inverter 2 of the liquid crystal display device of FIG. 1 receives a driving waveform outputted from the inverter control circuit 1, and applies a predetermined high-frequency high-voltage waveform to the cold cathode tube 3. As shown in FIG. 7, the inverter control circuit 1 is adapted so that the waveform of the inverter input signal (inverter driving signal) becomes a sinusoidal wave with its frequency matching the frame frequency. Accordingly, the rise and fall of the envelope of the waveform of the inverter output signal applied to the cold cathode tube from the inverter 2 become a sinusoidal wave with its frequency matching the frame frequency. Note that, in this embodiment, a sinusoidal wave generating circuit is included in the inverter control circuit 1 to create a sinusoidal wave. However, the present invention is not limited to this and the same result can also be obtained by providing the sinusoidal wave generating circuit, for example, in the inverter 2.

In this manner, the rise and fall of the envelope make up a sinusoidal wave with its frequency matching the frame frequency, and by applying this high-frequency high voltage to the cold cathode tube 3, the light emitted by the cold cathode tube 3 also has a sinusoidal wave with the rise and fall of its envelope having a frequency matching the frame frequency. That is, by applying the inverter output signal as shown in FIG. 7 to the cold cathode tube 3, the rise of the envelope of the emission waveform becomes a sinusoidal wave, and there will be no sudden current flow in the cold cathode tube 3, and the current of the cold cathode tube 3 will not be shut down abruptly at the fall of emission because the fall of the envelope makes up a sinusoidal wave, thus preventing a reverse current flow through the cold cathode tube 3. This current behavior ensures preventing the detrimental effect to the life of the cold cathode tube 3.

Further, since the inverter output signal applied to the cold cathode tube 3 has the envelope with the rise and fall making up a sinusoidal wave of a frequency matching the frame frequency, the high harmonic component can be reduced or relieved to effectively reduce the harmful electromagnetic wave to the human body, thereby overcoming the problem of electromagnetic wave.

Further, by the provision of a period of reduced luminance of the cold cathode tube 3 per one frame, a viewer would see only a moment of high contrast as a persistent image, which is perceived as a clear image with good contrast, thus improving display quality of fast-moving images in particular.

This embodiment described the case where the rise and fall of the envelope of the waveform of the inverter output signal make up a sinusoidal wave of a frequency matching the frame frequency. However, not limited to this, the present invention may have an arrangement where a sinusoidal wave of a frequency matching the frame frequency is directly applied to the cold cathode tube 3. The foregoing functions and effects can also be obtained in this case.

Further, even though the foregoing described the case of a sinusoidal wave, the present invention is not limited to this and can employ other waves of a similar shape such as a rectangular wave. The same effects can also be obtained in this case.

The cold cathode tube of FIG. 2 was selected to have an extremely short response time (1 ms or less) with respect to ON (rise) and OFF (fall) of emission. The response time is adjusted by selecting a fluorescent material to be sealed in the cold cathode tube.

Thus, depending on the types of fluorescent materials sealed in the cold cathode tube, there are cases where the response time becomes several ms to several ten ms. However, a response time in an emission phenomena is to be decided by a waveform of the inverter output signal, irrespective of a current phenomena in the cold cathode tube. Therefore, the effects of the present invention can be obtained even when a fluorescent material with a short response time is sealed.

Figure 8:
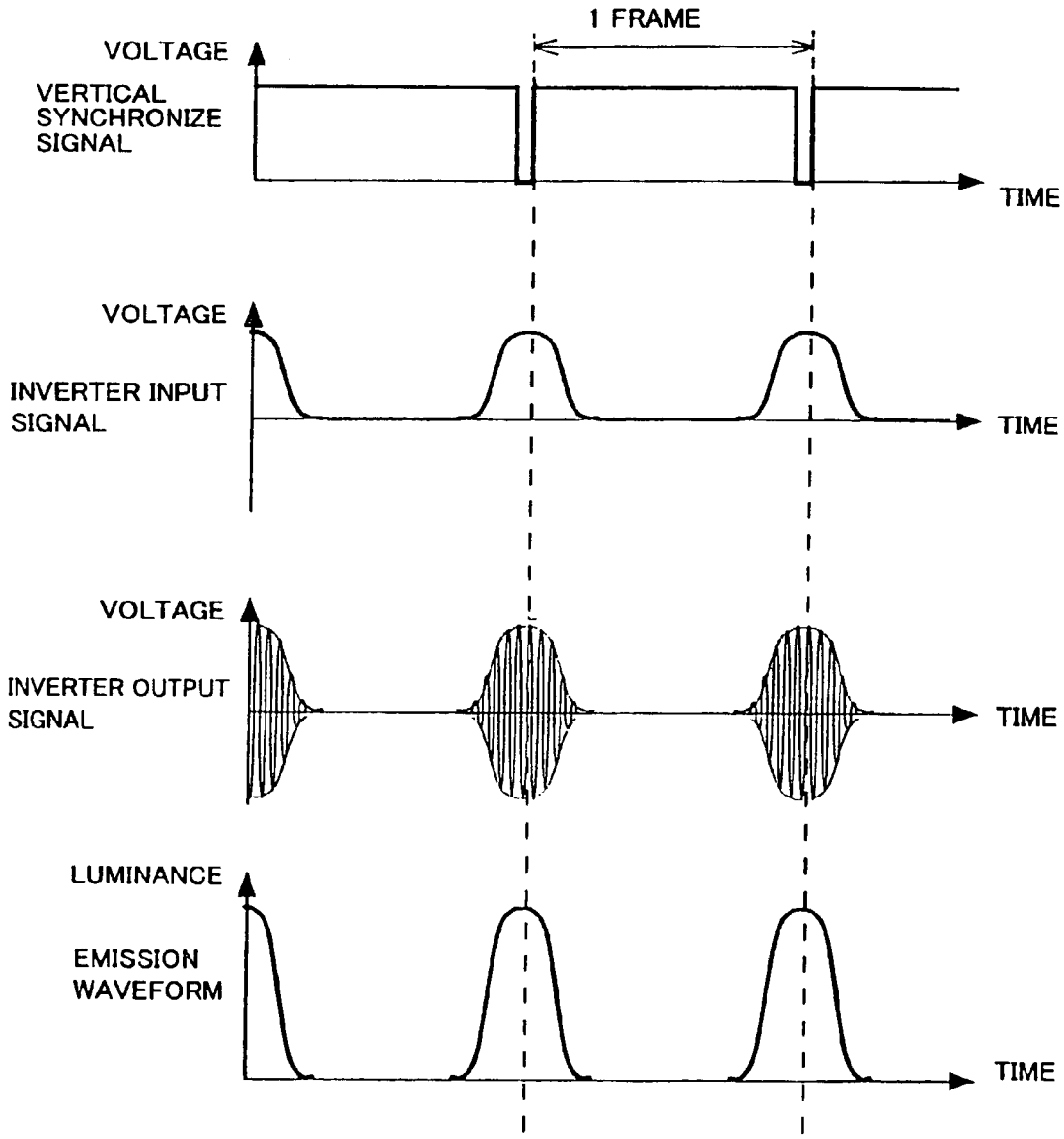
FIG. 8 is a waveform diagram showing yet different examples of applied signal waveforms for overcoming problems caused by the signal waveforms of FIG. 5.

The following will describe yet another embodiment of the present invention referring to FIG. 8. According to this embodiment, the inverter 2 of the liquid crystal display device of FIG. 1 receives a driving waveform outputted from the inverter control circuit 1, and applies a predetermined high-frequency high-voltage waveform to the cold cathode tube 3. The inverter control circuit 1 is adapted so that, as shown in FIG. 8, the inverter input signal (inverter driving signal) has a Gaussian distribution waveform with its repetitive period matching an inverse of the frame frequency. Accordingly, the envelope of the waveform of the inverter output signal applied to the cold cathode tube 3 from the inverter 2 also has a Gaussian distribution waveform with its repetitive period matching an inverse of the frame period.

By thus applying to the cold cathode tube 3 a high-frequency high voltage of a Gaussian distribution waveform whose envelope has a repetitive period which matches the inverse of the frame period, the light emitted by the cold cathode tube 3 also has a Gaussian distribution waveform whose envelope has a repetitive period which matches the inverse of the frame period. That is, with the application of the inverter output signal as shown in FIG. 8 to the cold cathode tube 3, the repetitive period of the envelope of the emission waveform takes the form of a Gaussian distribution waveform matching the inverse of the frame period. Thus, there will be no sudden current flow in the cold cathode tube 3, and the current of the cold cathode tube 3 will not be shut down abruptly at the fall of emission because the fall of the envelope makes up a sinusoidal wave, thus preventing a reverse current flow through the cold cathode tube 3. This current behavior ensures preventing the detrimental effect to the life of the cold cathode tube 3.

Further, since the inverter output signal applied to the cold cathode tube 3 has a Gaussian distribution waveform whose envelope has a repetitive period which matches the inverse of the frame period, the high harmonic component can be reduced or relieved to effectively reduce the harmful electromagnetic wave to the human body, thereby overcoming the problem of electromagnetic wave.

Further, by the provision of a period of reduced luminance of the cold cathode tube 3 per one frame, a viewer would see only a moment of high contrast as a persistent image, which is perceived as a clear image with good contrast, thus improving display quality of fast-moving images in particular.

This embodiment described the case where the repetitive period of the envelope of the inverter output signal is in the form of a Gaussian distribution waveform matching the inverse of the frame period. However, not limited to this, the present invention may have an arrangement where a Gaussian distribution waveform with a repetitive period of its waveform matching the inverse of the frame period is directly applied to the cold cathode tube 3. The foregoing functions and effects can also be obtained in this case.

Further, even though the foregoing described the case of a Gaussian distribution waveform, the present invention is not limited to this and can employ other waveforms, such as a Lorentz distribution waveform. The same effects can also be obtained in this case.

The foregoing embodiments described the case where the liquid crystal display device has a single emitter. However, the present invention is not just limited to this and is applicable to the case where a plurality of emitting areas are provided in a scanning direction, which are successively scanned and switched ON in synchronism with the vertical synchronize signal of the liquid crystal display device, while applying any of the voltage waveforms of the foregoing five embodiments to each emitter to cause emission.

Further, the foregoing embodiments described the case where the emitter was the cold cathode tube. However, the present invention is not just limited to this and is also applicable to the cases where the emitter is a light-emitting diode, an electroluminescence element, a hot cathode tube, a mercury lamp, a halogen lamp, or a laser, etc.

Even though the explanations of the embodiments according to the present invention are based on a video signal of the interlace driving mode, the present invention is not limited to this and it can also be realized by a video signal of the non-interlace driving mode. In the interlace driving mode, one field corresponds to one vertical period, whereas one frame corresponds to one vertical period in the non-interlace driving mode.

As described, a first liquid crystal display device of the present invention includes an illumination device, and there is provided a certain time period per one frame in which luminance of the illumination device is reduced.

According to a second liquid crystal display device of the present invention, in the first liquid crystal display device, the voltage waveform applied to the emitter of the illumination device is adjusted so as to prevent an abrupt increase of a current through the emitter when increasing luminance of the illumination device.

According to a third liquid crystal display device of the present invention, in the first liquid crystal display device, a rising waveform of the voltage waveform applied to the emitter of the illumination device is slacked when increasing luminance of the illumination device.

According to a fourth liquid crystal display device of the present invention, in the first liquid crystal display device, a rising waveform of an envelope of the voltage waveform applied to the emitter of the illumination device is slacked when increasing luminance of the illumination device.

According to a fifth liquid crystal display device of the present invention, in the first liquid crystal display device, the voltage waveform applied to the emitter of the illumination device is adjusted so as to prevent an abrupt decrease of a current through the emitter, or to prevent a flow of a large reverse current through the emitter when reducing luminance of the illumination device.

According to a sixth liquid crystal display device of the present invention, in the first liquid crystal display device, a falling waveform of the voltage waveform applied to the emitter of the illumination device is slacked when reducing luminance of the illumination device.

According to a seventh liquid crystal display device of the present invention, in the first liquid crystal display device, a falling waveform of an envelope of the voltage waveform applied to the emitter of the illumination device is slacked when reducing luminance of the illumination device.

According to an eighth liquid crystal display device of the present invention, in the first liquid crystal display device, a rising waveform of the voltage waveform applied to the emitter of the illumination device essentially makes up a part of a sinusoidal wave when increasing luminance of the illumination device.

According to a ninth liquid crystal display device of the present invention, in the first liquid crystal display device, a rising waveform of an envelope of the voltage waveform applied to the emitter of the illumination device essentially makes up a part of a sinusoidal wave when increasing luminance of the illumination device.

According to a tenth liquid crystal display device of the present invention, in the first liquid crystal display device, a falling waveform of the voltage waveform applied to the emitter of the illumination device essentially makes up a part of a sinusoidal wave when reducing luminance of the illumination device.

According to an eleventh liquid crystal display device of the present invention, in the first liquid crystal display device, a falling waveform of an envelope of the voltage waveform applied to the emitter of the illumination device essentially makes up a part of a sinusoidal wave when reducing luminance of the illumination device.

As described, a twelfth liquid crystal display device of the present invention includes an illumination device, wherein the voltage waveform applied to the emitter of the illumination device makes up a sinusoidal wave whose frequency essentially matches an inverse of a vertical period.

As described, according to a thirteenth liquid crystal display device of the present invention, an envelope of the voltage waveform applied to the emitter of the illumination device is a sinusoidal wave whose frequency essentially matches an inverse of a vertical period.

As described, according to a fourteenth liquid crystal display device of the present invention, the voltage waveform applied to the emitter of the illumination device is a Gaussian distribution waveform with its repetitive period essentially matching an inverse of a frame frequency.

As described, a fifteenth liquid crystal display device of the present invention includes an illumination device, wherein an envelope of the voltage waveform applied to the emitter of the illumination device is a Gaussian distribution waveform with its repetitive period essentially matching an inverse of a frame frequency.

As described, a sixteenth liquid crystal display device of the present invention includes an illumination device, wherein the voltage waveform applied to the emitter of the illumination device is a Lorentz distribution waveform with its repetitive period essentially matching an inverse of a frame frequency.

As described, a seventeenth liquid crystal display device of the present invention includes an illumination device, wherein an envelope of the voltage waveform applied to the emitter of the illumination device is a Lorentz distribution waveform with its repetitive period essentially matching an inverse of a frame frequency.

As described, an eighteenth liquid crystal display device of the present invention includes an illumination device, wherein the voltage waveform applied to the emitter of the illumination device is a triangular wave of a frequency essentially matching an inverse of a vertical period.

As described, a nineteenth liquid crystal display device of the present invention includes an illumination device, wherein an envelope of the voltage waveform applied to the emitter of the illumination device is a triangular wave of a frequency essentially matching an inverse of a vertical period.

According to a twentieth liquid crystal display device of the present invention, in the first and twelfth through nineteenth liquid crystal display devices, the emitter of the illumination device is a light-emitting diode, an electroluminescence element, a hot cathode tube, a mercury lamp, a halogen lamp, or a laser.

With the foregoing first through twentieth liquid crystal display devices, it is possible to provide a liquid crystal display device with a desirable display quality of fast-moving images while preventing the detrimental effect to the life of the emitter of the illumination device and relieving the problem of electromagnetic wave.

[Second Embodiment]

The following will describe another embodiment of the present invention referring to FIG. 9 through FIG. 15.

First, the mechanism of a coloring phenomenon, in which contours of an image are colored in fast-moving images is explained with reference to FIG. 14 and FIG. 15.

Figure 14:
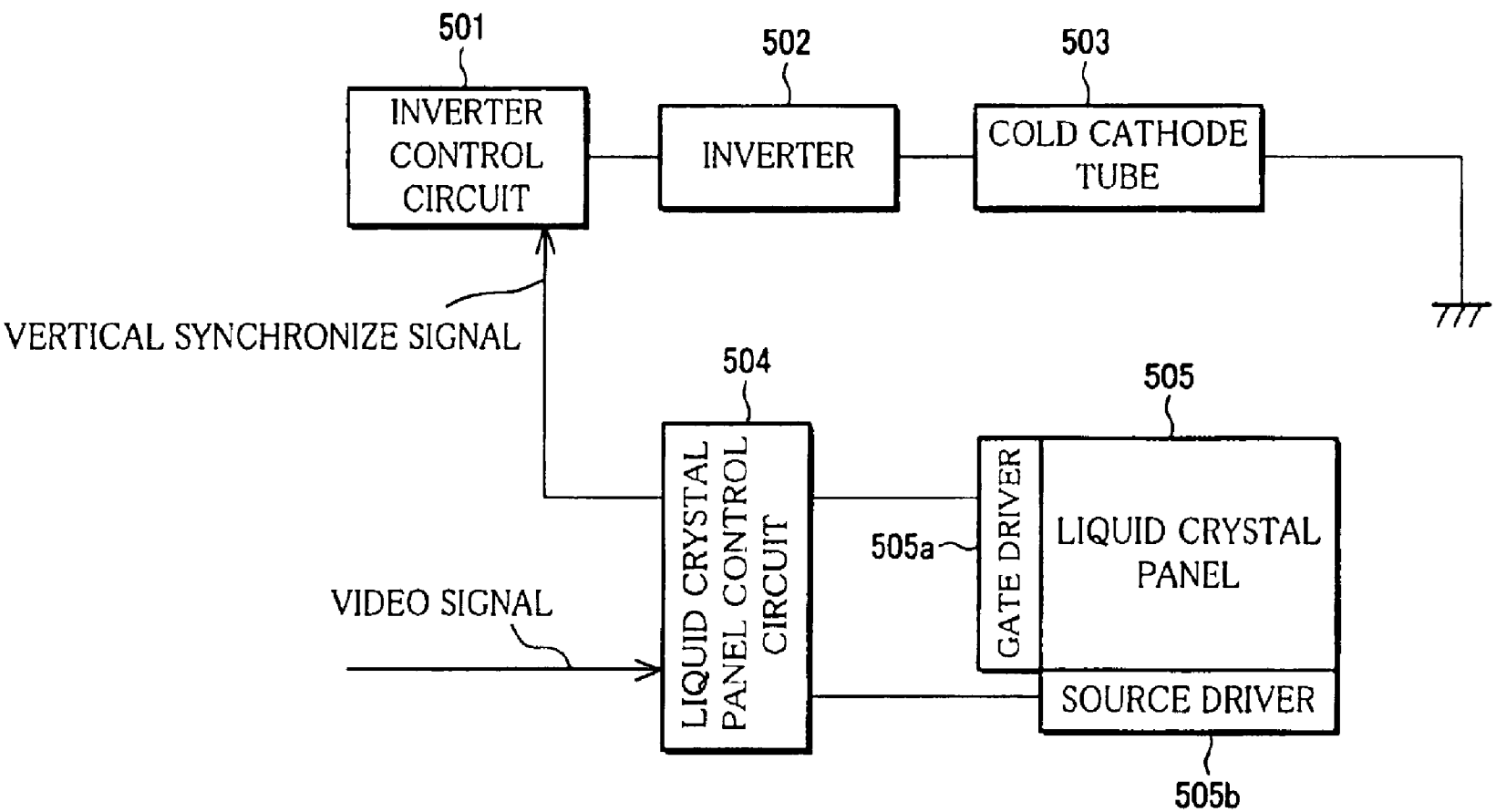
FIG. 14 is a block diagram showing an exemplified structure of a liquid crystal display device which causes a coloring phenomenon on image contours in a display of a fast-moving image.

A liquid crystal display device (active-matrix liquid crystal display device) as shown in FIG. 14 is chiefly made up of an inverter control circuit 501, an inverter 502, a cold cathode tube 503 (emitter), a liquid crystal panel control circuit 504, and a liquid crystal panel 505.

The inverter control circuit 501 receives a vertical synchronize signal which is inputted from the liquid crystal panel control circuit 504, and outputs driving signals for driving the inverter 502 to the inverter 502. The inverter 502 applies a high voltage whose frequency is varied according to the driving signal to the cold cathode tube 503. The cold cathode tube 503, upon receiving the high voltage, emits light to illuminate the liquid crystal panel 505.

The liquid crystal panel control circuit 504, upon input of a video signal, separates synchronize signals, of which the vertical synchronize signal is sent to the inverter control circuit 501 as described above. Further, a gate driver 505*a* and a source driver 505*b* for driving scanning lines and signal lines (both not shown) are driven based on the video signal to select desired pixels (not shown), such that the light emitted by the cold cathode tube 3 travels through the selected pixels to display the video signal.

Figure 15:
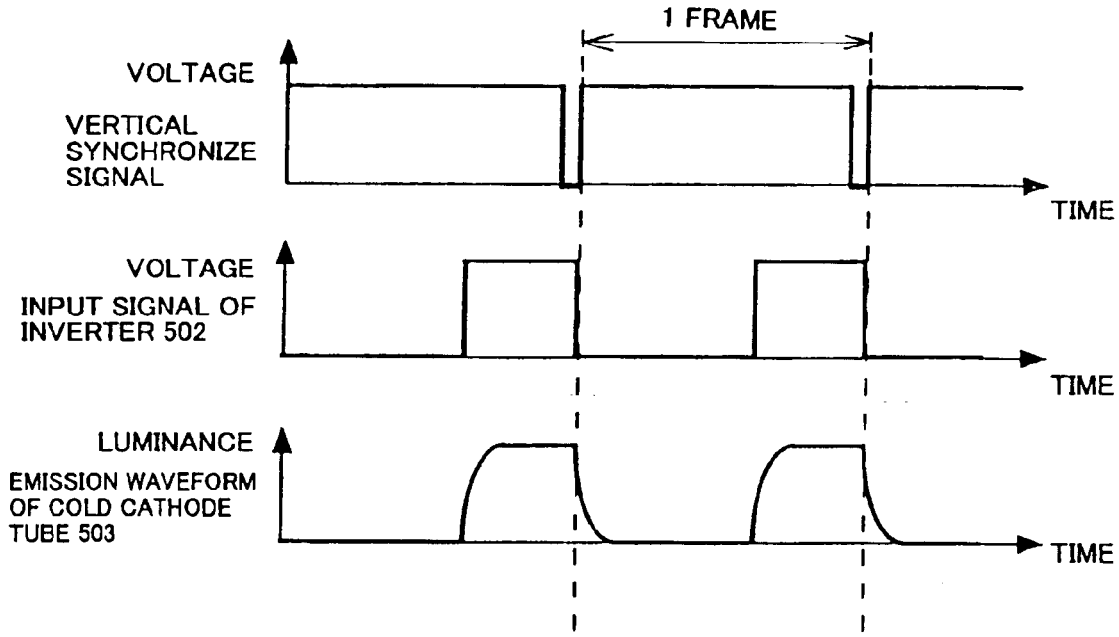
FIG. 15 is a waveform diagram explaining operations of the liquid crystal display device of FIG. 14.

The following described the case where main signals of the liquid crystal display device (vertical synchronize signal, input signal (driving signal) of the inverter 502, and emission waveform of the cold cathode tube 3) have waveforms as shown in FIG. 15.

In this case, by providing an OFF period (dimming period) per one frame, a viewer would see only a moment of high contrast as a persistent image, which is perceived as a clear image with good contrast. However, in display of a fast-moving image, the coloring phenomenon was observed, i.e., the contours of a moving image were colored.

It is common in liquid crystal display devices to adopt the cold cathode tube as the emitter of the illumination device. The cold cathode tube usually includes fluorescent materials of at least three colors for emitting green, red, and blue, respectively. The fluorescent materials becomes fluorescent by the ultraviolet light released from mercury which was excited by discharge in the cold cathode tube.

It was found that, when the cold cathode tube, which is commonly and widely used for an illumination device of the liquid crystal display devices, is flashed or lit in a pulse patten, the emission waveform of each color becomes different. It was also found that the rise and fall of green were slower in particular. That is, it was confirmed that the emission waveform of green was shifted behind with respect to blue and red. Thus, two emitters, a cold cathode tube with a green fluorescent material, and a cold cathode tube with fluorescent materials of two primary colors red and blue were prepared to make up an illumination device. Using this device, the driving waveforms for controlling the emitters in an illuminating section were shifted in phase among the emitters such that an OFF period or a dimming period of a certain time period was provided per one frame. That is, the phase of the driving waveform of the cold cathode tube of red and blue was delayed with respect to the phase of the driving waveform of the cold cathode tube of green. This relieved the coloring phenomenon.

Further, a total of three emitters: a cold cathode tube containing only the fluorescent material of green, a cold cathode tube containing only the fluorescent material of red, and a cold cathode tube containing only the fluorescent material of blue, were prepared to make up an illumination device. Using this device, the driving waveforms for controlling the emitters in an illuminating section were shifted in phase among the emitters such that an OFF period or a dimming period of a certain time period was provided per one frame. That is, the phases of green, red, and blue were shifted to fall behind in this order.

Further, generally, a response time required for emission and a response time required for dimming are different in fluorescent materials. Accordingly, the durations of emitting periods are also different, though slightly, among different fluorescent materials. It is therefore more preferable to match the durations of emitting periods, in addition to shifting the phases. That is, a display quality can be further improved by controlling at least one of a pulse width and an amplitude, in addition to providing emitters of different colors and shifting phases of their driving waveforms. Note that, such a driving method is also effective for the emitters other than the cold cathode tube, when each color has a different response time.

Figure 9:
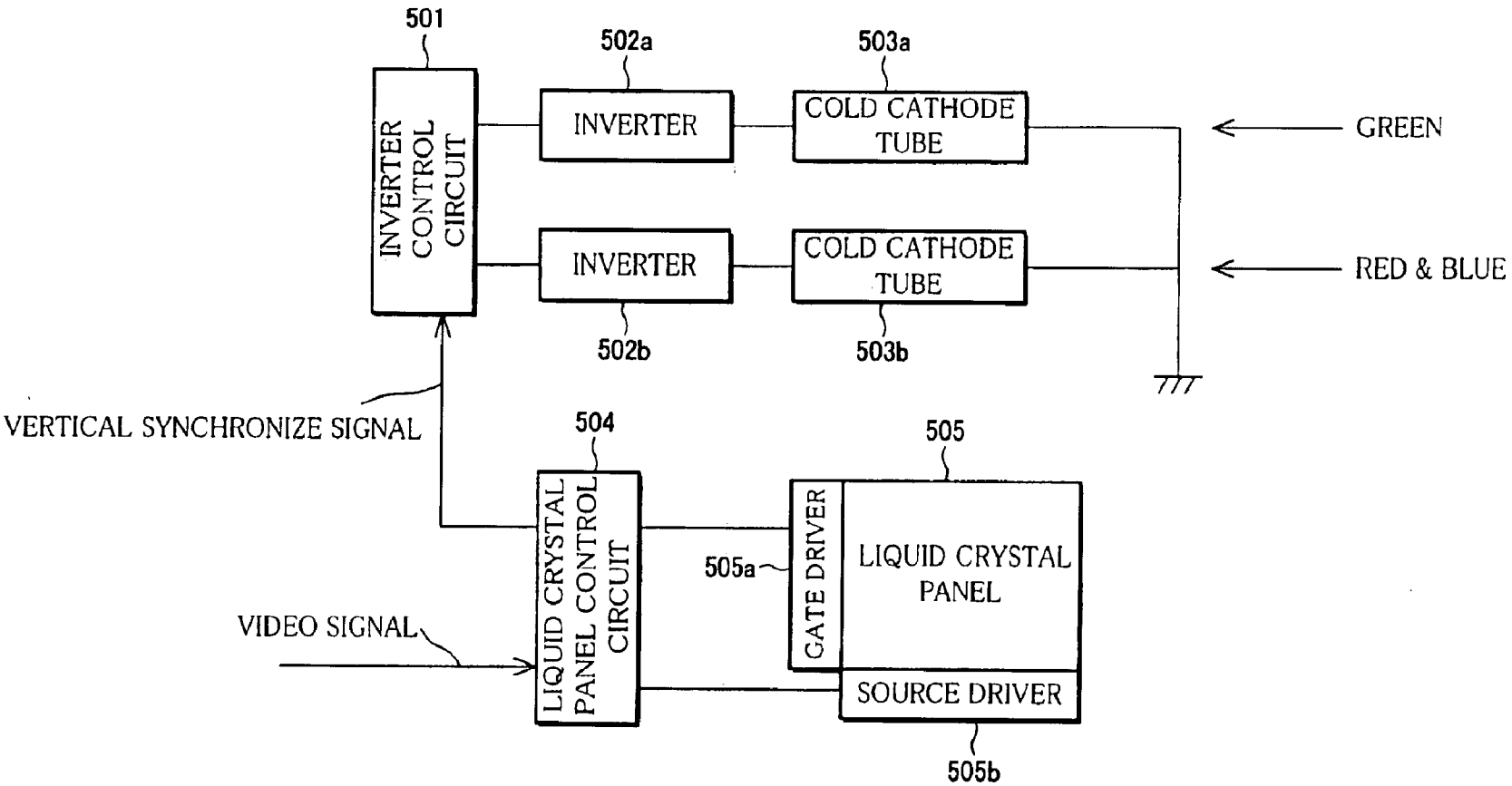
FIG. 9 is a block diagram showing an exemplified structure of a liquid crystal display device of the present invention.

The following describes the liquid crystal display device according to the present embodiment with reference to FIG. 9. Note that, elements having the same functions as those described pertaining to the liquid crystal display device of FIG. 14 are given the same reference numerals and explanations thereof are omitted here.

As shown in FIG. 9, the product liquid crystal display device includes two illuminating sections having a cold cathode tube 503*a* (first cold cathode tube) containing only the fluorescence material of green, and a cold cathode tube 503*b* (second cold cathode tube) containing only the fluorescent materials of two primary colors red and blue, and inverters 502*a* and 502*b* for driving the respective two illuminating sections.

To the inverters 502*a* and 502*b* are inputted, in synchronism with the vertical synchronize signal, pulses (driving signals), each having a period matching a vertical period, with its pulse width being ⅖ of the vertical period (period which corresponds to ⅖ of the vertical period). The pulse (driving signal) inputted to the inverter 502*a* for driving the cold cathode tube 503*a* is set so that its phase advances earlier, for example, by 2 ms. Here, the vertical synchronize signal, the input signals of the inverters 502*a* and 502*b*, and emission waveforms of the cold cathode tubes 503*a* and 503*b* are as shown in FIG. 10.

Figure 10:
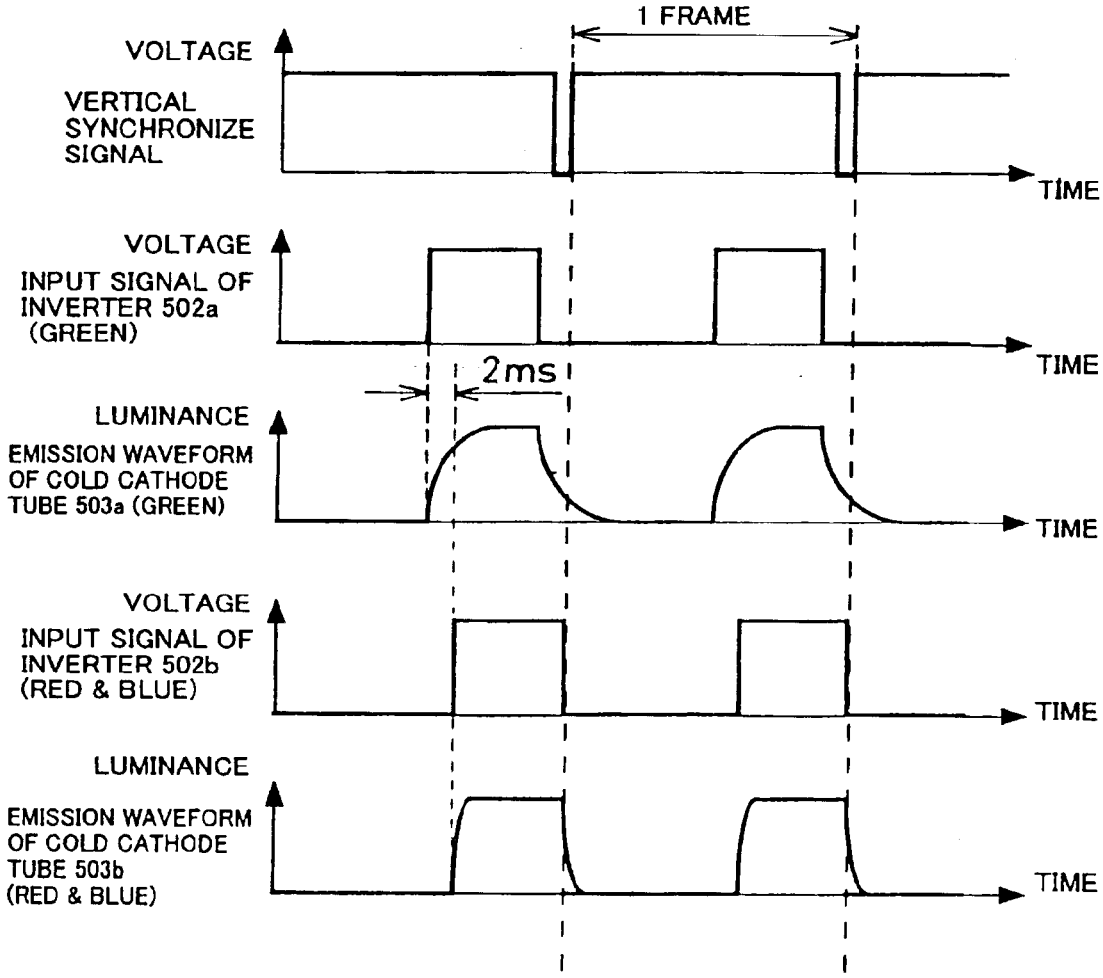
FIG. 10 is a waveform diagram showing examples of applied main signal waveforms, explaining operations of the liquid crystal display device.

As shown in FIG. 10, the rise and fall of the emission waveform of the cold cathode tube 503*a* are slacked. As a result, the emission timing of the cold cathode tube 503*a* is brought closer to the emission timing of the cold cathode tube 503*b*.

As described, by the provision of the two cold cathode tubes 503*a* and 503*b*, where the former contains only the fluorescent material of green and the latter contains only the fluorescent materials of two primary colors red and blue, it became possible to bring the respective emission timings of the cold cathode tubes 503*a* and 503*b* closer together. With this liquid crystal display device displaying fast-moving images, it was ensured relieving the coloring phenomenon of moving image contours.

Figure 11:
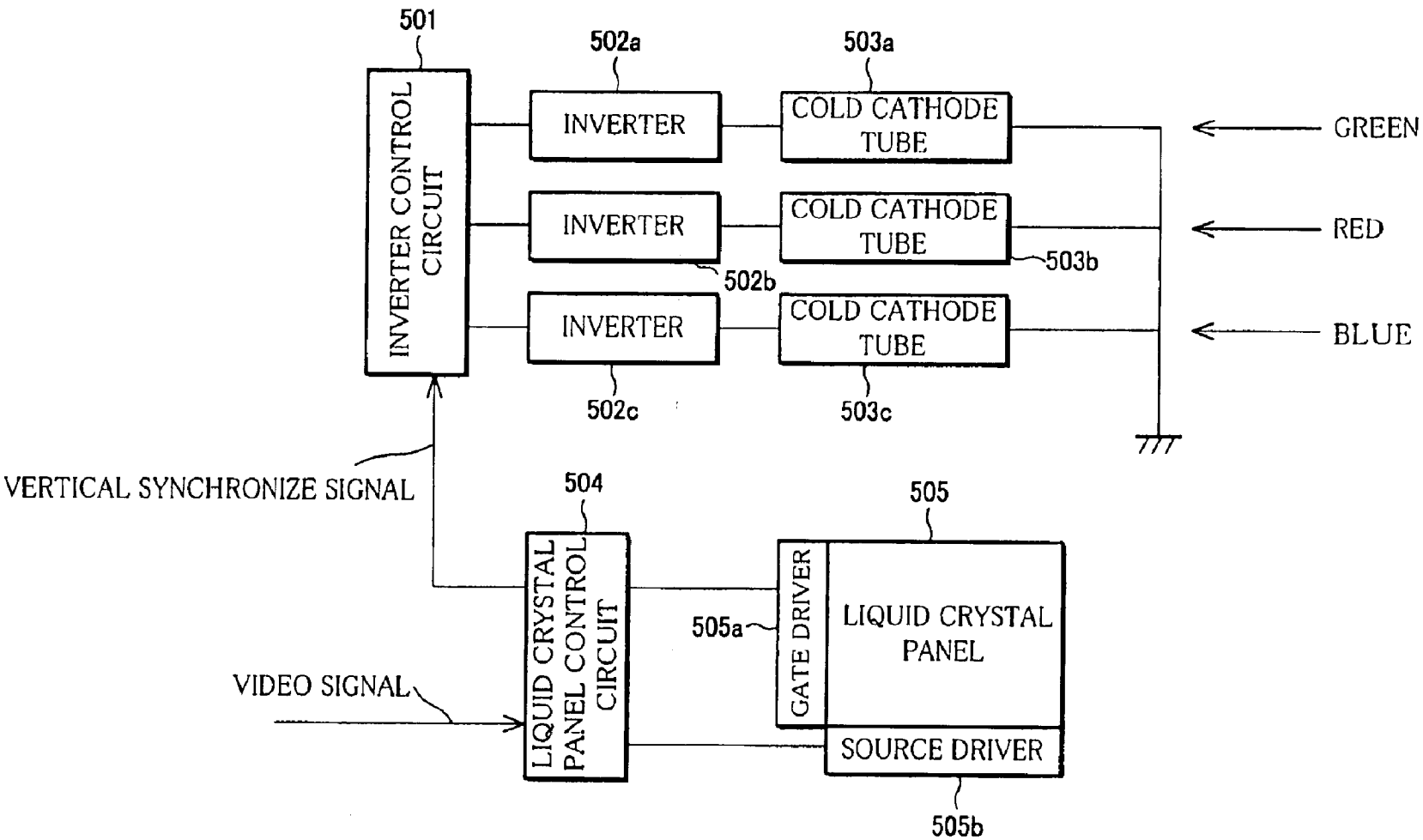
FIG. 11 is a block diagram showing an exemplified structure of another liquid crystal display device of the present invention.

The following describes yet another embodiment of the present invention with reference to FIG. 11. Note that, elements having the same functions as those of the liquid crystal display device of FIG. 14 are given the same reference numerals and detailed explanations thereof are omitted here.

As shown in FIG. 11, the product liquid crystal display device includes three illuminating sections, having a cold cathode tube 503*a* (first cold cathode tube) containing only the fluorescent material of green, a cold cathode tube 503*b* (second cold cathode tube) containing only the fluorescent material of red, and a cold cathode tube 503*c* (third cold cathode tube) containing only the fluorescent material of blue, and inverters 502*a*, 502*b*, and 502*c* for driving the respective three illuminating sections.

To the inverters 502*a*, 502*b*, and 502*c* are inputted, in synchronism with the vertical synchronize signal, pulses (driving signals), each having a period matching a vertical period, with a pulse width ⅖ of the vertical period. The pulse (driving signal) inputted to the inverter 502*a* for driving the cold cathode tube 503*a* is set so that its phase advances earlier, for example, by 2 ms than the phase of the pulse (driving signal) inputted to the inverter 502*c*. Further, the pulse (driving signal) inputted to the inverter 502*b* for driving the cold cathode tube 503*b* is set so that its phase advances earlier, for example, by 1 ms than the phase of the pulse (driving signal) inputted to the inverter 502*c*. Here, the vertical synchronize signal, the input signals of the inverters 502*a* through 502*c*, and emission waveforms of the cold cathode tubes 503*a* through 503*c* are as shown in FIG. 12.

Figure 12:
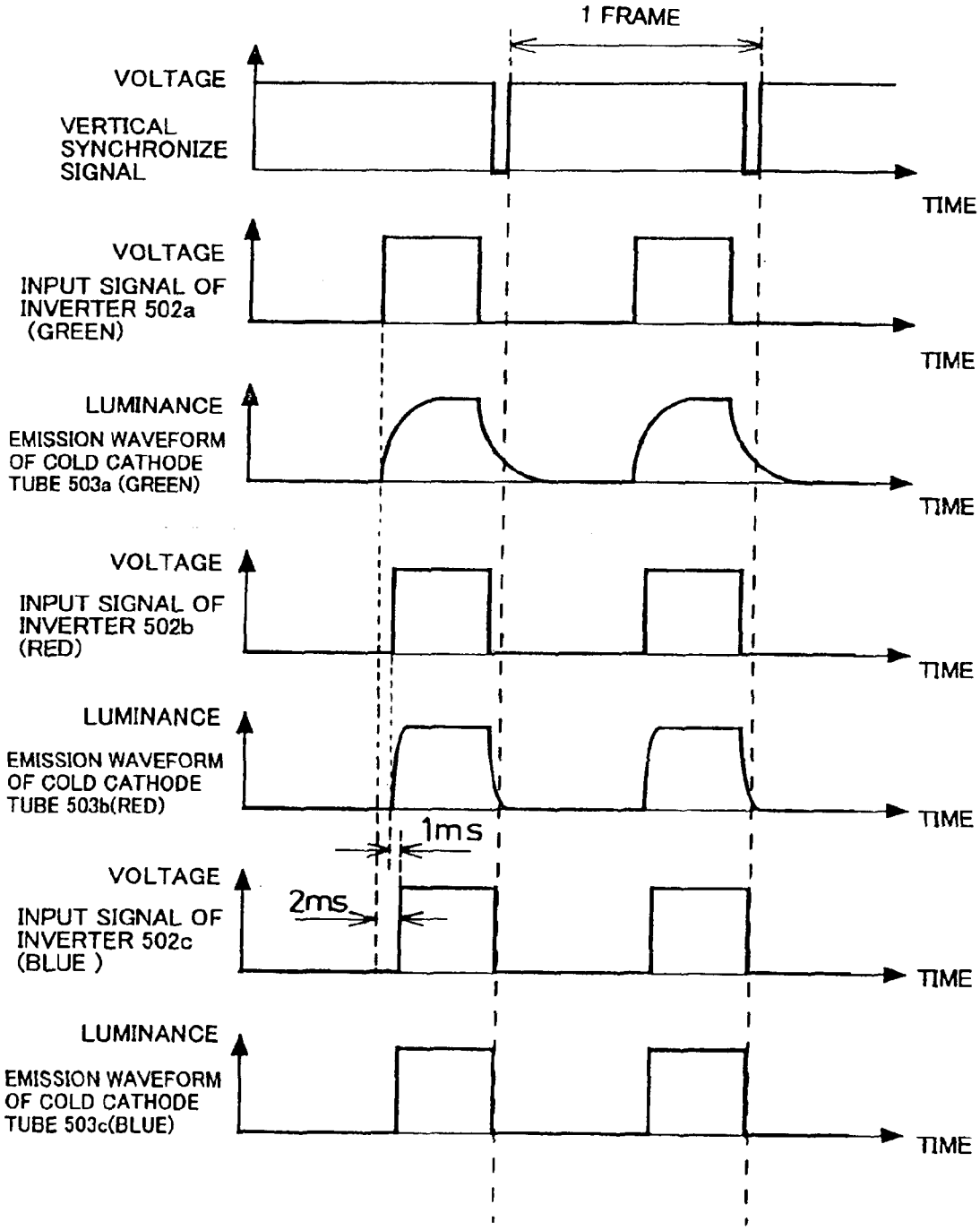
FIG. 12 is a waveform diagram showing examples of applied main signal waveforms, explaining operations of the liquid crystal display device of FIG. 11.

As shown in FIG. 12, the emission waveforms of the cold cathode tubes 503*a* and 503*b* both have a rise and fall which are slacked. However, the extent of the slack is larger in the cold cathode tube 503*a* (green). As a result, it became possible to bring the emission timings of the cold cathode tubes 503*a* (green), 503*b* (red), and 503*c* (blue) closer together.

As described, by the provision of the cold cathode tube 503*a* containing the fluorescent material of green, the cold cathode tube 503*b* containing the fluorescent material of red, and the cold cathode tube 503*c* containing the fluorescent material of blue, and by adjusting the phases of the driving signals for driving the respective cold cathode tubes, it became possible to bring the emission timings of the respective cold cathode tubes closer together more accurately than the case of FIG. 9. With this liquid crystal display device displaying fast-moving images, it became possible to greatly relieve the coloring phenomenon of moving image contours, thus significantly improving display quality.

Figure 13:
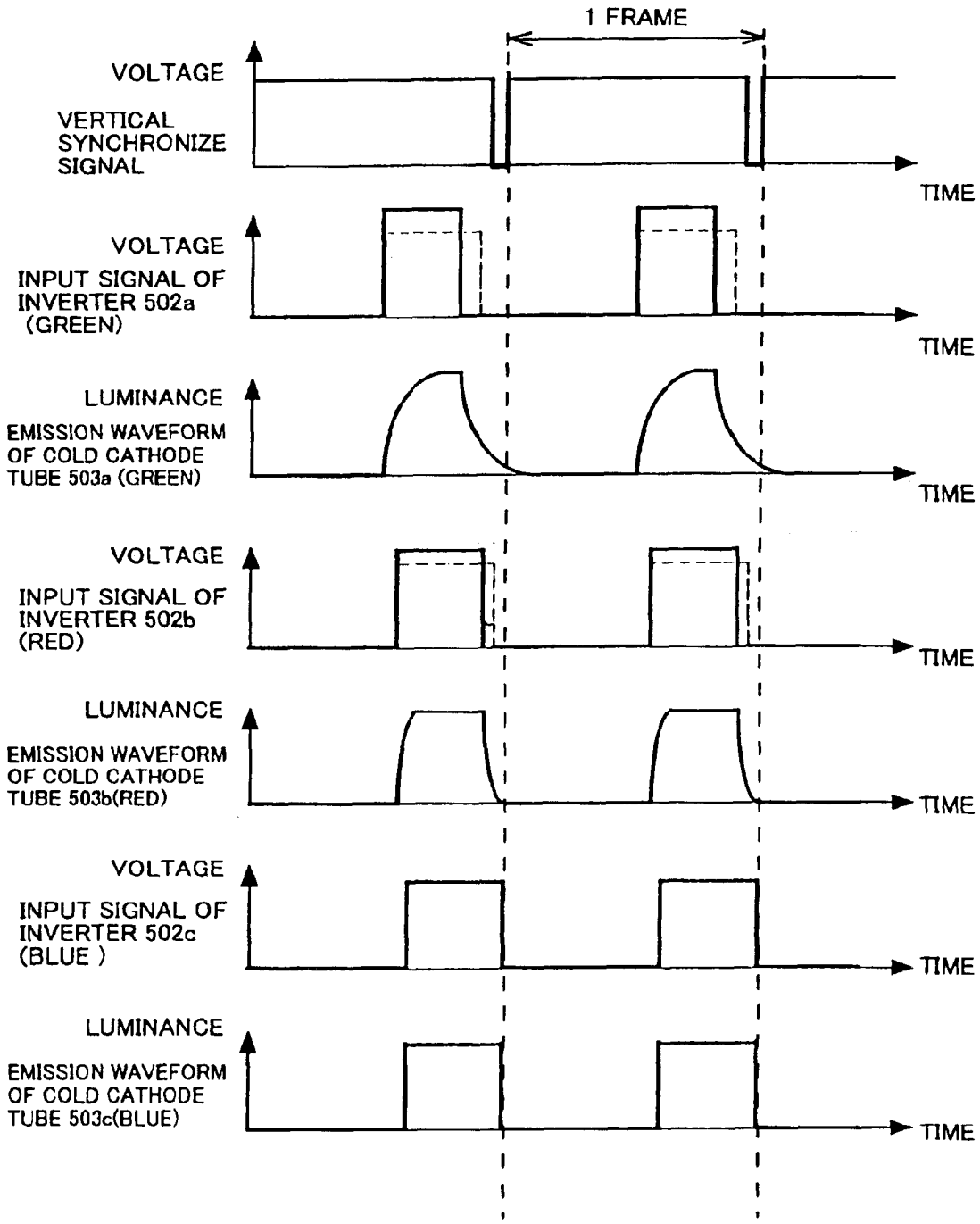
FIG. 13 is a waveform diagram showing examples of main signal waveforms, in which some of the signal waveforms of FIG. 12 are changed.

The following describes modification examples of the waveforms inputted to the inverters 502*a* (green) and 502*b* (red) with reference to FIG. 13.

That is, in FIG. 13, the input signal of the inverter 502*a* is modified to reduce the pulse width by 20% and increase the pulse height by 25%, whereas the input signal of the inverter 502*b* is modified to reduce the pulse width by 15% and increase the pulse height by 20%. The blue remains the same as the foregoing embodiment. In this case, the vertical synchronize signal, the input signals of the inverters 502*a* through 502*c*, and emission waveforms of the cold cathode tubes 503*a* through 503*c* are as shown in FIG. 13.

Here, the respective emission timings of green, red, and blue, and their luminance appreciably coincide one another. With this liquid crystal display device displaying fast-moving images, it became possible to greatly relieve the coloring phenomenon of moving image contours.

As described, by controlling at least one of the pulse width and an amplitude, in addition to providing the cold cathode tube for each color and shifting phases of their driving waveforms, display quality can be further improved.

Figure 17:
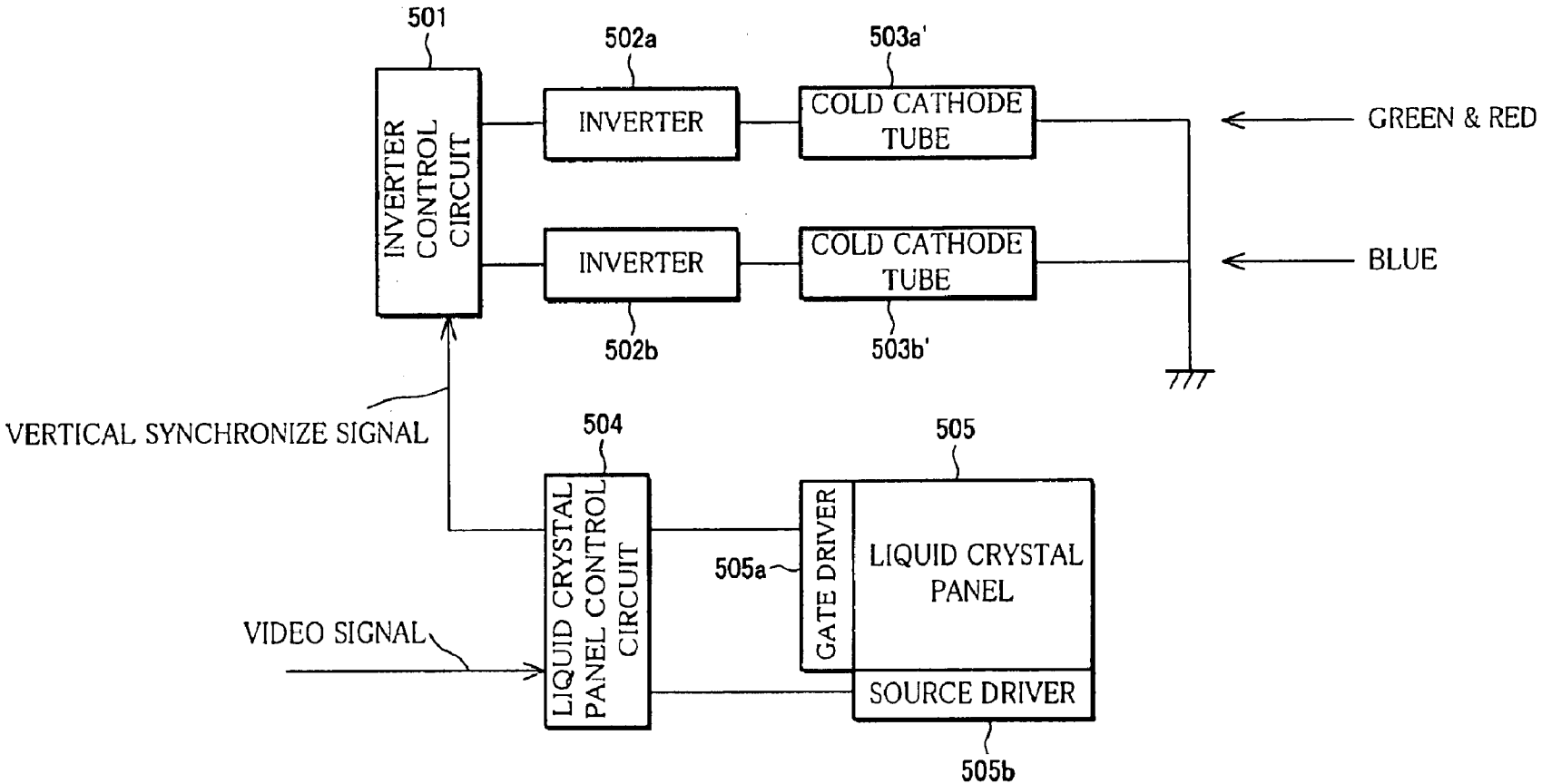
FIG. 17 is a block diagram showing another exemplified structure of the liquid crystal display device of the present invention.

The following describes yet another embodiment of the present invention. A liquid crystal display device having an arrangement as shown in FIG. 17 was prepared. The difference from that of FIG. 9 is that a cold cathode tube 503*a*' contains fluorescent materials of green and red, and a cold cathode tube 503*b*' contains only the fluorescent material of blue. The fluorescent material of green used here has been modified with an improved response time to have an emission waveform substantially the same as that of red.

Here, a brief explanation is given as to improving fluorescent materials. The fluorescent materials are developed with most emphasis on emission spectrum, i.e., displayed color (color purity) and emission efficiency. Especially, the emission spectrum is the most important factor in deciding the color balance of the overall display device. The fluorescent materials of blue and red are practically unchangeable with respect to their emission spectrum, and, presently, there is no prospect for developing a new material which allows adjustment of a response time.

In contrast, the fluorescent materials of green have relatively richer and wider selections of materials which can satisfy required emission spectrum. It was therefore possible to develop a material which could attain the response time of the red fluorescent material with the conventional emission spectrum, without sacrificing almost any emission efficiency. The present embodiment employs such a green fluorescent material and sealed it in the cold cathode tube 503*a*' together with the red fluorescent material.

To the inverters 502*a* and 502*b* are inputted, in synchronism with the vertical synchronize signal, pulses (driving signals), each having a period matching a vertical period, with a pulse width ⅖ of the vertical period (period which corresponds to ⅖ of one frame time). The pulse (driving signal) inputted to the inverter 502*a* for driving the cold cathode tube 503*a*' is set so that its phase advances earlier, for example, by 1 ms. In this case, the vertical synchronize signal, the input signals of the inverters 502*a* and 502*b*, and emission waveforms of the cold cathode tubes 503*a*' and 503*b*' are as shown in FIG. 18.

Figure 18:
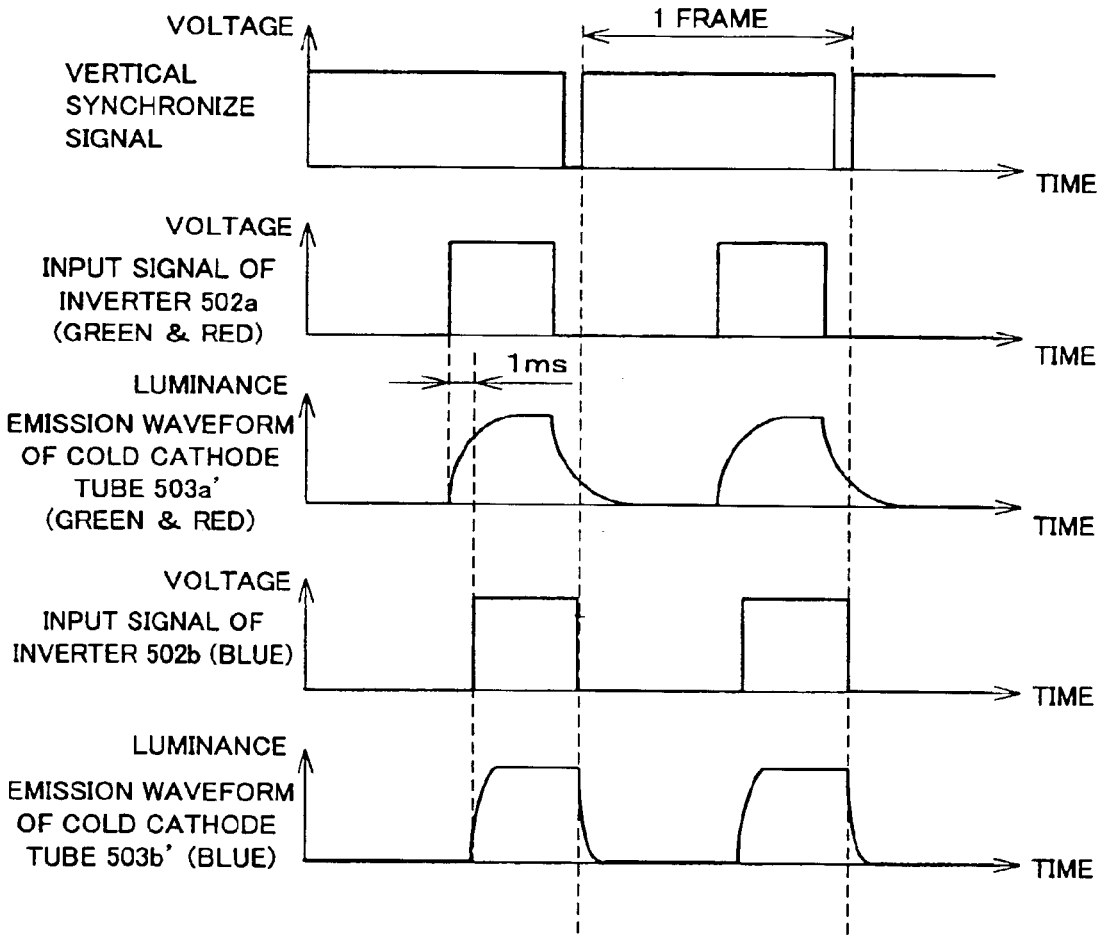
FIG. 18 is a waveform diagram showing examples of main signal waveforms, explaining operations of another liquid crystal display device.

As shown in FIG. 18, the rise and fall of the emission waveform of the cold cathode tube 503*a*' are slacked. As a result, it became possible to bring the emission timings of the cold cathode tubes 503*a*' and 503*b*' closer together.

As described, by the provision of the two cold cathode tubes 503*a*' and 503*b*', where the former contains the fluorescent materials of two primary colors green and red, and the latter contains only the fluorescent material of blue, it became possible to bring the respective emission timings (phases of emission waveforms) closer together. With this liquid crystal display device displaying fast-moving images, it was ensured to relieve the coloring phenomenon of moving image contours.

Further, because the response time of red and the response time of green are closer together, the emitting periods of the respective colors are aligned more desirably than the case of FIG. 10, thus further improving display performance for fast-moving images.

Figure 19:
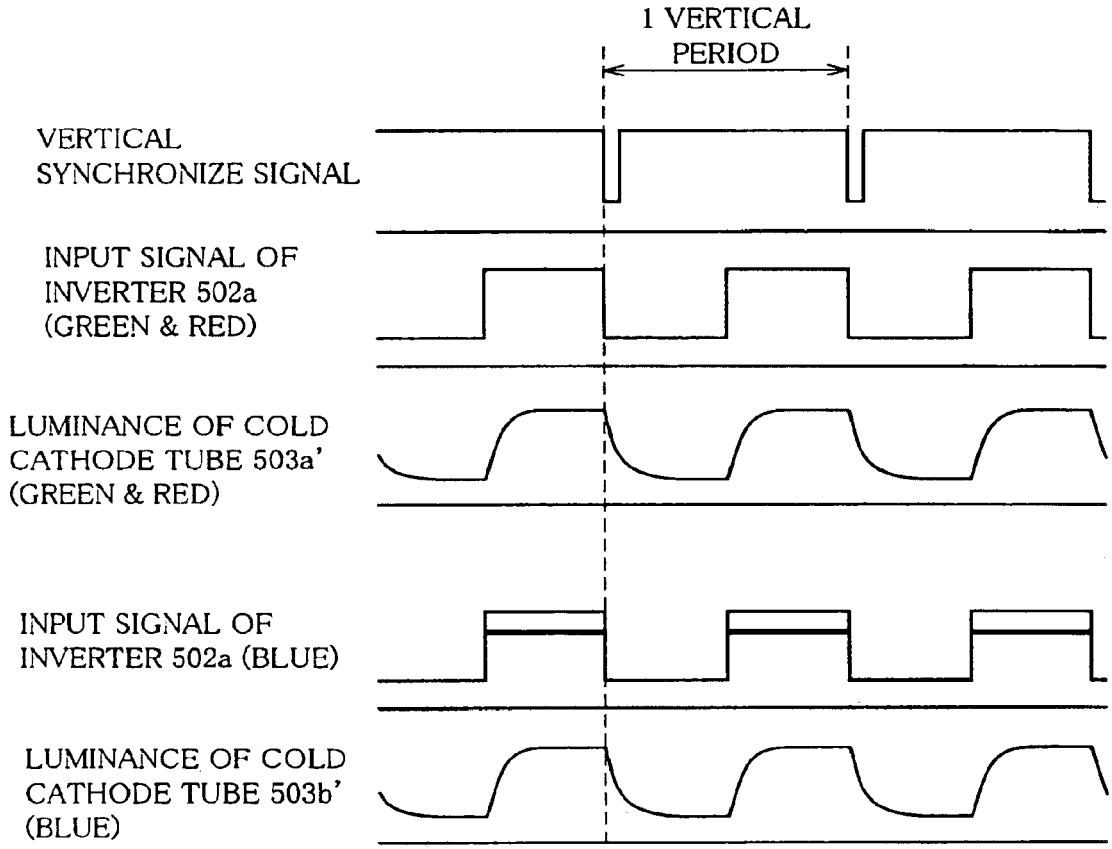
FIG. 19 is a waveform diagram showing how an emitting period is adjusted by delaying a response time.

In yet another embodiment of the present invention, the emitting periods are adjusted by delaying a response time. A liquid crystal display device as shown in FIG. 17 was prepared, and as shown in FIG. 19, a normal signal is inputted to the inverter in a cold cathode tube 503*a*', and a signal with smaller intensity than normally is inputted to a cold cathode tube 503*b*' (see bold line shown in 502*b* of FIG. 19).

As a result, the response time of the cold cathode tube 503*b*' becomes longer, and the emitting period substantially coincided with that of the cold cathode tube 503*a*'. This liquid crystal display device showed improvement in color separation in a display of fast-moving images.

Here, a brief explanation is given to delaying of a response speed. In order to appreciably obtain a display as intended, it is not difficult to imagine that the display preferably should show no delay with respect to driving, i.e., the response time should approach infinitesimal. However, this sometimes requires a voltage which is unpractical (or an effort to this end may be restricted by power setting for the entire liquid crystal display device). In such a case, it is effective in the marketed products to adjust the emitting periods by delaying the response speed using a smaller voltage than normally. Indeed, this was shown to be sufficient to obtain the expected effects of the present invention.

Note that, the foregoing described the case where the emitter was the cold cathode tube. However, the present invention is not just limited to this and a liquid crystal display device with a highly desirable moving image display quality with no coloring phenomenon of contours can be provided by controlling one of (1) phases, (2) pulse widths, and (3) pulse heights of applied voltage waveforms for driving emitters which show different response times by color (electroluminescence element or hot cathode tube can also be used other than the cold cathode tube).

Further, the foregoing described the case where the phase difference of driving signals between the inverters 502*a* and 502*c* is 2 ms, and the phase difference of driving signals between the inverters 502*b* and 502*c* is 1 ms. However, without limiting to this, in the present invention, the phase difference is decided so as to bring the emission waveforms of the cold cathode tubes 503*a* through 503*c* closer together. Further, the foregoing described the case where the pulse width or pulse height is adjusted. However, the reduction rate of the pulse width or the magnification rate of the pulse height is just one example, and the present invention is not limited by such in any ways, and the pulse width and/or pulse height are decided so that the emission waveforms of the cold cathode tubes 503*a* through 503*c* are brought closer together.

Even though the effects of the foregoing embodiments of the present invention are confirmed with the video signal of the non-interlace mode, the present invention is not limited by this. For example, the foregoing functions and effects can also be obtained when the present invention is applied to the non-interlace (progressive) video signal. In the case of the interlace video signal, one vertical period corresponds to one field, whereas one vertical period corresponds to one frame in the non-interlace video signal.

Figure 20:
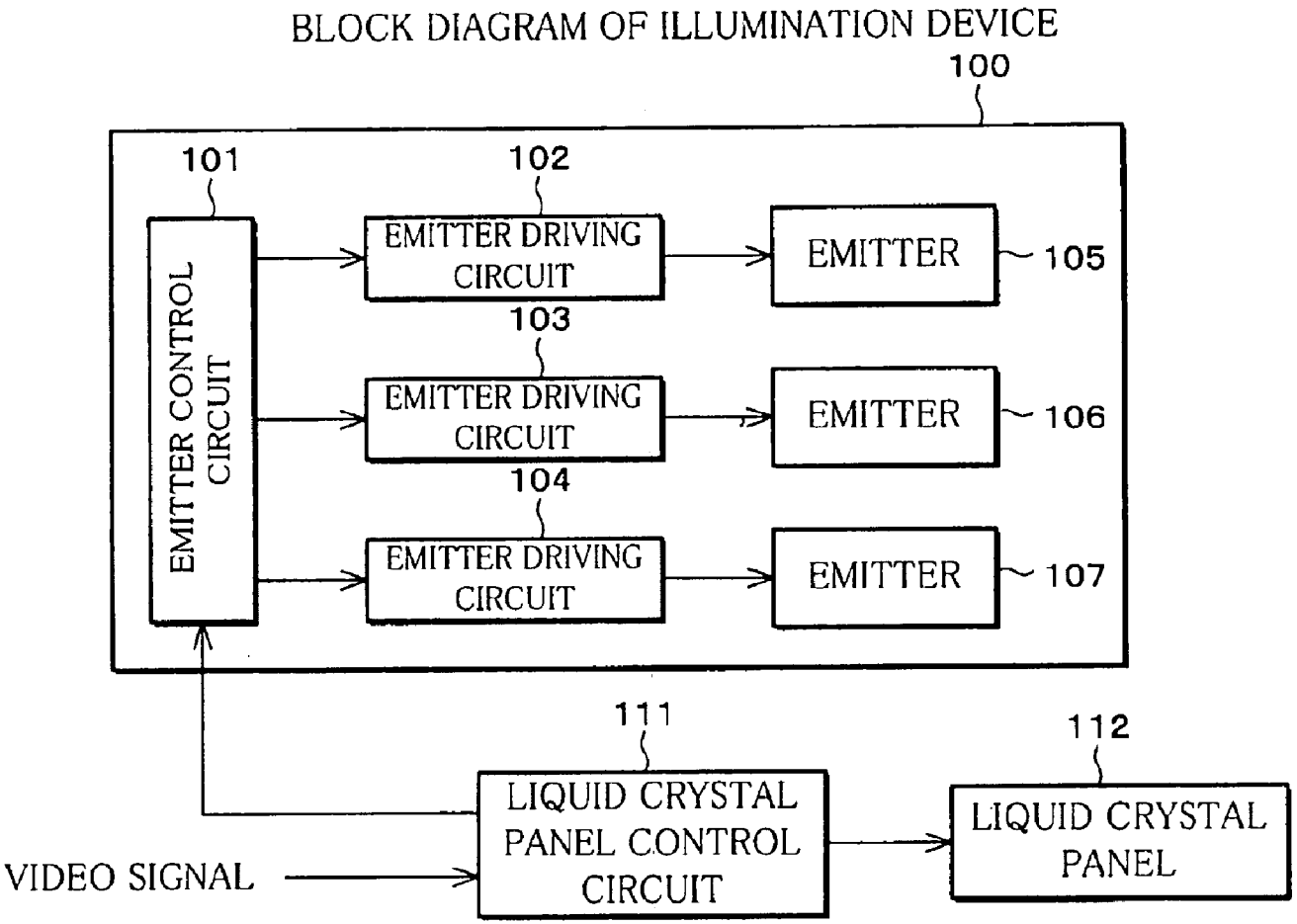
FIG. 20 is a block diagram showing an exemplified structure of an illumination device according to the present invention.

The following will describe an illumination device according to the present invention. FIG. 20 is a block diagram showing an example of an illumination device 100 according to the present invention. A liquid crystal panel control circuit 111 drives a liquid crystal panel 112 based on a video signal, at the same time as transferring a signal in accordance with a vertical synchronize signal (not shown) to an emitter control circuit 101. The emitter control circuit 101 is adapted to control a plurality of emitter driving circuits 102 through 104 (corresponding to the foregoing inverters). The emitter driving circuits 102 through 104 are adapted to cause emission of their corresponding emitters 105 through 107. At least one of the emitter driving circuits 102 through 104 is independently controlled, and their emitters correspond to at least one of the three primary colors.

Figure 21:
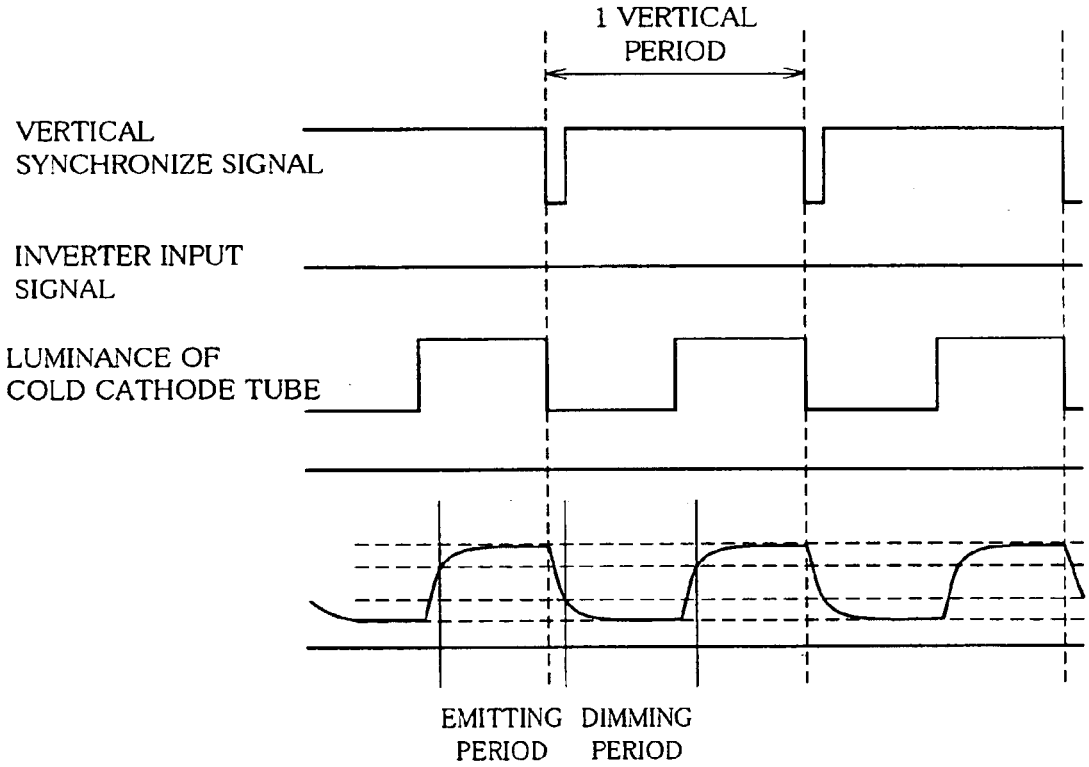
FIG. 21 is a waveform diagram showing a relationship between an emission profile, a vertical synchronize signal, and an inverter input signal of a cold cathode tube of the illumination device.

When the emitters 105 through 107 are cold cathode tubes, the emitter control circuit 101 corresponds to the inverter control circuit 1. In this case, the emission profile, vertical synchronize signal, and inverter input signal are related to one another as shown in FIG. 21. Note that, the emitting period and dimming period are defined as shown in FIG. 21. That is, the illumination device 100 can independently control a dimming period of an emitter of at least one of three primary colors of light within a range of 10% to 90% of one vertical period.

When the dimming period is less than 10% of one vertical period, an area of good contrast cannot be used selectively. On the other hand, when the dimming period is larger than 90% of one vertical period, there is a reduction of luminance as a whole, and a desirable display cannot be obtained. The foregoing illumination device 100 is therefore set to have a dimming period within a range of 10% to 90% of one vertical period. This makes it possible to selectively use an area of good contrast and obtain a desirable image without reducing luminance as a whole.

The dimming period is preferably in a range of 20% to 70% of a vertical period. With a dimming period around 70% of a vertical period, a moving image display performance which can match up against that of CRTs can be expected, and therefore further dimming is not necessary since luminance will be lost in doing so. Further, with a 20% dimming period with respect to common constant lighting, one can clearly appreciate an improvement in a moving image display performance.

Figure 22:
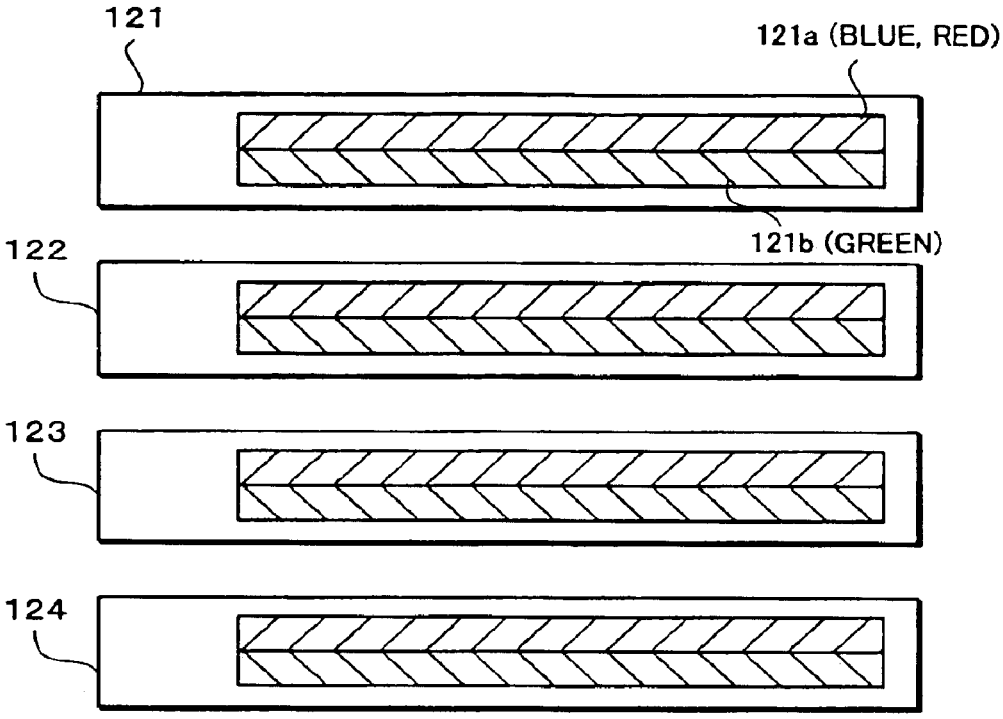
FIG. 22(*a*) is a front view showing an exemplified structure of another illumination device according to the present invention, and FIG. 22(*b*) is a side view of FIG. 22(*a*).
Figure 22:
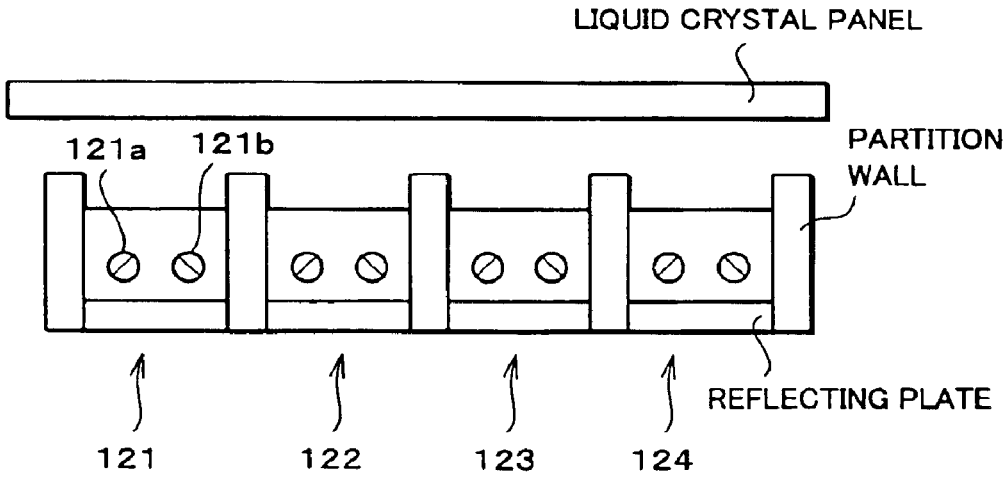

The following describes another illumination device of the present invention. A cold cathode tube back-light of a direct type as shown in FIG. 22(*a*) and FIG. 22(*b*) was prepared. The back-light of a direct type is divided into, for example, four blocks 121 through 124 (each block makes up an illumination device) in a horizontal direction, and partition walls are provided to separate the blocks. There are also provided reflecting plates for reflecting incident light of the emitters to the liquid crystal panel. According to this configuration, a certain display area is illuminated dominantly by an underlying block, and the illumination effect by adjacent blocks is relatively small. Here, since the blocks have the same configuration, the following only describes a block 121 for convenience of explanation.

Figure 23:
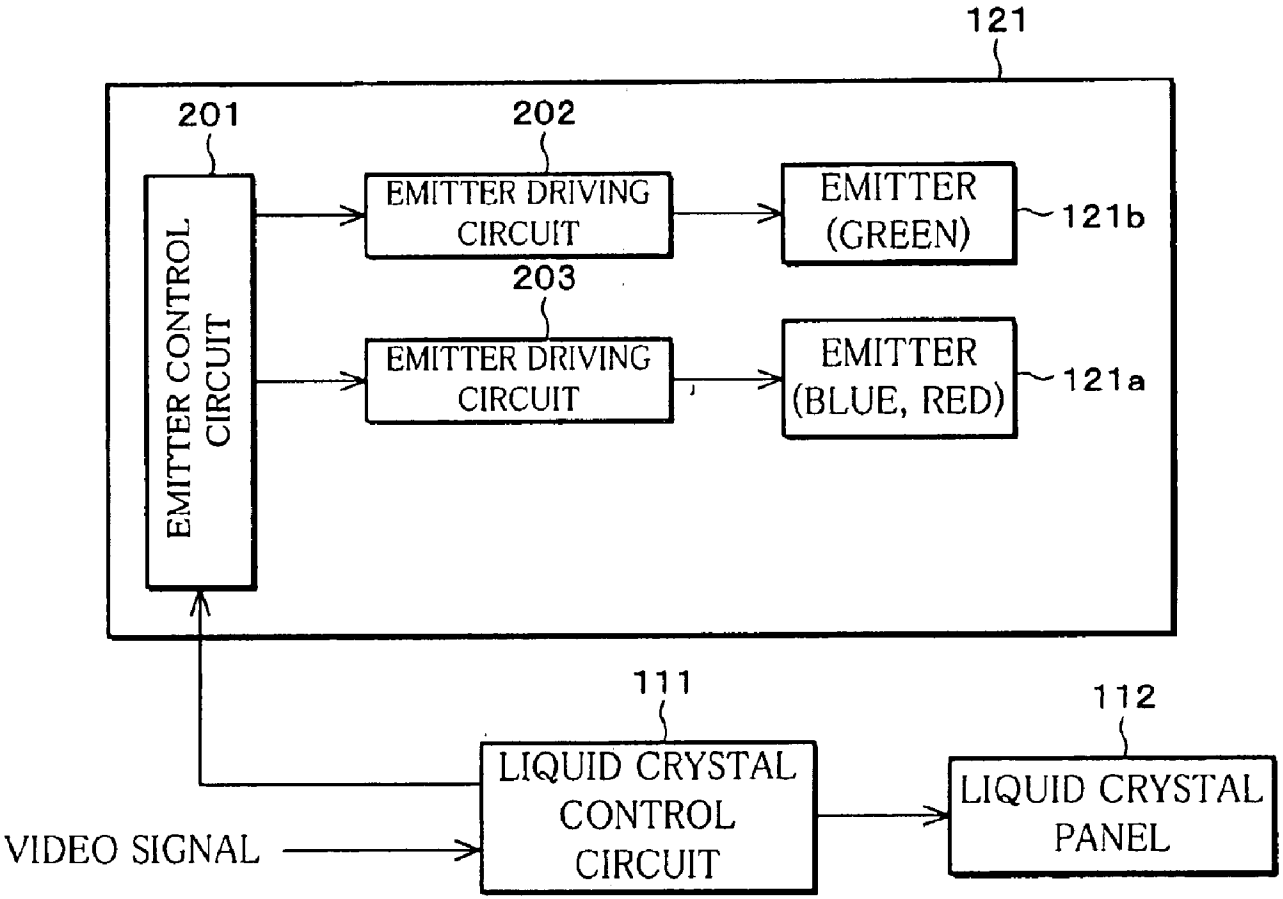
FIG. 23 is a block diagram showing a structure of the illumination device of FIG. 22(*a*) and FIG. 22(*b*).

The block 121 includes an emitter 121*b* containing only a fluorescent material of green, and an emitter 121*a* containing fluorescent materials of blue and red. The emitter 121*b*, as shown in FIG. 23 for example, is connected to an emitter control circuit 201 via an emitter driving circuit 202. Further, the emitter 121*a* is connected to the emitter control circuit 201 via an emitter driving circuit 203. The other blocks 122 through 124 are also connected to circuits in the same manner, and each block is driven at a timing different from one another.

Figure 24:
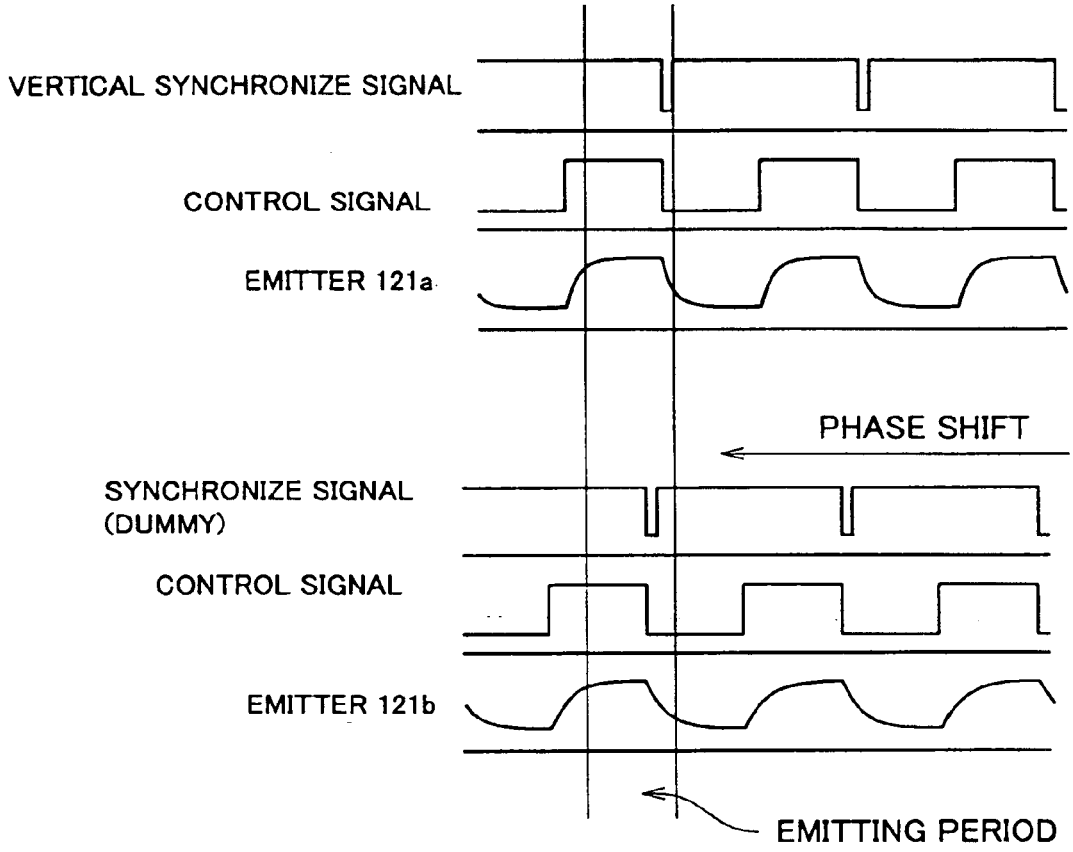
FIG. 24 is a waveform diagram showing how emitting periods of emitters are essentially matched by shifting respective driving timings of the emitters.

As shown in FIG. 24, the timing of driving the emitter 121*b* was shifted forward, while driving the emitter 121*a* at a normal timing, so as to substantially match the emitting periods of respective emitters.

In order to shift forward the timing of driving the emitter 121*b*, as shown in FIG. 24 for example, a dummy synchronize signal having the same period as that of the vertical synchronize signal is used instead of the vertical synchronize signal. This shifts (sets forward) the phase of the control signal of the emitter control circuit 201 as shown in FIG. 24, thereby substantially matching the emission timings of the emitters 121*a* and 121*b*. Note that, the dummy synchronize signal is incorporated in the drawing to explain the change in phase of emitting periods of emitters which are driven at the same timing, which change is caused due to different response times of the emitters.

Figure 25:
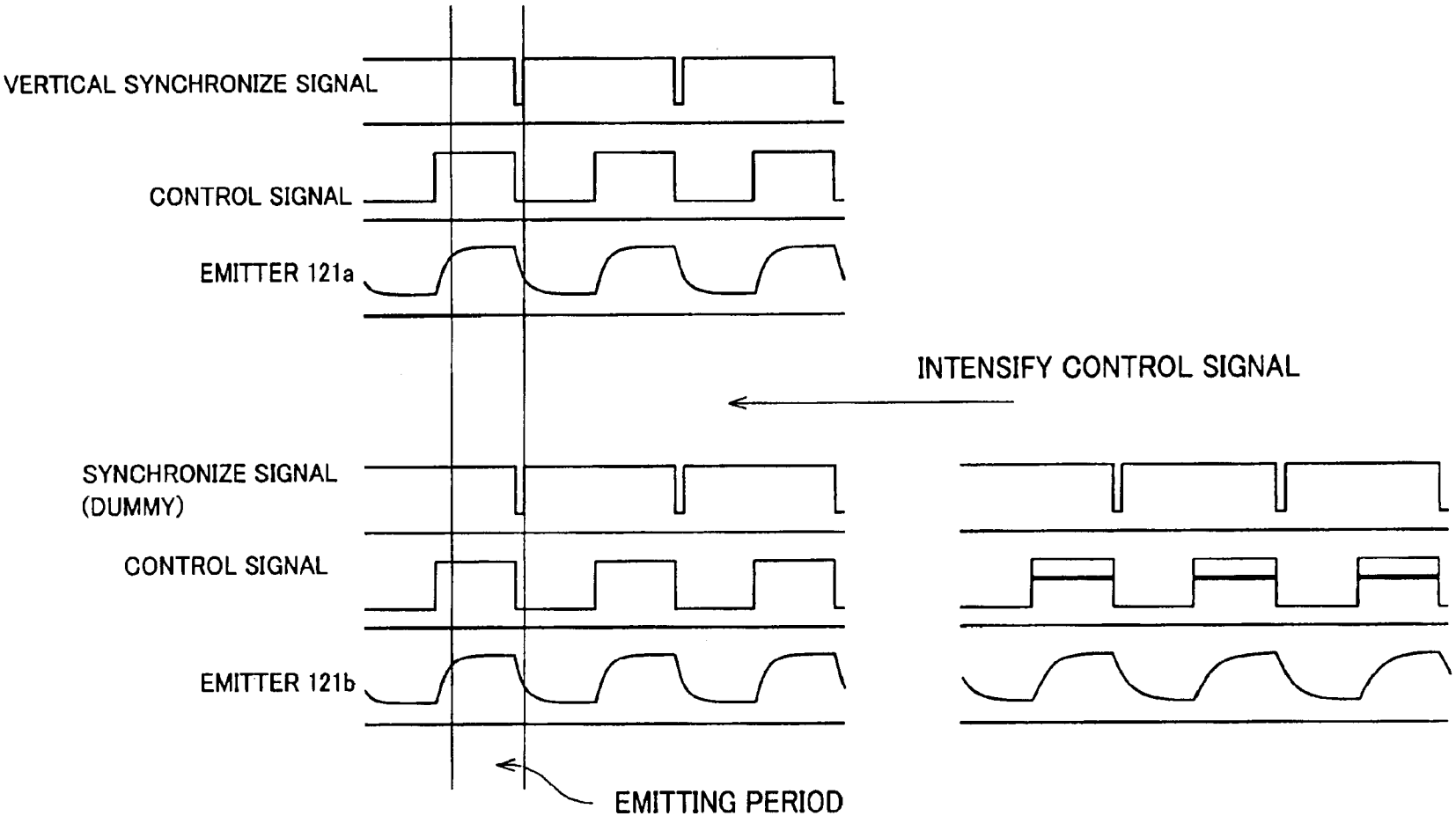
FIG. 25 is a waveform diagram explaining an example of reducing deviation of emitting periods of emitters in the present invention.

The following explains an example of reducing the deviation of the emitting periods of the plurality of emitters in the present invention, with reference to FIG. 25. In this case, the illumination device as shown in FIGS. 22(*a*) and 22(*b*) and FIG. 23 was prepared. Instead of setting forward the driving timing of the emitter 121*b*, the inverter input signal was intensified as shown in FIG. 25. As a result, the response time of the emitter 121*b* became shorter, thereby reducing the deviation of the both emitting periods of the emitters 121*a* and 121*b*.

Even though the foregoing explained the case where the emitter 121*b* emits light of only green among the three primary colors, the present invention is not limited to this and the emitter 121*b* may emit light of only blue among the three primary colors. In general, the response of green is the slowest, while that of blue is the fastest. Thus, by correcting the emitter whose response time deviates most (i.e., the emitter with the greatest degree of off-phase of the emission periods) a desirable display can be obtained with a simple structure.

It is preferable that the emitter 121*a* is a cold cathode tube containing a fluorescent material of a color with a relatively long response time among the three primary colors, while the emitter 121*b* is a cold cathode tube with a relatively shorter response time. Currently, the cold cathode tubes are most superior in industrial applications in terms of cost and productivity. Therefore, by dividing the cold cathode tubes into two groups, a group of emitters with a relatively longer response time (larger phase shift), and a group of emitters with a relatively shorter response time (smaller phase shift), and by correcting these emitter groups, it is possible to realize a practical display for practical applications, which is superior in terms of cost and productivity.

It is preferable that the emitter 121*a* contains the fluorescent material of green, and the emitter 121*b* contains the fluorescent materials of red and blue. However, the emitter 121*a* may contain the fluorescent materials of green and red, and the emitter 121*b* may contain the fluorescent material of blue.

In general, the response of green is the slowest, while that of blue is the fastest. Thus, by correcting the emitter whose response time deviates most (i.e., the emitter with the greatest degree of off-phase of the emission periods), a desirable display can be obtained with a simple structure.

The foregoing described the case where the three primary colors are effected by the two cold cathode tubes which are provided as the emitters. However, the present invention is not limited to this, and the emitters may be realized by a first cold cathode tube containing a fluorescent material with a relatively longer response time, a second cold cathode tube containing a fluorescent material with an intermediate response time, and a third cold cathode tube containing a fluorescent material with a relatively shorter response time (see the structure shown in FIG. 20 including emitters 105 through 107). In this case, because the three primary colors are divided into three cold cathode tubes, the emitting periods of the respective colors can be matched more accurately, thus providing the most preferable condition for a desirable display.

It is preferable that the emitter driving circuits (202, 203, 102 through 104) for driving the emitters (121*a*, 121*b*, 105 through 107) are provided, and the emitting period and the dimming period are independently controlled by modulating the phase, amplitude or pulse width of the input signal with respect to the emitter driving circuits (inverters).

Matching the emitting periods have the following three aspects. That is, the start time and end time of the emitting period, the duration of the emitting period, and the luminance profile at the beginning and end of the emitting period. The phase modulation controls the start time of the emitting period, and the pulse width modulation controls the duration of the emitting period and the end time associated with it. Further, the amplitude modulation controls the luminance profile at the beginning and end of the emitting period. Among these, the start time has the largest effect, followed by the end time and the luminance profile.

It is preferable that the emitting period of the emitter 105 is independently controlled, as well as being controlled to substantially match the emitting periods of the emitters 105 through 107. The emitting period of the emitter 106 or 107 may be independently controlled, and may be controlled to substantially match the emitting period of the emitter 105.

In principle, it is preferable for loyal reproduction of an intended image that the emitter starts and ends the emitting period according to the control signal with no waiting time. However, a zero response time in reality is unattainable. Further, an effort to set forward the phase may results in the use of a high voltage circuit or a phase adjusting circuit, which were not required conventionally.

It is therefore more practical to substantially match the emitting periods of the cold cathode tubes by correcting the emitters 106 and 107 whose phases are relatively ahead. In this case, it is practical and effective to substantially match the emitting periods of the cold cathode tubes by actively correcting the emitter with a longer response time and a larger phase deviation. Such a correction may be carried out, for example, by delaying the phase. A circuit for delaying the phase are often realized by an adjusting circuit of a relatively simple structure, thus avoiding a complex structure.

It is preferable that the emitting periods of the emitters 105 through 107 are independently controlled, as well as being controlled to substantially match. By independently controlling the emitters 105 through 107, it is ensured that the most desirable display is obtained.

Further, it is preferable that the emitter 121*b* contains only the fluorescent material of green. The emitter 121*b* may contain the fluorescent materials of green and red. In the case where two cold cathode tubes are provided, the emitter which would cause the largest phase deviation should be independently controlled. That is, the fluorescent material with the slowest response is generally the fluorescent material of green, and that with the fastest response is blue. Thus, by containing a fluorescent material of either of these two colors by itself, the phase deviation can be made smaller with certainty. The foregoing effect can be appreciably obtained by controlling the emitting period of the single-color emitter or the two-color emitter, provided that their emitting periods are substantially matched.

It is preferable that the emitters are provided at an end portion of an illumination unit covered with a photoconductor (both not shown), and illuminate the entire surface of the liquid crystal display device at the same phase. In this case, the illumination light is supplied to the liquid crystal display device, through the photoconductor, from the emitters which are provided at an end portion of the illumination unit.

Here, the emitting periods of the illumination light corresponding to all pixels (not shown) are matched. Therefore, it is crucial to decide an area in the screen in which the emitting period is set to start. A display area in which the emitting periods are matched immediately after it was scanned by the liquid crystal display device shows a display of the previous one vertical period because the response of the liquid crystal is not complete. A timing which is generally preferable is between the end of a liquid crystal display in the vicinity of the center of the liquid crystal display device and before scanning is started in this area. This provides the most desirable display at the center of the display. According to the foregoing structure, the timing can be changed depending on the use of the liquid crystal display device.

It is preferable that the emitters are divided into a plurality of areas having emitting periods of different phases with respect to the vertical synchronize signal, and the emitters having the emitting periods of the same phase make up a group of emitters to illuminate the same area of the liquid crystal display device, and the areas of different illumination areas are almost the same, and the phases are shifted at substantially equal intervals in order along the scanning direction, and the phase difference divides one vertical period into equal parts.

In the illumination device of a direct type, the emitters are divided into a plurality of areas having emitting periods of different phases with respect to the vertical synchronize signal, and the emitters having the emitting periods of the same phase make up a group of emitters to illuminate the same area of the liquid crystal display device, and the areas of different illumination areas are almost the same, and the phases are shifted at substantially equal intervals in order along the scanning direction, and the phase different divides one vertical period into equal parts. It is therefore possible to maintain a constant relation between the scanning timing of the liquid crystal display device and the phase of the emitting periods of the illumination area, irrespective of the display device. Thus, it becomes possible to match the emitting periods with a time zone near the time of completion of the liquid crystal in any display area. As a result, a display with good contrast is possible in all display areas.

The number of groups of emitters is preferably in a range of 4 and 48. The number of emitter groups less than 4 results in more phase shifts with respect to scanning of the liquid crystal display device, whereas the number of emitter groups larger than 48 requires nearly 100 cold cathode tubes (at least 48×2=96), which is not practical in terms of packaging and cost.

As described, a first liquid crystal display device of the present invention, in a liquid crystal display device provided with a certain period of reduced luminance per one frame period of the illumination device, is adapted to illuminate at least one of the three primary colors of light by an independent emitter.

According to a second liquid crystal display device of the present invention, in the first liquid crystal display device, the phase of the waveform applied to the emitter is different depending on the emitted color.

According to a third liquid crystal display device of the present invention, in the first liquid crystal display device, the amplitude of the waveform applied to the emitter is different depending on the emitted color.

According to a fourth liquid crystal display device of the present invention, in the first liquid crystal display device, the pulse width of the waveform applied to the emitter is different depending on the emitted color.

According to a fifth liquid crystal display device of the present invention, in the first liquid crystal display device, cold cathode tubes are used for the emitters of the illumination device.

According to a sixth liquid crystal display device of the present invention, in the first liquid crystal display device, hot cathode tubes are used for the emitters of the illumination device.

According to a seventh liquid crystal display device of the present invention, in the first liquid crystal display device, electroluminescence elements are used for the emitters of the illumination device.

According to an eighth liquid crystal display device of the present invention, in the first or fifth liquid crystal display device, cold cathode tubes are used for the emitters of the illumination device, and there are provided a cold cathode tube using a fluorescent material of green, and a cold cathode tube using a fluorescent materials of red and blue.

According to a ninth liquid crystal display device of the present invention, in any one of the first through fourth liquid crystal display device, cold cathode tubes are used for the emitters of the illumination device, and there are provided a cold cathode tube using a fluorescent material of green, a cold cathode tube using a fluorescent material of red, and a cold cathode tube using a fluorescent material of blue.

According to a tenth liquid crystal display device of the present invention, in the eighth or ninth liquid crystal display device, the emitting period of the cold cathode tube of green is started at a timing earlier than the other cold cathode tubes.

According to an eleventh liquid crystal display device of the present invention, in the eighth or ninth liquid crystal display device, the cold cathode tube of green is switched OFF or dimmed at a timing earlier than the other cold cathode tubes.

According to a twelfth liquid crystal display device of the present invention, in the ninth liquid crystal display device, the cold cathode tube of green, the cold cathode tube of red, and the cold cathode tube of blue are switched ON in this order.

According to a thirteenth liquid crystal display device of the present invention, in the ninth liquid crystal display device, the cold cathode tube of green, the cold cathode tube of red, and the cold cathode tube of blue are switched OFF or dimmed in this order.

According to a fourteenth liquid crystal display device of the present invention, in the ninth liquid crystal display device, the cold cathode tube of blue is switched ON last.

According to a fifteenth liquid crystal display device of the present invention, in the ninth liquid crystal display device, the cold cathode tube of blue is switched OFF or dimmed last.

According to a sixteenth liquid crystal display device of the present invention, there are provided a cold cathode tube containing fluorescent materials of green and red, and a cold cathode tube containing only the fluorescent material of blue.

According to a seventeenth liquid crystal display device of the present invention, in the sixteenth liquid crystal display device, the cold cathode tube containing fluorescent materials of green and red is switched ON earlier.

According to an eighteenth liquid crystal display device of the present invention, in the sixteenth liquid crystal display device, the cold cathode tube containing fluorescent materials of green and red is switched OFF or dimmed earlier.

According to a nineteenth liquid crystal display device of the present invention, in the sixteenth liquid crystal display device, the response speed of the cold cathode tube containing only the fluorescent material of blue is made slower, so as to delay the start of the emitting period.

According to a twentieth liquid crystal display device of the present invention, in the sixteenth liquid crystal display device, the pulse width is made different in accordance with the emitted color.

According to the foregoing first through twentieth liquid crystal display devices, it is ensured improving display quality of fast-moving images without causing the coloring phenomenon.

[Third Embodiment]

The following will describe yet another embodiment of the present invention with reference to FIG. 26 through FIG. 31.

Figure 26:
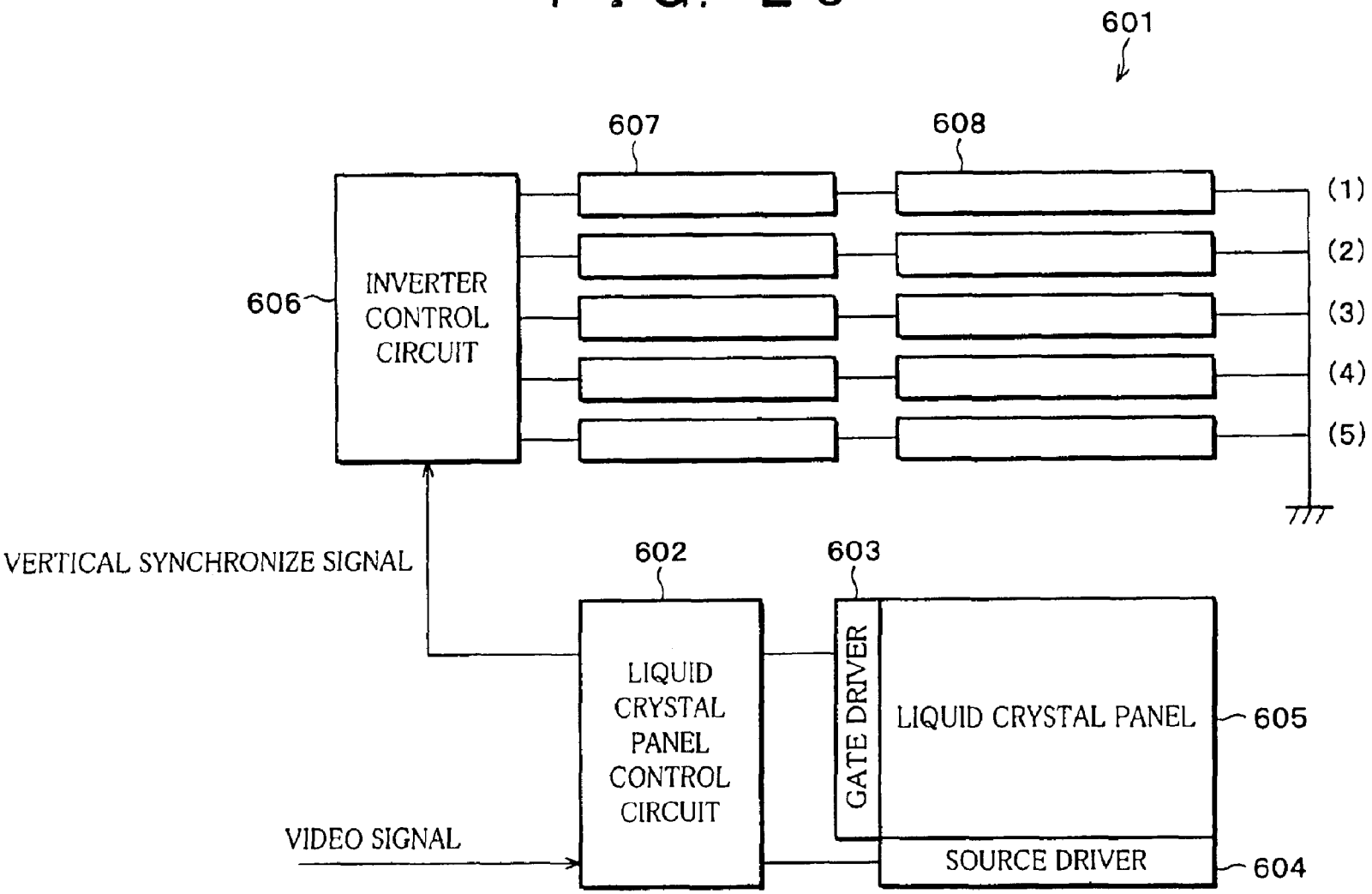
FIG. 26 is a block diagram showing an exemplified structure of an image display device according to the present invention.

As shown in FIG. 26, a liquid crystal display device 601 as an image display device according to the present embodiment adopts, for example, an active-matrix mode with TFTs (thin film transistors) of 640×480 dots. A liquid crystal panel (display section) 605 as an image panel includes liquid crystal display elements (pixels) (not shown), which are a plurality of display elements making up a screen, for modulating a light transmission state of a liquid crystal according to image data which are applied while being scanned. The liquid crystal display elements seal, for example, a twist-nematic liquid crystal therein. The liquid crystal panel 605 includes a gate driver 603 for driving scanning lines in the liquid crystal panel 605, and a source driver 604 for driving signal lines. The liquid crystal display device 601 includes a liquid crystal panel control circuit 602 which receives video signals. The video signals from the liquid crystal control circuit 602 are supplied to the liquid crystal panel 605 via the gate driver 603 and the source driver 604, so as to supply the video signals to the liquid crystal display elements. That is, the pixels receive signal voltages of the video signals at the corresponding signal lines at the timings of applied scanning pulses to the corresponding scanning lines.

Further, there is provided an inverter control circuit 606 as a lighting control circuit, which is connected to the liquid crystal panel control circuit 602 so as to receive a vertical synchronize signal of the liquid crystal display panel 601 therefrom. Further, a plurality of (there are five in this example) inverters 607 are provided for lighting and driving purposes. The inverters 607 receive driving signals from the inverter control circuit 606, so as to apply signals of a predetermined high frequency and a high voltage to a plurality of (there are five in this example) cold cathode tubes (illuminating elements) 608, which are emitters. The cold cathode tubes 608 are numbered 1 to 5 from the scanning starting position, and the corresponding inverters connected thereto will be called inverters (1) to (5). The inverter control circuit 606 outputs an inverter input signal to each of the five inverters 607, and the five inverters 607 drive their respective cold cathode tubes 608 according to the inverter input signals for lighting. The inverter control circuit 606, the inverters 607, and the cold cathode tubes 608 make up an illuminating section.

The cold cathode tubes 608 make up an emitting area as a back-light for illuminating the liquid crystal display elements of the liquid crystal panel 605 from the back, and the light intensity of the cold cathode tubes 608 becomes the luminance of the illuminating section. There are provided five cold cathode tubes 608 and five inverters 607. The five cold cathode tubes 608 are disposed parallel to the scanning lines in the lengthwise direction with equal intervals in the signal line direction (vertical scanning direction).

Figure 30:
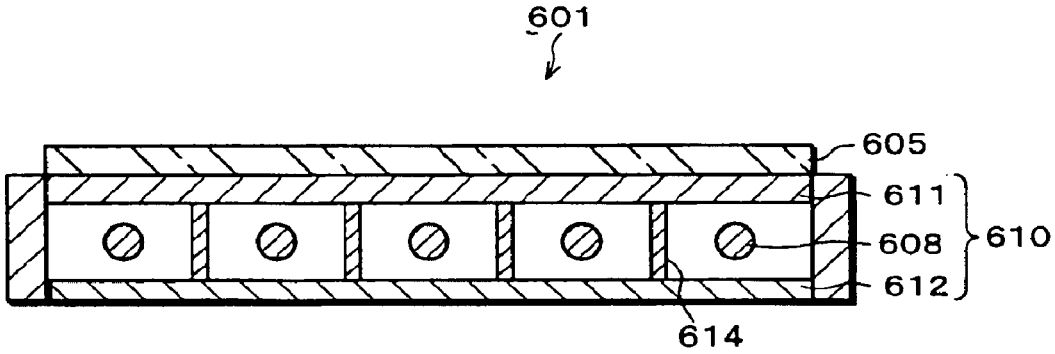
FIG. 30 is a cross sectional view showing an exemplified structure of the image display device according to the present invention.

As shown in FIG. 30, the liquid crystal display device 601 has a combined structure of the liquid crystal panel 605 and a back-light section 610. The back-light section 610 is an illumination device of a direct type which includes a diffusing plate 611 on the side facing the liquid crystal panel 605, and a reflecting plate 612 on the other side, and the cold cathode tubes 608 which are disposed therebetween. Note that, FIG. 30 omits the liquid crystal control circuit 602, the gate driver 603, the source driver 604, the inverter control circuit 606, and the inverters 607.

In the present embodiment, as shown in FIG. 30, the illuminating section includes partition walls (partition member) 614 for parting the emitting area in the back-light section 610. That is, the partition walls 614 are provided in the form of thin films between the diffusing plate 611 and the reflecting plate 612, perpendicular to the respective planes of the diffusing plate 611 and the reflecting plate 612. Note that, the angle made by the respective planes of the partition walls 614 and the diffusing plate 611 and the reflecting plate 612 may be perpendicular as shown in the drawing, or any other angle. The partition walls 614 in the form of thin films are extended in a direction into the plane of the paper, i.e., a lengthwise direction of the cold cathode tubes 608 (direction parallel to the scanning line) along the cold cathode tubes 608, and completely cover the emitting portion of the cold cathode tubes 608, so as to shield light from the emitting portion. In this manner, the partition walls 614 are provided to prevent the illumination light of one cold cathode tube 608 from reaching the liquid crystal which is assigned to be illuminated by another cold cathode tube 608, for example, liquid crystal to be illuminated by an adjacent cold cathode tube 608. The emitting area is parted by thus parting adjacent illuminating elements.

The partition wall 614 each has a thickness not more than the width of the shielding section (not shown) of the liquid crystal panel 605, and aluminium with a thickness of 0.02 mm is used therefor. The partition walls 614 are tightly attached to the diffusing plate 611 and the reflecting plate 612 without a gap, so as to prevent light of the cold cathode tubes 608 from leaking to the adjacent emitting area therebetween. As a result, the light of one cold cathode tube 608 does not illuminate the display elements (liquid crystal) which are assigned to be illuminated by the other cold cathode tubes 608, including adjacent ones.

As described, there are provided five cold cathode tubes 608. Therefore, in the elements of 640×480 dots, a single cold cathode tube 608 corresponds to 96 scanning lines. That is, the first cold cathode tube 608 illuminates pixels which correspond to the first through 96th scanning lines, and the second cold cathode tube 608 illuminates pixels which correspond to the 97th through 192nd scanning lines, and so on. That is, when the number of cold cathode tubes 608 is M, and the number of scanning lines, i.e., the number of pixels in the scanning line direction is N, an nth cold cathode tube 608 illuminates pixels which correspond to $\{(n-1)\cdot(N/M)+1\}$th through $\{n\cdot(N/M)\}$th scanning lines. Note that, the number of scanning lines is not particularly limited as long as it can effectively relieve lowering of image quality such as a streaking phenomenon in a fast-moving image, which will be mentioned later.

Here, the liquid crystal display elements having the same scanning time are grouped into a display element band. That is, in this example, a single display element band is composed of 640 liquid crystal display elements which correspond to a single scanning line. The display element band is further grouped into display element groups in the order of scanning time and to include at least one display element band in one group. That is, in this example, 640×96 liquid crystal display elements, corresponding to adjacent 96 scanning lines, make up a single display element group, which grouping is made in the order of scanning time.

Further, each cold cathode tube 608 makes up an illumination element group for the illuminating element for illuminating the group of display elements. That is, one display element group corresponds to one illuminating element group. Further, in the present embodiment, one illuminating group includes one cold cathode tube 608.

Figure 27:
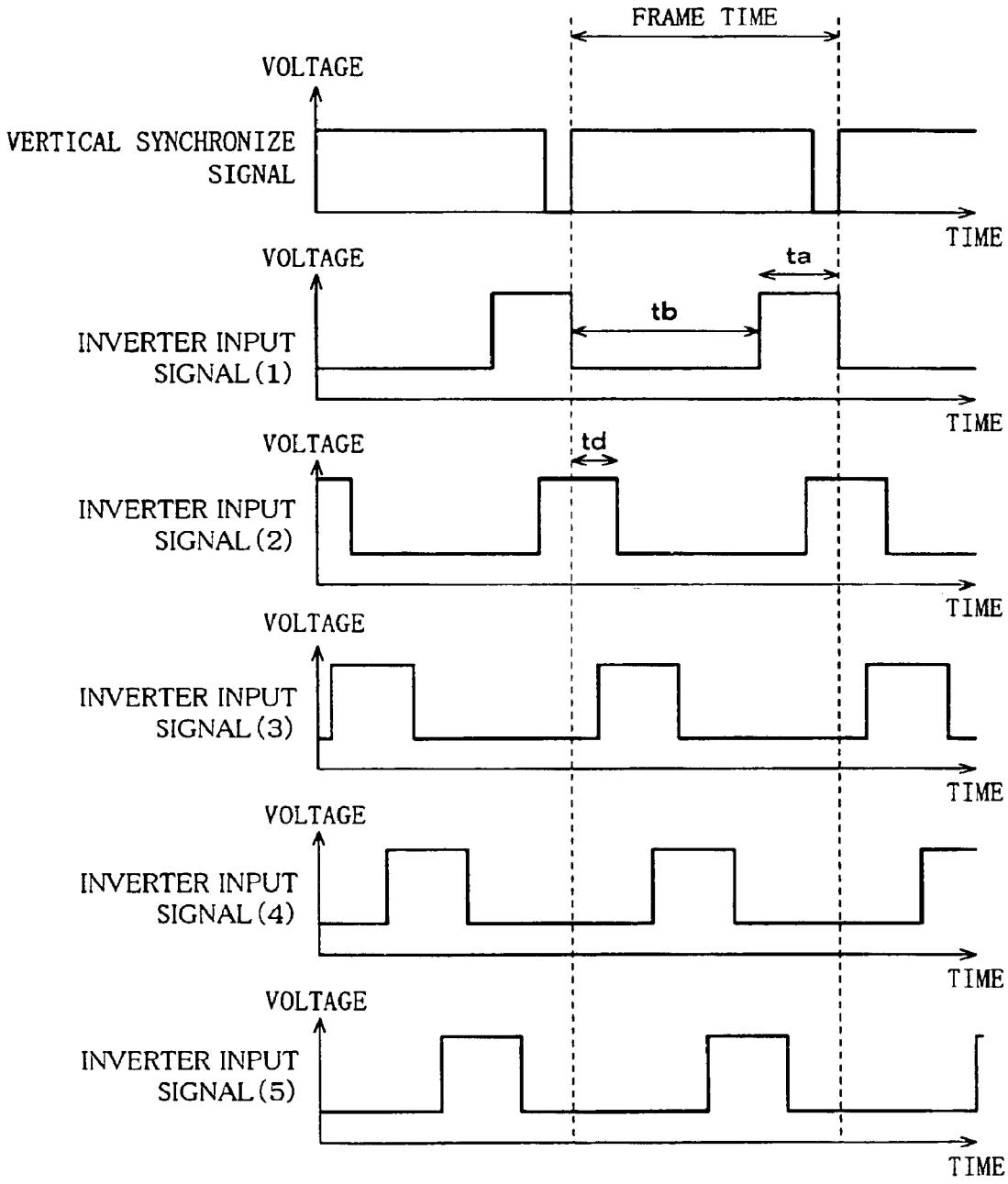
FIG. 27 is a timing chart showing a vertical synchronize signal and inverter input signals.
Figure 28:
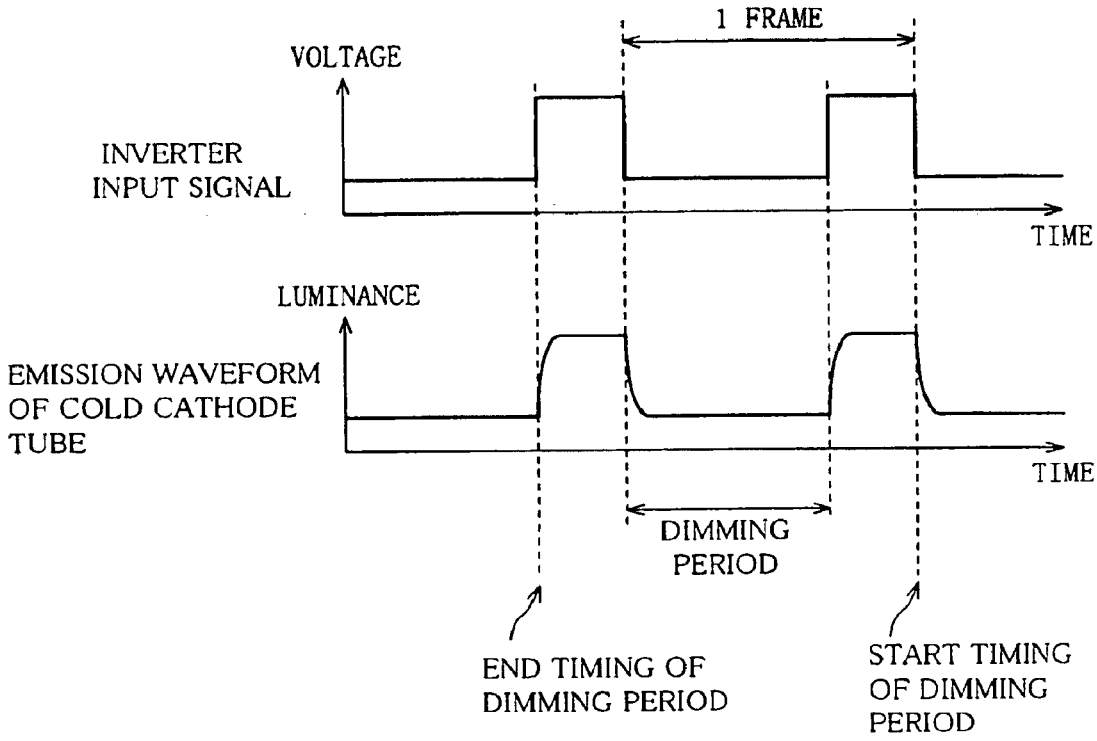
FIG. 28 is a timing chart showing an inverter input signal and an emission waveform of a cold cathode tube.

FIG. 27 shows a waveform of the vertical synchronize signal inputted into the inverter control circuit 606, and waveforms of inverter input signals (1) to (5) as the driving signals outputted to the inverters (1) through (5). The inverter input signals (1) to (5) are signals which are respectively inputted into the inverters (1) through (5) as shown in FIG. 26. Further, FIG. 28 shows a waveform of emission of an arbitrary cold cathode tube 608 and a waveform of an inverter input signal which is inputted into the corresponding inverter 607 to drive the cold cathode tube 608. As shown, the emitters are successively scanned for lighting (flashing) or dimming in synchronism with the vertical synchronize signal, in response to the inverter input signals as shown in FIG. 27. The operation of successive scanning for dimming according to the vertical synchronize signal refers to the operation of successively shifting (scanning) the emitter to be dimmed among emitters which are selected according to the display elements which are scanned one after another, by the repeating operation of the selected emitter, which is dimmed at least in a part of its selected period, and upon becoming a non-selected state by the selection of the next emitter after the selected period, returns to a lighted state at least in a part of the non-selected period.

The inverter control circuit 606 includes a counter and a shift register (both not shown). The counter receives a horizontal synchronize signal, and the shift register receives a vertical synchronize signal. The pulse width, i.e., the duty ratio of each inverter input signal is decided by counting (dividing) the horizontal synchronize signal by the counter. By the shift register, the inverter input signal (1) is outputted to the corresponding inverter (1) of the inverter 607 in synchronism with the vertical synchronize signal (rising timing). Then, in order to shift the dimming start times of the cold cathode tubes 608 (to be described later), the inverter input signals (2) through (5) are successively outputted by the shift register to their corresponding inverters 607 at the timings of predetermined inverter control clocks (not shown), which are provided to decide the degree of off-phase of the inverter input signals. The five cold cathode tubes 608 enter a dimming period periodically in one frame period, one after another at different timings, and therefore the phases are shifted by a frame time/the number of cold cathode tubes.

In the present embodiment, the inverter input signals of adjacent inverters in the inverter input signals (1) through (5) are set so that their lighting periods, i.e., high voltage periods overlap. However, not limiting to this, the high voltage period of a certain inverter input signal may be started at the timing when dimming of a preceding inverter input signal is started, i.e., when the signal becomes low voltage. Further, the high voltage signal of a certain inverter input signal may be started short while after the dimming period of a preceding inverter input signal is started. The pulse width of each inverter input signal can be arbitrarily set by deciding, at the time of manufacture or use, the counts of the horizontal synchronize signal. Further, the degree of phase deviation of the inverter input signals can be arbitrarily set, at the time of manufacture or use, by adjusting the inverter control clock.

Here, the period of high voltage level is ta, and the period of low voltage level is tb. When one frame period is f, ta+tb=f. The driving signal outputted by the inverter control circuit 606 to each inverter 607 is set so that it becomes low voltage level (3 V) at the time when the area illuminated by the cold cathode tube 608 is scanned. Further, here, the driving signal is set to become high voltage level (9V) after the elapsed time tb (e.g., ½ frame period) from the time when it became low voltage level, and the high voltage level is maintained for ta (e.g., ½ frame period (f−tb). The cold cathode tube 608, as shown in FIG. 28, is switched ON brightly at its normal luminance (first luminance) when the inverter input signal becomes high voltage level according to the driving signal and the dimming period ends. Conversely, the dimming period starts when the inverter input signal becomes low voltage level, and the cold cathode tube 608 is dimmed from its normal level, and is lit at predetermined luminance (second luminance) which is brighter than the OFF state. A dimming period is the period between the dimming start timing and the dimming end timing.

Note that, here, the second luminance refers to a state in which the cold cathode tube 608 is dimmed to be darker than normally by a predetermined low voltage level to emit light with predetermined luminance which is brighter than the luminance of an OFF state. However, it is possible alternatively to set the predetermined low voltage level to zero, so as to have a completely OFF state.

By this system of driving, the five cold cathode tubes 608 are scanned as they are successfully dimmed. That is, a shown in FIG. 27, within one frame period, the inverter input signal (1) first becomes low voltage level at the timing of the vertical synchronize signal, and the first cold cathode tube 608, i.e., the cold cathode tube (1) enters the dimming period. After a predetermined time period, i.e., after the elapsed time (td) which corresponds to the degree of phase deviation between the inverter input signals (1) and (2), the inverter input signal (2) becomes low voltage level and the second cold cathode tube 608, i.e., the cold cathode tube (2) enters the dimming period. The same process is repeated thereafter.

Therefore, in this example, in a scanning period of a pixel, the cold cathode tube illuminating this pixel is in a dim state, and becomes a normal ON state before the end of one frame period, at the latest, from the start of dimming (in this example, after the elapsed time tb (e.g., after ½ frame period)).

Here, observing a fast-moving image on the liquid crystal display device using the cold cathode tubes 608, the liquid crystal display device using the cold cathode tubes 608 produced a superior image far clearer than those produced by conventional liquid crystal display devices. The fast-moving image evaluated here included images in a TV sports program (images including fast movement of players or a ball, as in tennis, volley ball, or base ball), or the scrolling image of staffs and casts which is displayed at the end of a TV program, to see if there is any improvement in display quality by checking for such a phenomenon as streaking.

As described, in the present embodiment, there are provided cold cathode tubes 608, which are a plurality of emitting areas in the scanning direction, and the plurality of emitting areas are successively scanned at predetermined luminance and timing in synchronism with the vertical synchronize signal of the liquid crystal display device to effect dimming and lighting (flashing). In doing so, the phases of timings at which the cold cathode tubes 608 emit light are shifted according to the scanning timings of the display element groups illuminated by the respective cold cathode tubes 608. As a result, it is possible to obtain a liquid crystal display device with desirable display quality, while suppressing shortening of life of emitters and the detrimental effect to luminance of a display.

Further, in the present embodiment, as shown in FIG. 30, the liquid crystal display device 601 includes the partition walls 614. Thus, it was confirmed by a result of experiment that different emitting areas do not illuminate the same display area in almost all cases. Therefore, observing a fast-moving image with the foregoing liquid crystal display device, a significantly desirable display quality, which was not found conventionally, was obtained.

As described, in the present embodiment, the illuminating section includes the thin partition walls 614 in advance which separate the emitting areas and prevents the light of one emitting area from reaching the liquid crystal which is to be illuminated by another emitting area. That is, the partition walls 614 prevent the light of one cold cathode tube 608 from entering the emitting area of another cold cathode tube 608, which may be adjacent, so as to prevent incident of the light on the display area which is assigned to be illuminated by another cold cathode tube 608. This realizes a substantially one-to-one relationship between the emitting area and the display area, thus illuminating each display area according to the emission waveform of the corresponding single emitter (cold cathode tube 608). As a result, a display quality of a fast-moving image in particular can be improved. Further, as mentioned above, the partition walls 614 may be formed conveniently using a material such as a thin aluminium foil to shield light. Further, by employing a material having a reflecting property such as the aluminium foil, the light from the cold cathode tube 608 can be reflected at the surfaces of the partition walls 614 so as to illuminate the display area by allowing entry of the light efficiently into the display area which is assigned to be illuminated by this cold cathode tube 608. Therefore, the partition walls 614 can have the two effects.

Note that, in this example, a single cold cathode tube 608 is assigned to one emitting area. However, the luminance of one emitting area may be increased as a whole by lighting additional cold cathode tubes 608 having the same emission waveform and the same timing of changing luminance, as shown in FIG. 28. In this case, a plurality of cold cathode tubes 608 operate as a single illuminating element in one emitting area.

Figure 29:
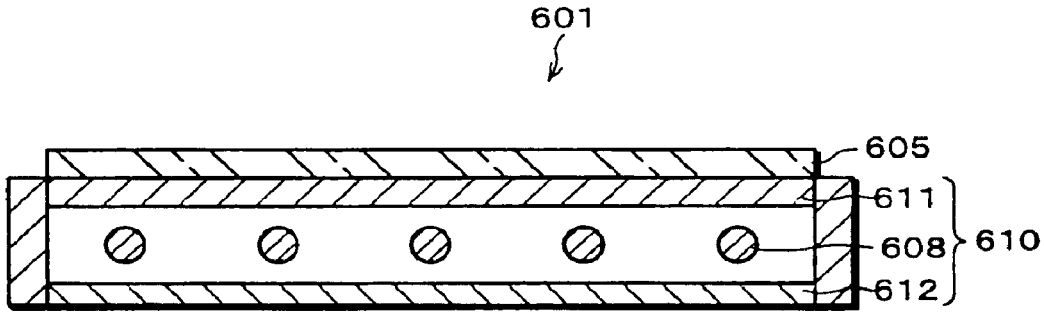
FIG. 29 is a cross sectional view showing an exemplified structure of an image display device for comparison.

FIG. 29 shows a conventional structure for comparison. That is, no partition walls 614 are provided. In this structure, the light of one cold cathode tube 608 reaches the liquid crystal over a wide range, including adjacent one and more distant ones. In other words, different emitting areas illuminate the same display area.

Figure 31:
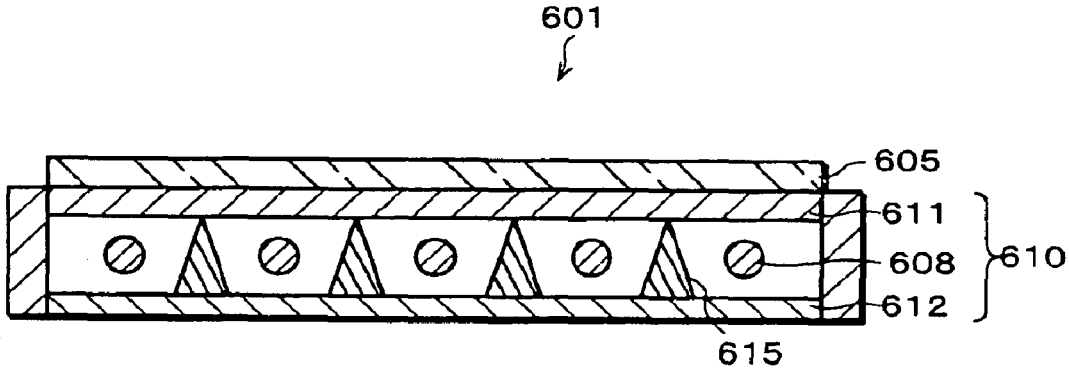
FIG. 31 is a cross sectional view showing another exemplified structure of the image display device according to the present invention.

Note that, it was also possible to obtain the same effect using partition walls (partition member) 615, instead of the partition walls 614, having a cross sectional shape an isosceles triangle, as shown in FIG. 31. The partition walls 615 in the form of an isosceles triangular cross section extend in a direction into the plane of the paper, i.e., in a lengthwise direction of the cold cathode tubes 608 (direction parallel to the scanning line) along the cold cathode tubes 608.

The partition walls 615 may be made by injection molding of resin, cutting of resin, cutting of metal, or by folding a resin sheet (thin plastic plate) or a metal plate into an up-side-down V shape.

The width in the horizontal direction of each partition wall 615 in FIG. 31 is not more than the width of a shielding section (not shown) of the liquid crystal panel 605. Further, the partition walls 615 are tightly attached to the diffusing plate 611 and the reflecting plate 612 without a gap, so as to prevent light of the cold cathode tubes 608 from leaking to the adjacent emitting area through the connected parts of the partition portions 612*a*, and the diffusing plate 611 and reflecting plate 612. As a result, the light of one cold cathode tube 608 does not illuminate the display elements (liquid crystal) which are assigned to be illuminated by the other cold cathode tubes 608, including adjacent ones.

Note that, the height in the vertical direction of the partition member, i.e., the degree of shielding, or the range of the partition member, i.e., the range of shielding in the drawings is set appropriately according to the extent to which degradation of display quality is to be relieved, which is caused, for example, by image persistence due to an extended pulse width of emission of the cold cathode tube 608 in a displayed fast-moving image.

[Fourth Embodiment]

Figure 32:
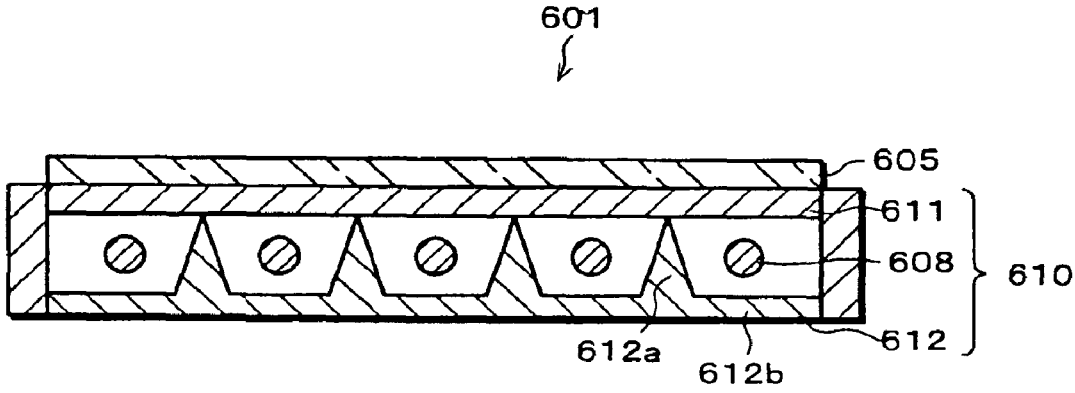
FIG. 32 is a cross sectional view showing yet another exemplified structure of the image display device according to the present invention.
Figure 33:
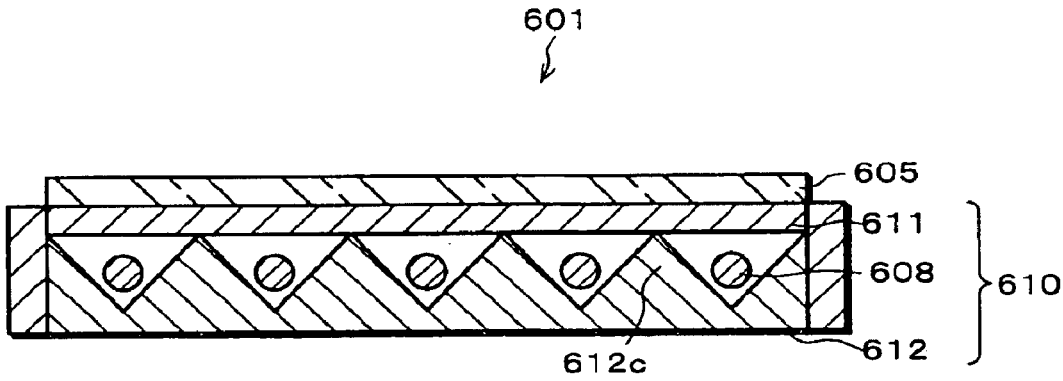
FIG. 33 is a cross sectional view showing still another exemplified structure of the image display device according to the present invention.
Figure 34:
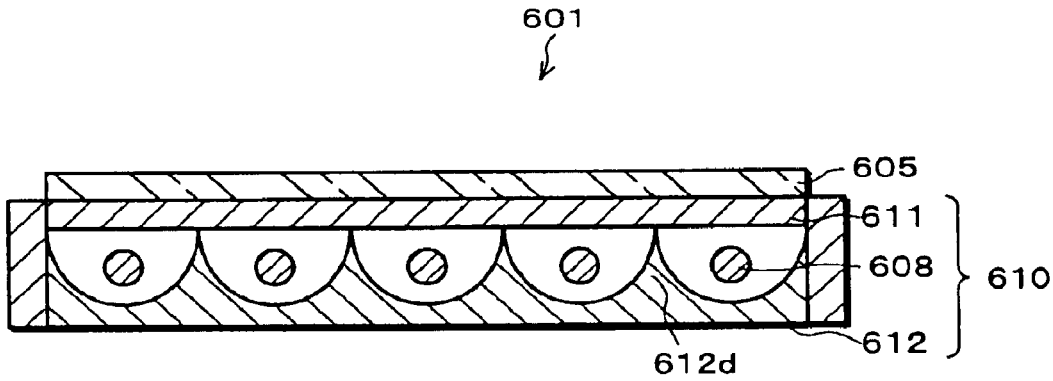
FIG. 34 is a cross sectional view showing yet another exemplified structure of the image display device according to the present invention.

The following will describe still another embodiment of the present invention with reference to FIG. 32 through FIG. 34. Note that, elements having the same functions as those described pertaining to the drawings of the foregoing embodiments are given the same reference numerals and explanations thereof are omitted here.

In the present embodiment, the partition walls 614 and 615 are modified as shown in FIG. 32. The other structure is the same as that described in the Third Embodiment.

In the present embodiment, instead of independently providing the members like the partition walls 615, as shown in FIG. 32, a partition portion of a concave shape (concave portion) 612*a*, corresponding to each emitting area, is integrally provided with a reflecting plate 612 as a part of the reflecting plate 612. That is, the reflecting plate 612 is an integral body of a material including partition portions 612*a*, which correspond to the partition walls 615, having an isosceles triangular cross sectional shape (see FIG. 31), and a flat portion 612*b*, wherein the cold cathode tubes 608 are placed in wells of the concave shape of the partition portions 612*b*. Note that, the boundary of the partition portions 612*a* and the flat portion 612*b* may have an angle as shown in the drawing, or it may be curved. The partition portions 612*a* in the form of an isosceles triangular cross section extend in a direction into the plane of the paper, i.e., in a lengthwise direction of the cold cathode tubes 608 (direction parallel to the scanning line) along the cold cathode tubes 608, and completely cover the emitting portion of the cold cathode tubes 608, so as to shield light from the emitting portion. In this manner, the partition portions 612*a*, as with the partition walls 614 and 615, are provided to prevent the illumination light of one cold cathode tube 608 from reaching the liquid crystal which is assigned to be illuminated by another cold cathode tube 608, for example, liquid crystal to be illuminated by an adjacent cold cathode tube 608. The emitting area is parted by thus covering the cold cathode tubes 608 with the partition portions 612*a* which are placed between adjacent cold cathode tubes 608.

The width in the horizontal direction of each partition portion 612*a* in FIG. 32 is not more than the width of a shielding section (not shown) of the liquid crystal panel 605. Further, the partition portions 612*a*, as with the partition walls 614 and 615, are tightly attached to the diffusing plate 611 and the reflecting plate 612 without a gap, so as to prevent light of the cold cathode tubes 608 from leaking to the adjacent emitting area through the connected parts of the partition portions 612*a*, the diffusing plate 611, and the reflecting plate 612.

Thus, as with the Third Embodiment, it was confirmed by a result of experiment that different emitting areas do not illuminate the same display area in almost all cases. Therefore, observing a fast-moving image with the foregoing liquid crystal display device, a significantly desirable display quality, which was not found conventionally, was obtained.

Further, alternatively, it is possible to employ a modified structure as shown in FIG. 33 wherein the flat portion 612*b* is eliminated, and instead of the partition portions 612*a*, there are provided partition portions (concave portion) 612*c* in which partition portions are adjacent to one another and the cross section of each portion is in the form of an isosceles triangle.

Further alternatively, as shown in FIG. 34, the isosceles triangular shape of the partition portions 612*c* may be modified to employ partition portions (concave portion) 612*d* of a shape wherein a pattern of adjacent semi-circles is cut out from the reflecting plate 612 as in the cross section of FIG. 34. In other words, the semi-circle portions are cut out from the reflecting plate 612, so as to leave the partition portions 612*d*. Further, the structure of FIG. 34 may be modified so that the pattern cut out is in the form of a parabolic shape, rather than the semi-circle shape. In this case, the reflected light becomes parallel light, and the liquid crystal can be illuminated further efficiently.

The partition portions 612*c* in the form of an isosceles triangular cross section, and the partition portions 612*d* in the form of a semi-circular cross section extend in a direction into the plane of the paper, i.e., in a lengthwise direction of the cold cathode tubes 608 (direction parallel to the scanning line) along the cold cathode tubes 608. The partition portions 612*c* have a shape which is made by folding a flat plane in a zig-zag shape, and the partition portions 612*d* have a shape in which a pattern made by cutting a circular cylinder (circular pillar) on a plane perpendicular to the bottom surface is cut out from the reflecting plate 612. By thus completely covering the emitting sections of the cold cathode tubes 608, the light from the emitting sections is shielded.

The reflecting plate 612 having the partition portions 612*a*, the flat portions 612*b*, the partition portions 612*c*, or the partition portions 612*d* may be made by injection molding of resin, cutting of resin, or cutting of metal.

In the structures as shown in FIG. 32 through FIG. 34, the partition portions 612*a*, 612*c*, or 612*d*, as with the partition walls 614 or 615, are tightly attached to the diffusing plate 611 without a gap, so as to prevent light of the cold cathode tubes 608 from leaking to the adjacent emitting area through the connected parts of the partition portions 612*a*, 612*c*, or 612*d* and the diffusing plate 611.

The effects of the Third Embodiment were also obtained by the structures of FIG. 32 through FIG. 34.

Note that, in the present embodiment, unlike the Third Embodiment, the shape of the reflecting plate 612 is modified to have the function of the partition walls 614 or 615, i.e., to prevent entry of the light of one cold cathode tube 608 into the emitting areas of the other cold cathode tubes including adjacent ones so as to prevent illumination of the display areas which are assigned to be illuminated by these cold cathode tubes 608. Thus, in addition to such a shielding function, the reflecting plate 612 has the original function of uniformly reflecting the light of the cold cathode tubes 608 so that the light from the cold cathode tubes in the concave sections is efficiently incident on their assigned display areas to be illuminated. Therefore, the reflecting plate has the two functions.

Note that, the height in the vertical direction of the concave sections, i.e., the degree of shielding, or the range of the concave sections, i.e., the range of shielding in the drawings is set appropriately according to the extent to which degradation of display quality is to be relieved, which is caused, for example, by image persistence due to an extended pulse width of emission of the cold cathode tube 608 in a displayed fast-moving image.

Further, the partition members as shown in FIG. 30 through FIG. 34 may be used in combination. For example, a part of the reflecting plate 612 may be provided with the partition walls 614, and the other part with the partition walls 615, or a part of the reflecting plate 612 may be provided with the partition walls 614, and the other part with the partition walls 612*a*. Further, for example, a spacing may be provided between the apices of the isosceles triangles of the partition portions 612*a* or 612*c* as shown in FIG. 32 and FIG. 33 and the diffusing plate 611, so as to provide the partition walls 614 as shown in FIG. 30 in the spacing.

[Fifth Embodiment]

Figure 35:
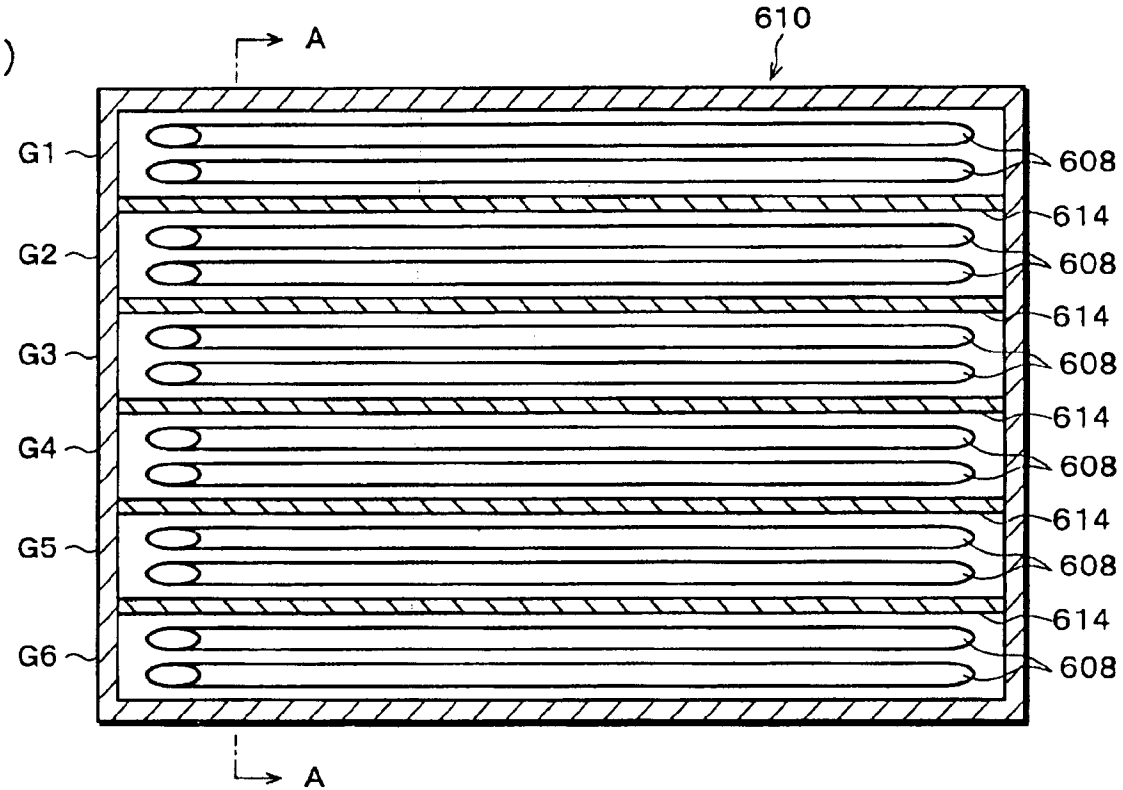
FIG. 35(*a*) and FIG. 35(*b*) are drawings showing another exemplified structure of the image display device according to the present invention, in which FIG. 35(*a*) is a cross sectional view as viewed from a direction perpendicular to a surface of a liquid crystal panel, and FIG. 35(*b*) is a cross sectional view of FIG. 35(*a*) taken along the line A—A.
Figure 35:
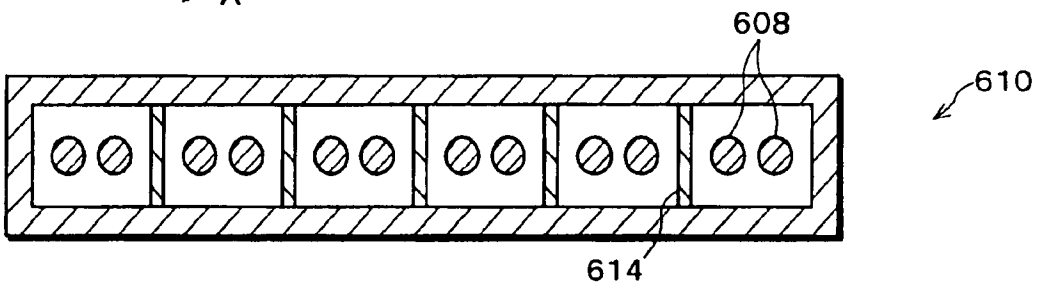
Figure 36:
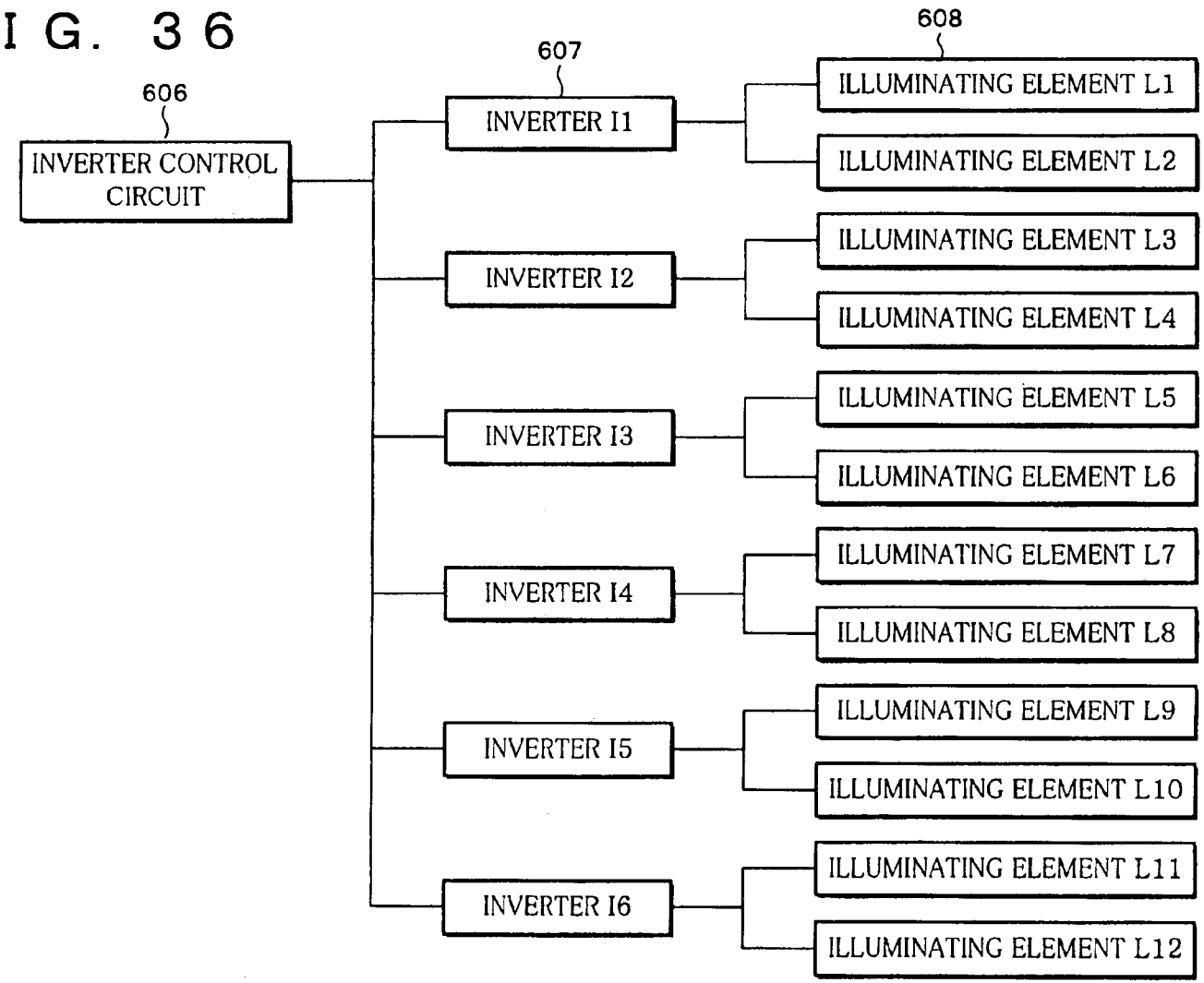
FIG. 36 is a block diagram showing an exemplified structure of an illuminating section provided in the image display device according to the present invention.

The following will describe still another embodiment of the present invention with reference to FIG. 26, FIG. 35(*a*) and FIG. 35(*b*), and FIG. 36. Note that, for convenience of explanation, elements having the same functions as those described pertaining to the drawings of the foregoing embodiments are given the same reference numerals and explanations thereof are omitted here.

First, a further explanation is given to the number of illuminating element groups for illuminating the display element groups, and the number of illuminating elements in the illuminating element group according to the present invention.

As described already in the foregoing embodiments, a display quality of a moving image display is decided by the number of illuminating element groups (=the number of display element groups), and the ON time of each illuminating element group. Also, the luminance of an image display device such as the liquid crystal display device is decided by (the number of illuminating elements in each illuminating element group)×(the number of illuminating element groups)×(proportion of ON time in one frame). Comparing contribution to display quality of a moving image in terms of increasing the number of illuminating element groups and reducing the length of ON time, the latter contributes more.

In view of this, considering brightness and display quality, it is not necessarily the case that one illuminating element group which corresponds to one display element group should include one illuminating element. For example, it is assumed in the illumination device of the liquid crystal display device currently available that brightness under 100% lighting state of the emitting element, i.e., lighting for one frame time, with the use of six illuminating elements is practically preferable. When the number of display element groups is twelve, and accordingly the number of illuminating element groups is also twelve in the present invention, it was already mentioned that the ON time of each of twelve illuminating elements becomes ½ frame time, which is effective in improving performance of displaying moving images. However, this structure employs twelve illuminating element groups, and therefore requires twelve inverters.

The following describes a structure of the present embodiment. A liquid crystal display device 1 of the present embodiment, as with that of the Third Embodiment, has the structure as shown in FIG. 26. A liquid crystal panel 605 and a back-light section 610 as shown in FIG. 35(*a*) and FIG. 35(*b*) are combined each other. FIG. 35(*a*) is a cross sectional view as viewed in a direction perpendicular to the plane of the liquid crystal panel, and FIG. 35(*b*) is a cross sectional view of FIG. 35(*a*) taken along the line A—A. Note that, in FIG. 35(*a*) and FIG. 35(*b*), the diffusing plate 611 and the reflecting plate 612 of the Third Embodiment are shown in a simplified form as a frame of the back-light section 610.

The cold cathode tube 608, as with the Third Embodiment, makes up the illuminating element group for illuminating the display element group. That is, the display element group and the illuminating element group correspond each other one to one. Further, in the present embodiment, one illuminating element group includes two cold cathode tubes 608. That is, as shown in FIG. 35(*a*) and FIG. 35(*b*), the back-light section 610 has a parted structure provided with partition walls (partition member) 614 having the same structure as that shown in FIG. 30. In this structure, a storage space for the cold cathode tubes 608 is parted into a plurality of (six in this example) of illuminating element groups (G1, G2, . . . , G6), each of which corresponding one to one to the display element group. In the structure as shown in FIG. 35(*a*) and FIG. 35(*b*), unlike that shown in FIG. 30, a plurality of (two in this example) illuminating elements are included in one illuminating element group. As shown in FIG. 36, the two illuminating elements are connected to a single inverter 607 (inverters I1, I2, . . . , I6).

That is, as shown in FIG. 36, a single back-light section 610 includes a plurality of (twelve in this example) cold cathode tubes 608 (illuminating elements L1, L2, . . . , L12). Further, a single inverter control circuit 606 is connected to a plurality of (six in this example) inverters 607. Each inverter 607 corresponds one to one to the illuminating element group (see FIG. 35(*a*)) and the display element group. Further, a single inverter 607 is connected to a plurality of (two in this example) cold cathode tubes 608, and each inverter 607 induces the same operation (ON or OFF) with respect to the plurality of (two in this example) cold cathode tubes 608. For example, the inverter I1 is assigned to control lighting of the illuminating elements L1 and L2.

In this manner, in this example, lighting of the twelve illuminating elements is controlled by the six inverters. In this way, compared with the case where lighting of the twelve illuminating elements is controlled by the same number of (twelve in this example) inverters, the number of inverters can be reduced, which permits the use of less components. Further, the reduced number of the inverters puts significantly less burden on the inverter control circuit 606.

That is, in the foregoing Third and Fourth Embodiments, a single inverter lights one illuminating element. As described already, this structure requires twelve illuminating element groups when the number of illuminating elements is twelve, and accordingly requires twelve inverters. In contrast, in the present embodiment, there are provided a plurality of illuminating elements in each illuminating element group, and a plurality of illuminating elements are switched ON by a single inverter. Thus, compared with the Third and Fourth Embodiments, given the same number of illuminating elements, the number of illuminating element groups can be reduced, and accordingly the number of inverters can also be reduced. As a result, it is possible to suppress increase in production cost or increase in number of components associated with the members for parting the illuminating element groups, or the inverters and their associate members.

In principle, in view of display characteristics of a moving image display, it is more advantageous to increase the number of illuminating element groups. By varying the number of illuminating element groups, it was found that the display characteristics can be greatly improved when the number of illuminating element groups is preferably four or greater when the ON time is not more than ½ frame time. Further, the display characteristics further improved when the number of illuminating element groups was preferably six or greater under the same condition.

Therefore, by providing a plurality of illuminating elements for a single illuminating element group, it is possible to adjust brightness, i.e., luminance of the liquid crystal display device, without increasing the number of components or the burden put on circuits, and without losing performance of displaying moving images.

Note that, even though FIG. 35(*a*) and FIG. 35(*b*) employs the partition structure provided with the partition walls (partition member) 614 as shown in FIG. 30, it is also possible to adopt other partition structures, for example, such as those shown in FIG. 31 through FIG. 34.

Note that, the present invention is not just limited to liquid crystal display devices, but is applicable to any structure which carries out image display by a display element (shutter or reflector) having a shutter function for controlling (modulating) transmittance or reflectance of light, and an illuminating section (light source such as the cold cathode tube). Examples of such a display element having the shutter function include, for example:

(1) Structures which show birefringence by an external field (liquid crystal shows birefringence by an electric field), examples of which include a magnetic optical element (by a magnetic field), a Pockels cell (by an electric field, such as a Pockels shutter), and a Kerr cell (by electric field, such as a Kerr shutter).

(2) Structures which show a change in reflectance or color by an external field, examples of which include an electrochromism element, which shows a change in color (reflected color), for example, by a redox reaction induced by a current, and a photochromic element, which shows a change in transmittance by laser light and the like.

(3) Mechanical shutters or reflectors, examples of which include a micro machine, for example, such as a mechanical micro shutter, which is provided with a micro mechanical element for each pixel.

Note that, the image display device according to the present invention may have an arrangement including a display section having a plurality of signal lines and a plurality of scanning lines which are provided orthogonal to each other, and a signal line driver circuit for applying display data to each signal line and a scanning line driver circuit for scanning each scanning line; and an illuminating section for illuminating the display section, wherein the illuminating section includes a plurality of emitting areas in a scanning direction, and the plurality of emitting areas are successively scanned in synchronism with a vertical synchronize signal of the image display device for lighting (flashing), and partition walls are provided between the emitting areas.

Further, the image display device according to the present invention may have an arrangement including a display section having a plurality of signal lines and a plurality of scanning lines which are provided orthogonal to each other, and a signal line driver circuit for applying display data to each signal line and a scanning line driver circuit for scanning each scanning line; and an illuminating section for illuminating the display section, wherein the illuminating section includes a plurality of emitting areas in a scanning direction, and the plurality of emitting areas are successively scanned in synchronism with a vertical synchronize signal of the image display device for lighting (flashing), and the reflecting plate of the illumination device is provided in the form of a concave shape.

Further, the image display device according to the present invention, in the foregoing arrangements, may include a partition wall having a thickness not more than the width of the shielding section of the image panel.

Further, the image display device according to the present invention, in the foregoing arrangements, may include a partition wall whose cross section is essentially in the form of an isosceles triangle.

Further, the image display device according to the present invention, in the foregoing arrangements, may include a partition wall whose cross section is essentially in the form of a semi-circle.

Further, the image display device according to the present invention, in the foregoing arrangements, may include a partition wall whose cross section is essentially parabolic.

Further, the image display device according to the present invention, in the foregoing arrangements, may include the reflecting plate of the concave shape whose cross section is essentially in the form of an isosceles triangle.

Further, the image display device according to the present invention, in the foregoing arrangements, may include the reflecting plate of the concave shape whose cross section is essentially in the form of a semi-circle.

Further, the image display device according to the present invention, in the foregoing arrangements, may include the reflecting plate of the concave shape whose cross section is essentially parabolic.

[Sixth Embodiment]

The following will describe yet another embodiment of the present invention with reference to FIG. 37 through FIG. 41.

Figure 37:
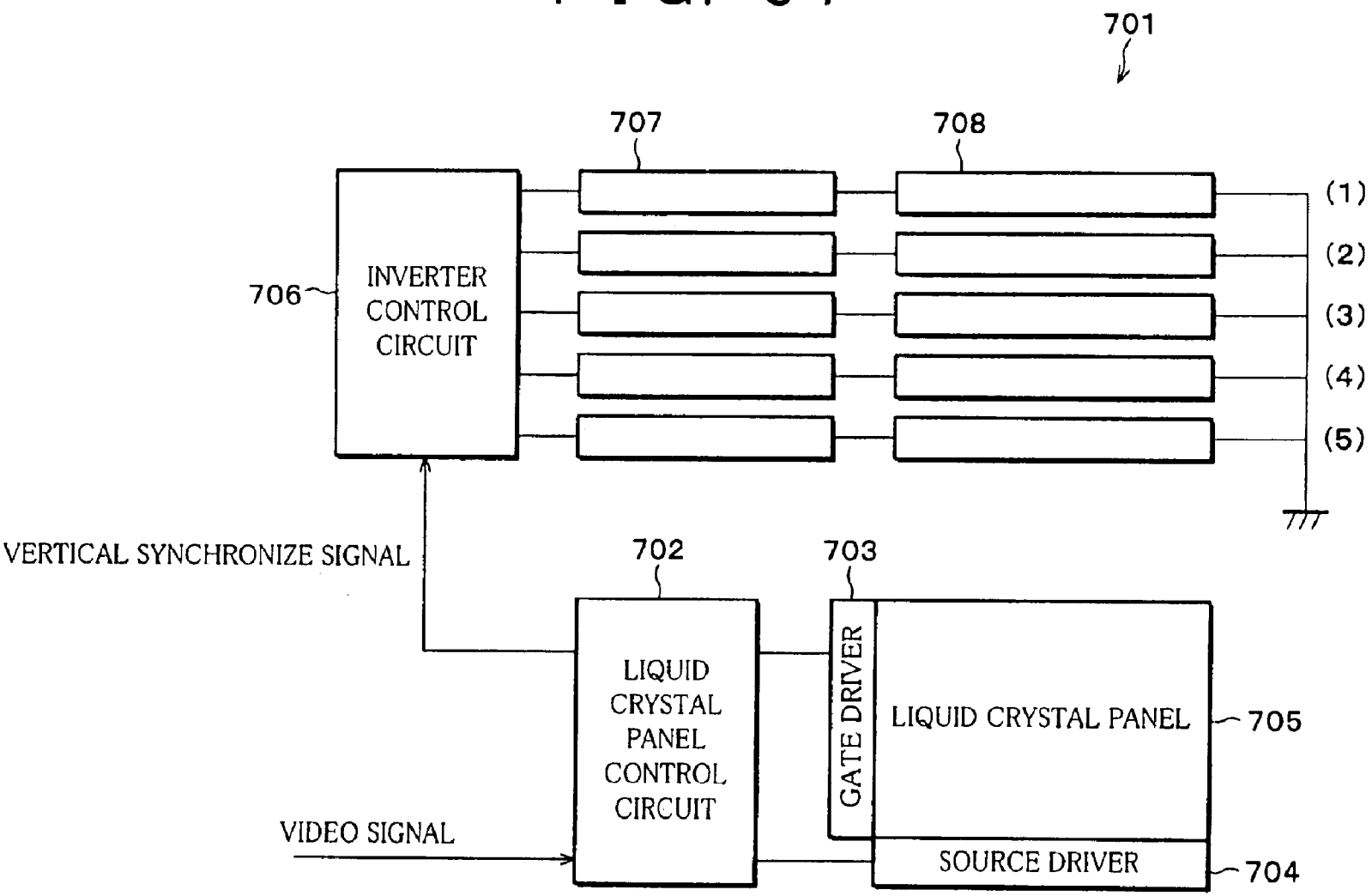
FIG. 37 is a block diagram showing an exemplified structure of an image display device according to the present invention.

As shown in FIG. 37, a liquid crystal display device 701 as an image display device according to the present embodiment adopts, for example, an active-matrix mode with TFTs (thin film transistors) of 640×480 dots. A liquid crystal panel (display section) 705 as an image panel includes liquid crystal display elements (pixels) (not shown), which are a plurality of display elements making up a screen, for modulating a light transmission state of a liquid crystal according to image data which are applied while being scanned. The liquid crystal display elements seal, for example, a twist-nematic liquid crystal therein. The liquid crystal panel 705 includes a gate driver 703 for driving scanning lines in the liquid crystal panel 705, and a source driver 704 for driving signal lines. The liquid crystal display device 701 includes a liquid crystal panel control circuit 702 which receives video signals. The video signals from the liquid crystal control circuit 702 are supplied to the liquid crystal panel 705 via the gate driver 703 and the source driver 704, so as to supply the video signals to the liquid crystal display elements. That is, the pixels receive signal voltages of the video signals at the corresponding signal lines at the timings of applied scanning pulses to the corresponding scanning lines.

Further, there is provided an inverter control circuit 706 as a lighting control circuit, which is connected to the liquid crystal panel control circuit 702 so as to receive a vertical synchronize signal of the liquid crystal display panel 701 therefrom. Further, a plurality of (there are five in this example) inverters 707 are provided for lighting and driving purposes. The inverters 707 receive driving signals from the inverter control circuit 706, so as to apply signals of a predetermined high frequency and a high voltage to a plurality of (there are five in this example) cold cathode tubes (illuminating elements) 708, which are emitters. The cold cathode tubes 708 are numbered 1 to 5 from the scanning starting position, and the corresponding inverters connected thereto will be called inverters (1) to (5). The inverter control circuit 706 outputs an inverter input signal to each of the five inverters 707, and the five inverters 707 drive their respective cold cathode tubes 708 according to the inverter input signals for lighting. The inverter control circuit 706, the inverters 707, and the cold cathode tubes 708 make up an illuminating section.

The cold cathode tubes 708 make up an emitting area as a back-light for illuminating the liquid crystal display elements of the liquid crystal panel 705 from the back, and the light intensity of the cold cathode tubes 708 becomes the luminance of the illuminating section. There are provided five cold cathode tubes 708 and five inverters 707. The five cold cathode tubes 708 are disposed parallel to the scanning lines in the lengthwise direction with equal intervals in the signal line direction (vertical scanning direction).

Figure 40:
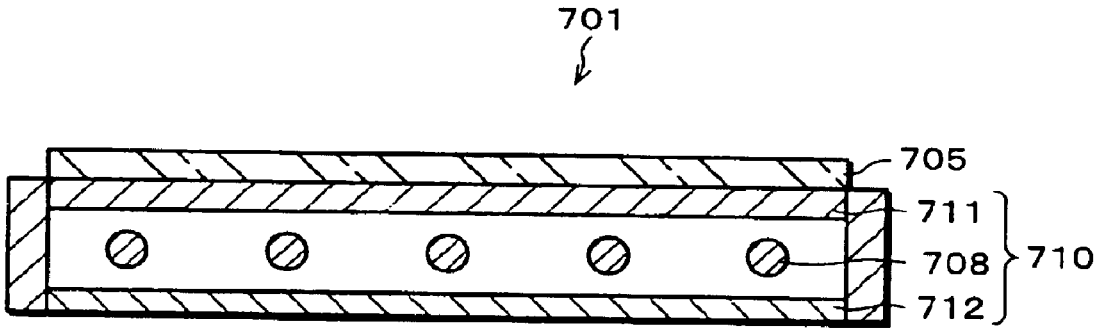
FIG. 40 is a cross sectional view showing an exemplified structure of the image display device according to the present invention.

As shown in FIG. 40, the liquid crystal display device 701 has a combined structure of the liquid crystal panel 705 and a back-light section 710. The back-light section 710 is an illumination device of a direct type which includes a diffusing plate 711 on the side facing the liquid crystal panel 705, and a reflecting plate 712 on the other side, and the cold cathode tubes 708 which are disposed therebetween. Note that, FIG. 40 omits the liquid crystal control circuit 702, the gate driver 703, the source driver 704, the inverter control circuit 706, and the inverters 707.

As described, there are provided five cold cathode tubes 708. Therefore, in the elements of 640×480 dots, a single cold cathode tube 708 corresponds to 96 scanning lines. That is, the first cold cathode tube 708 illuminates pixels which correspond to the first through 96th scanning lines, and the second cold cathode tube 708 illuminates pixels which correspond to the 97th through 192nd scanning lines, and so on. That is, when the number of cold cathode tubes 708 is M, and the number of scanning lines, i.e., the number of pixels in the scanning line direction is N, an nth cold cathode tube 708 illuminates pixels which correspond to $\{(n-1)\cdot(N/M)+1\}$th through $\{n\cdot(N/M)\}$th scanning lines. Note that, the number of scanning lines is not particularly limited as long as it can effectively relieve lowering of image quality such as a streaking phenomenon in a fast-moving image, which will be mentioned later.

Here, the liquid crystal display elements having the same scanning time are grouped into a display element band. That is, in this example, a single display element band is composed of 640 liquid crystal display elements which correspond to a single scanning line. The display element band is further grouped into display element groups in the order of scanning time and to include at least one display element band in one group. That is, in this example, 640×96 liquid crystal display elements, corresponding to adjacent 96 scanning lines, make up a single display element group, which grouping is made in the order of scanning time.

Figure 38:
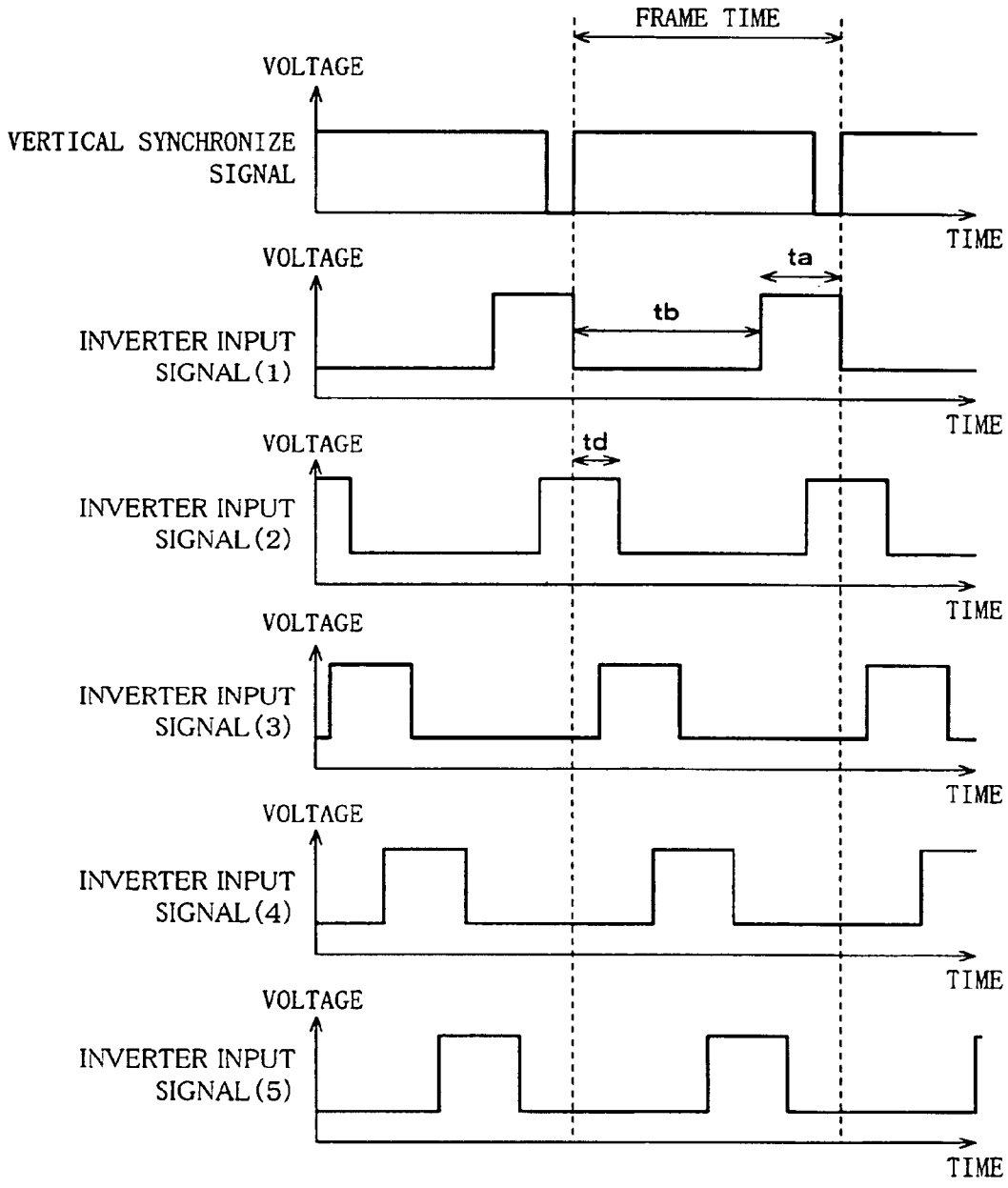
FIG. 38 is a timing chart showing a vertical synchronize signal and inverter input signals.
Figure 39:
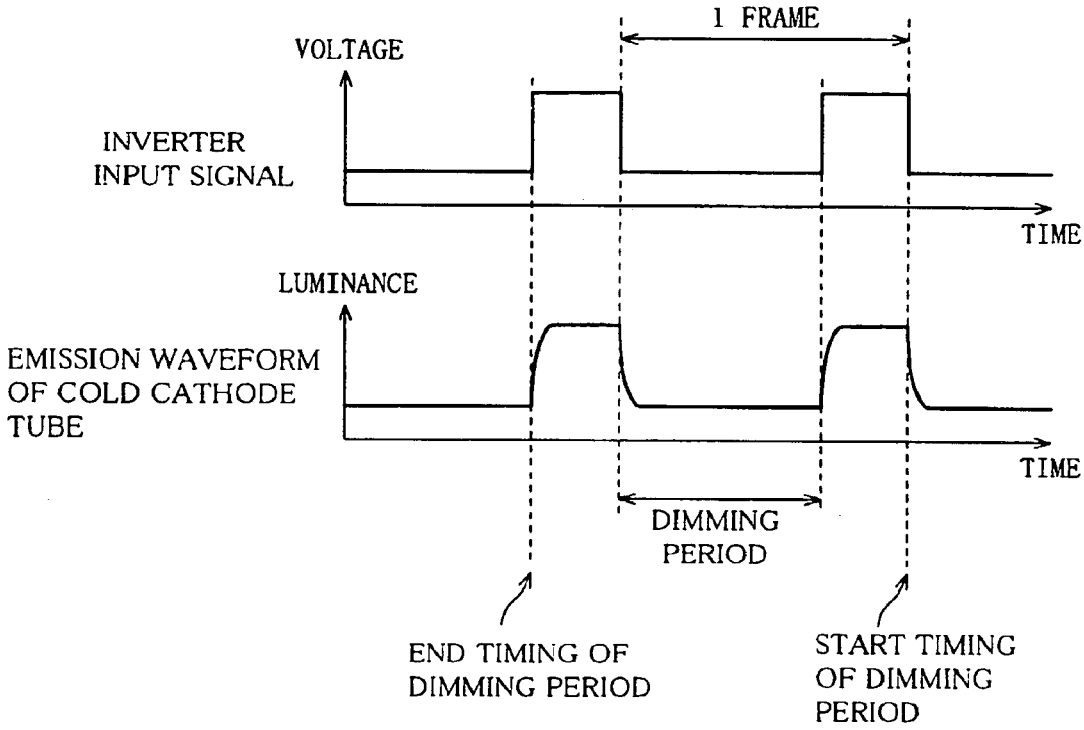
FIG. 39 is a timing chart showing an inverter input signal and an emission waveform of a cold cathode tube.

FIG. 38 shows a waveform of the vertical synchronize signal inputted into the inverter control circuit 706, and waveforms of inverter input signals (1) to (5) as the driving signals outputted to the inverters (1) through (5). The inverter input signals (1) to (5) are signals which are respectively inputted into the inverters (1) through (5) as shown in FIG. 37. Further, FIG. 39 shows a waveform of emission of an arbitrary cold cathode tube 708 and a waveform of an inverter input signal which is inputted into the corresponding inverter 707 to drive the cold cathode tube 708. As shown, the emitters are successively scanned for lighting (flashing) or dimming in synchronism with the vertical synchronize signal, in response to the inverter input signals as shown in FIG. 38. The operation of successive scanning for dimming according to the vertical synchronize signal refers to the operation of successively shifting (scanning) the emitter to be dimmed among emitters which are selected according to the display elements which are scanned one after another, by the repeating operation of the selected emitter, which is dimmed at least in a part of its selected period, and upon becoming a non-selected state by the selection of the next emitter after the selected period, returns to a lighted state at least in a part of the non-selected period.

The inverter control circuit 706 includes a counter and a shift register (both not shown). The counter receives a horizontal synchronize signal, and the shift register receives a vertical synchronize signal. The pulse width, i.e., the duty ratio of each inverter input signal is decided by counting (dividing) the horizontal synchronize signal by the counter. By the shift register, the inverter input signal (1) is outputted to the corresponding inverter (1) of the inverter 707 in synchronism with the vertical synchronize signal (rising timing). Then, in order to shift the dimming start times of the cold cathode tubes 708 (to be described later), the inverter input signals (2) through (5) are successively outputted by the shift register to their corresponding inverters 707 at the timings of predetermined inverter control clocks (not shown), which are provided to decide the degree of off-phase of the inverter input signals. The five cold cathode tubes 708 enter a dimming period periodically in one frame period, one after another at different timings, and therefore the phases are shifted by a frame time/the number of cold cathode tubes.

In the present embodiment, the inverter input signals of adjacent inverters in the inverter input signals (1) through (5) are set so that their lighting periods, i.e., high voltage periods overlap. However, not limiting to this, the high voltage period of a certain inverter input signal may be started at the timing when dimming of a preceding inverter input signal is started, i.e., when the signal becomes low voltage. Further, the high voltage signal of a certain inverter input signal may be started short while after the dimming period of a preceding inverter input signal is started. The pulse width of each inverter input signal can be arbitrarily set by deciding, at the time of manufacture or use, the counts of the horizontal synchronize signal. Further, the degree of phase deviation of the inverter input signals can be arbitrarily set, at the time of manufacture or use, by adjusting the inverter control clock.

Here, the period of high voltage level is ta, and the period of low voltage level is tb. When one frame period is f, ta+tb=f. The driving signal outputted by the inverter control circuit 706 to each inverter 707 is set so that it becomes low voltage level (3 V) at the time when the area illuminated by the cold cathode tube 708 is scanned. Further, here, the driving signal is set to become high voltage level (9V) after the elapsed time tb (e.g., ½ frame period) from the time when it became low voltage level, and the high voltage level is maintained for ta (e.g., ½ frame period (f−tb). The cold cathode tube 708, as shown in FIG. 39, is lit brightly at its normal luminance (first luminance) when the inverter input signal becomes high voltage level according to the driving signal and the dimming period ends. Conversely, the dimming period starts when the inverter input signal becomes low voltage level, and the cold cathode tube 708 is dimmed from its normal level, and is lit at predetermined luminance (second luminance) which is brighter than the OFF state. A dimming period is the period between the dimming start timing and the dimming end timing.

By this system of driving, the five cold cathode tubes 708 are scanned as they are successively dimmed. That is, as shown in FIG. 38, within one frame period, the inverter input signal (1) first becomes low voltage level at the timing of the vertical synchronize signal, and the first cold cathode tube 708, i.e., the cold cathode tube (1) enters the dimming period. After a predetermined time period, i.e., after the elapsed time (tb) which corresponds to the degree of phase deviation between the inverter input signals (1) and (2), the inverter input signal (2) becomes low voltage level and the second cold cathode tube 708, i.e., the cold cathode tube (2) enters the dimming period. The same process is repeated thereafter.

Therefore, in this example, in a scanning period of a pixel, the cold cathode tube illuminating this pixel is in a dim state, and becomes a normal ON state before the end of one frame period, at the latest, from the start of dimming (in this example, after the elapsed time tb (e.g., after ½ frame period)).

Observing a fast-moving image on the liquid crystal display device using the cold cathode tubes 708, the liquid crystal display device using the cold cathode tube 708 produced a superior image far clearer than those produced by conventional liquid crystal display devices.

As described, in the present embodiment, there are provided cold cathode tubes, which are a plurality of emitting areas in the scanning direction, and the plurality of emitting areas are successively scanned at predetermined luminance and timing in synchronism with the vertical synchronize signal of the liquid crystal display device to effect dimming and lighting (flashing). In doing so, the phases of timings at which the cold cathode tubes 708 emit light are shifted according to the scanning timings of the display element groups illuminated by the respective cold cathode tubes 708. As a result, it is possible to obtain a liquid crystal display device with desirable display quality, while suppressing shortening of life of emitters and the detrimental effect to luminance of a display.

Here, for example, the time ratio (duty ratio) of luminance may be varied or the same between display element groups. Further, for example, the groups of display elements may be shifted one after another in the order of scanning the display elements, so that the change timing of the illuminating elements becomes earlier or later for a predetermined period. Further, the degree of timing deviation may be the same or varied among all the display element groups.

Further, in this example, dimming proceeds continuously from the beginning to the end of its period, and there are one dimming period and one non-dimming period before the end of a period, which corresponds in length to one frame period, from the time the dimming started. Further, for example, the luminance may be varied once or more before the end of a period, which corresponds in length to one frame period, from the time when the luminance was varied. For example, the luminance may be varied once to the first luminance (normal ON state) before the end of a period, which corresponds in length to one frame period, from the time when the second luminance (dim state) started, or may be varied again to the second luminance after once varied to the first luminance, or varied again to the second luminance after once varied to the first luminance, and to return to the first luminance.

Thereafter, the luminance level of the dim state is varied. The luminance level of the dim state can be controlled by adjusting the low voltage level of the driving signal outputted to each inverter 707 from the inverter control circuit 706. By thus setting the luminance level of the dim state to be not more than 9/10 of the 100% luminance level in the ON state, deterioration of image quality such as streaking can be effectively suppressed even in fast-moving images, and a superior image quality was obtained. Further, by setting the luminance level of the dim state to be not less than 1/10 of the 100% luminance level in the ON state, lowering of display quality was suppressed further effectively, and the rate of degradation of the cold cathode tube 708 could be slowed more.

Then, improvement in display quality at various dimming periods was examined. The results are shown in FIG. 41. FIG. 41 shows the dimming period starting timing and the dimming period ending timing in the unit of frame time (f), where the time when scanning of each emitting area is started is the reference point (time=0). Note that, in FIG. 41, where the dimming period starting timing is lager (later) than the dimming period ending timing, the dimming period is ended at the corresponding timing (dimming period ending timing) of the next frame. The time of starting scanning of each emitting area is when scanning of a display element band ("A") having the earliest scanning time in the corresponding display element group of each emitting area is started. Further, indicated by various symbols in FIG. 41 are display qualities as a result of comparison with a conventional structure in which emitters are not scanned but emit light constantly, wherein "◎" indicates large improvement in display quality from the conventional structure, "○" indicates improvement in display quality from the conventional structure, "Δ" indicates slight improvement in display quality from the conventional structure, and "X" indicates display failure. These classifications were used to conduct an experiment on 10 subjects for evaluation, using different timing combinations. The evaluated image was a fast-moving image, including images in a TV sports program (images including fast movement of players or a ball, as in tennis, volley ball, or base ball), or the scrolling image of staffs and casts which is displayed at the end of a TV program, to see if there is any improvement in display quality by checking for such a phenomenon as streaking.

It can be seen from the results of FIG. 41 that the display quality changes by the way the dimming period, or the dimming starting timing or dimming ending timing is set. Further, it can also be seen from the results that display quality is improved greatly in particular when the response time of the liquid crystal of the pixels in the emitting area substantially coincides with the dimming period.

It became clear from the foregoing detailed experiment that in order to obtain superior effects, the following conditions are preferably employed.

(1) the luminance of the dim state is not less than 1/10 and not more than 9/10 of the 100% luminance of the ON state.

(2) the dimming period is not less than 1/10 and not more than 9/10 of one frame period.

(3) at least 1/10 of one frame period immediately after the reference point at which the display section of the emitting area is scanned makes up a period of dim state in this emitting area. Further preferably, at least 5/10 of one frame period immediately after the reference point at which the display section of the emitting area is scanned makes up a period of dim state in this emitting area.

(4) More preferably, in a period after scanning of the display section corresponding to the emitting area and until the response of the liquid crystal of the pixels therein is substantially complete, the dim state is maintained at least for this emitting area. Under these conditions, there is no shortening of life of the emitters, and the detrimental effect to luminance can be suppressed further effectively, thus obtaining further superior display quality. The foregoing driving method is particularly effective in display of fast-moving images. That is, by the function which allows the adjustment of luminance and timing in response to such moving images, it is possible to provide a liquid crystal display device with desirable display quality even in display of fast-moving images, while effectively suppressing shortening of life and display luminance of the emitters.

Further, when the dimming period ending timing is (1/10)·f, the period between (9/10)·f and (1/10)·f is dimmed throughout. Also, when the dimming period ending timing is (2/10)·f, the period between (1/10)·f and (2/10)·f is dimmed throughout. Further, as can be seen from FIG. 41, when the dimming period ending timing is (1/10)·f or (2/10)·f, improvement in display quality is observed regardless of the dimming period starting timing. This imposes less restrictions in deciding dimming period starting timing, thus increasing the degree of freedom in designing of the liquid crystal display device.

Further, when the dimming period starting timing is (9/10)·f, the period between (9/10)·f and (1/10)·f is dimmed throughout. Also, when the dimming period starting timing is (1/10)·f, the period between (9/10)·f and (1/10)·f is switched ON (non-dim state) normally throughout, and the period from (1/10)·f and (2/10)·f are dimmed throughout. Further, as can be seen from FIG. 41, improvement in display quality is observed when the dimming period starting timing is (9/10)·f or (1/10)·f, regardless of the dimming period ending timing. This imposes less restrictions in deciding dimming period ending timing, thus increasing the degree of freedom in designing of the liquid crystal display device.

Further, the foregoing explained the case where the fast-moving images were selected for evaluation; however, in actual broadcasted images, a moving image and a still image coexist. Thus, the liquid crystal display device may be adapted to have a mechanism for detecting the speed of moving images, so as to automatically adjust the dimming period and luminance of the illuminating section. More specifically, as the speed of moving images is increased, the luminance of the dim state is lowered and the dimming period is increased. On the other hand, when the image includes is a still image, no dim state is provided. This improves display quality and suppresses shortening of life of the cold cathode tubes 708 (emitters) even more efficiently. That is, no dim state is provided for the still image. In this way, the light will not be switched OFF nor will it be dimmed, thus further suppressing shortening of life of the cold cathode tubes 708. Further, the same effect can be obtained by allowing the user to externally adjust the dimming period and luminance of the illuminating section as he/she desires, instead of providing the image detecting mechanism.

Note that, the present invention is not just limited to liquid crystal display devices, but is applicable to any structure which carries out image display by a display element (shutter or reflector) having a shutter function for controlling (modulating) transmittance or reflectance of light, and an illuminating section (light source such as the cold cathode tube). Examples of such a display element having the shutter function include, for example:

(1) Structures which show birefringence by an external field (liquid crystal shows birefringence by an electric field), examples of which include a magnetic optical element (by a magnetic field), a Pockels cell (by an electric field, such as a Pockels shutter), and a Kerr cell (by electric field, such as a Kerr shutter).

(2) Structures which show a change in reflectance or color by an external field, examples of which include an electrochromism element, which shows a change in color (reflected color), for example, by a redox reaction induced by a current, and a photochromic element, which shows a change in transmittance by laser light and the like.

(3) Mechanical shutters or reflectors, examples of which include a micro machine, for example, such as a mechanical micro shutter, which is provided with a micro mechanical element for each pixel.

The foregoing explanation of the present embodiment is based on the case of a video signal of the interlace driving mode. However, the present invention is not just limited to this and can also be realized with a video signal of the non-interlace driving mode. In the interlace driving mode, one field corresponds to one vertical period, whereas one frame corresponds to one vertical period in the non-interlace driving mode.

Note that, the image display device according to the present invention may have an arrangement including: a display section having a plurality of signal lines and a plurality of scanning lines which are disposed orthogonal to each other, and a signal line driver circuit for applying display data to each of the signal lines and a scanning line driver circuit for scanning each of the scanning line; and an illuminating section for illuminating the display section, wherein the illuminating section includes a plurality of emitting areas in a scanning direction, and the plurality of emitting areas are successively scanned for dimming in synchronism with a vertical horizontal signal of the image display device.

Further, the image display device according to the present invention having the foregoing structure may be arranged so that the luminance of the dim state is not less than 1/10 and not more than 9/10 of the luminance of the 100% luminance of the ON state.

Further, the image display device according to the present invention having the foregoing structure may be arranged so that the dimming period is not less than 1/10 and not more than 9/10 of one frame period.

Further, the image display device according to the present invention having the foregoing structure may be arranged so that at least 1/10 of one frame period immediately after the reference time at which the display section corresponding to the emitting area is scanned makes up a period of dim state in this emitting area.

Further, the image display device according to the present invention having the foregoing structure may be arranged so that at least 5/10 of one frame period immediately after the reference time at which the display section corresponding to the emitting area is scanned makes up a period of dim state in this emitting area.

Further, the image display device according to the present invention having the foregoing structure may be arranged so that in a period after scanning of the display section corresponding to the emitting area and until the response of the liquid crystal of the pixels therein is substantially complete, the dim state is maintained at least for this emitting area. For example, in a structure where the illuminating section includes a plurality of illuminating elements as the emitting area, in a period after scanning of the emitting area, i.e., the display elements to be illuminated by the illuminating element, and until the response is the display element, i.e., a change according to the image data of a transmissive state or reflected state of the light is substantially complete in each illuminating element, at least this emitting area is lit in the dim state as the second luminance.

Further, the image display device according to the present invention having the foregoing structure may be arranged so that the luminance of the dim state can be externally adjusted arbitrarily.

Further, the image display device according to the present invention having the foregoing structure may be arranged so that the luminance of the dim state is varied by the speed of a moving image included in the video signal.

Further, the image display device according to the present invention having the foregoing arrangement may be arranged so that the duration and timing of the dimming period can be externally varied arbitrarily.

Further, the image display device according to the present invention having the foregoing arrangement may be arranged so that the duration and timing of the dimming period is varied by the speed of a moving image included in the video signal.

The emitters of the present embodiment are preferably cold cathode tubes, emitting diodes, electroluminescence, hot cathode tubes, mercury lamps, halogen lamps, or lasers.

[Seventh Embodiment]

The following will describe yet another embodiment of the present invention referring to FIG. 42 through FIG. 45.

Figure 42:
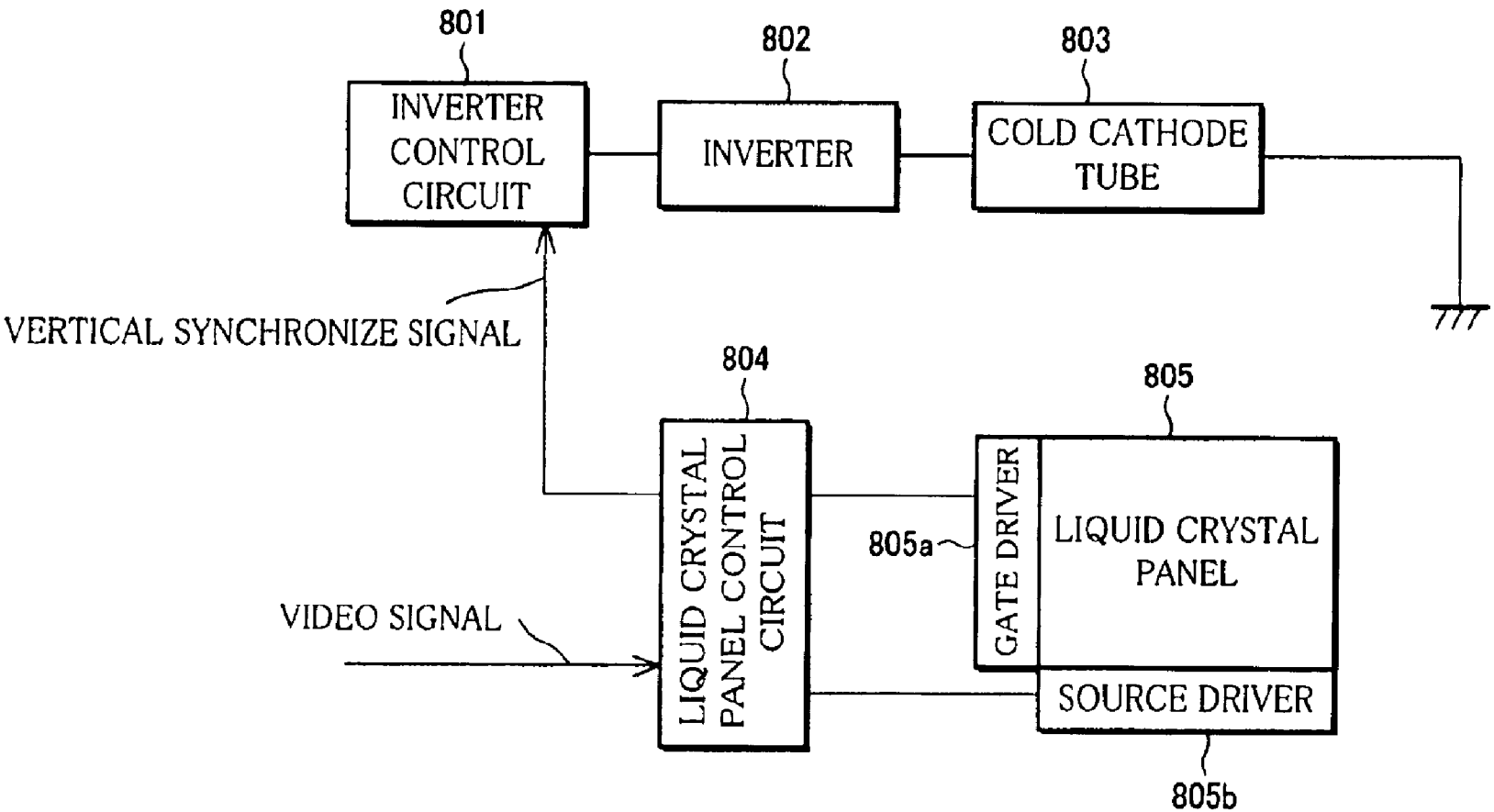
FIG. 42 is an explanatory drawing showing an exemplified structure of a liquid crystal display device of the present invention.

A liquid crystal display device (active-matrix liquid crystal display device) according to the present embodiment chiefly includes, as shown in FIG. 42, an inverter control circuit 811, an inverter 802, a cold cathode tube 803 (emitter), a liquid crystal panel control circuit 804, and a liquid crystal panel 805. The inverter control circuit 801, the inverter 802, the cold cathode tube (emitter) 803, and the liquid crystal panel control circuit 804 make up an illumination device.

The inverter control circuit 801 receives a vertical synchronize signal which is outputted from the liquid crystal panel control circuit 804, and outputs an inverter driving signal for driving the inverter 802 to the inverter 802. The inverter 802 applies to the cold cathode tube 803 (white cold cathode tube) a high voltage whose frequency is varied according to the inverter driving signal. The cold cathode tube 803, upon receiving the high voltage, emits light to shine the liquid crystal panel 805. Here, the cold cathode tube 803 makes up an illuminating section for illuminating the liquid crystal panel 805 with light.

The liquid crystal panel control circuit 804, upon input of a video signal, separates synchronize signals, of which the vertical synchronize signal is sent to the inverter control circuit 801 as described above. Further, a gate driver 805*a* and a source driver 805*b* for driving scanning lines and signal lines (both not shown) are driven based on the video signal to select desired pixels (not shown), such that the light emitted by the cold cathode tube 803 travels through the selected pixels to display the video signal.

Figure 43:
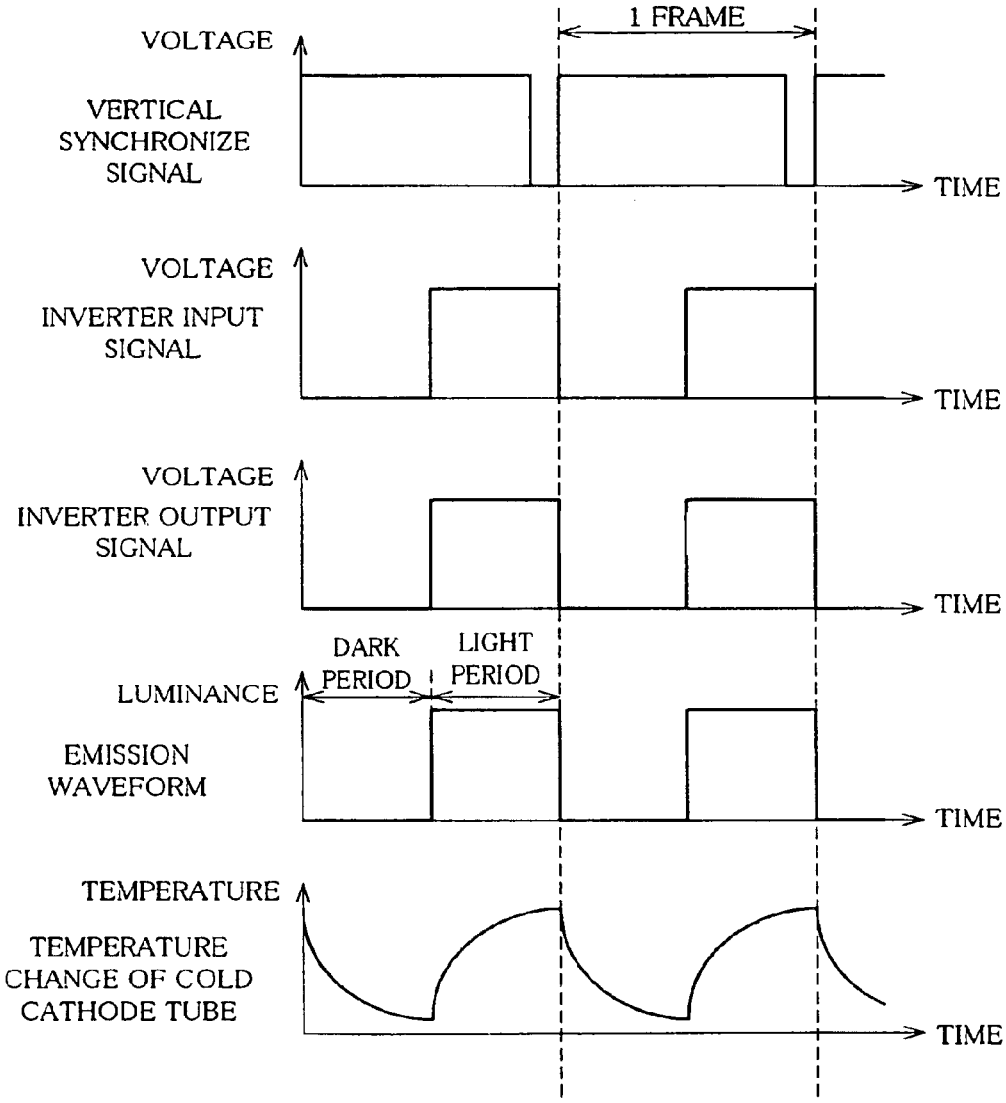
FIG. 43 is a waveform diagram showing examples of applied signal waveforms, explaining operations of the liquid crystal display device, and an emission waveform and temperature change of an emitter with the applied signal waveforms.
Figure 44:
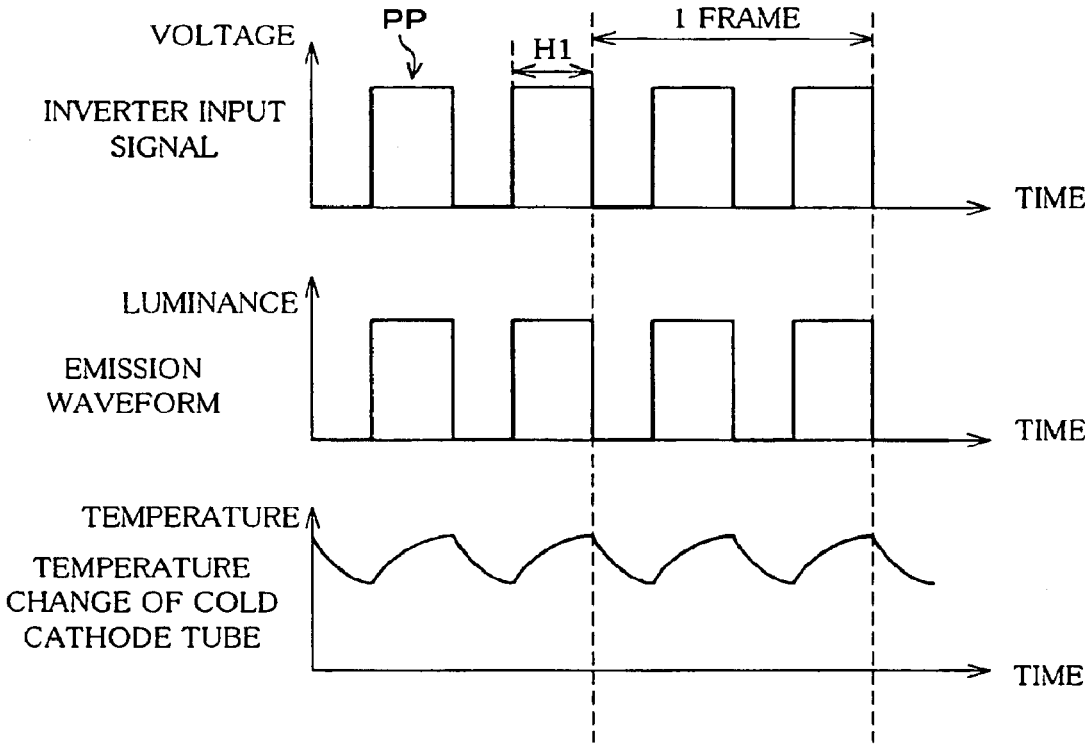
FIG. 44 is a waveform diagram showing another examples of applied signal waveforms, explaining operations of the liquid crystal display device, and an emission waveform and temperature change of an emitter with the applied signal waveforms.

The following describes the case where the main signals of the liquid crystal display device (vertical synchronize signal, inverter input signal (inverter driving signal), inverter output signal, and emission waveform) have waveforms as shown in FIG. 43.

In this case, by providing an OFF period (period of reduced luminance) per one frame, a viewer would see only a moment of high contrast as a persistent image, which is perceived as a clear image with good contrast, thus improving display quality of fast-moving images in particular.

However, by the driving as shown in FIG. 43, the temperature of the cold cathode tube 803 changed by the period of one frame, as indicated by the temperature change of the cold cathode tube on the bottom of FIG. 43. Such a temperature change causes a cooling/heating cycle on the cold cathode tube 803, which shortens the life of the cold cathode tube 803, in addition to lowering temperature stability of the cold cathode tube 803 during emission and thus lowered temperature. As a result, luminance is lowered.

Figure 45:
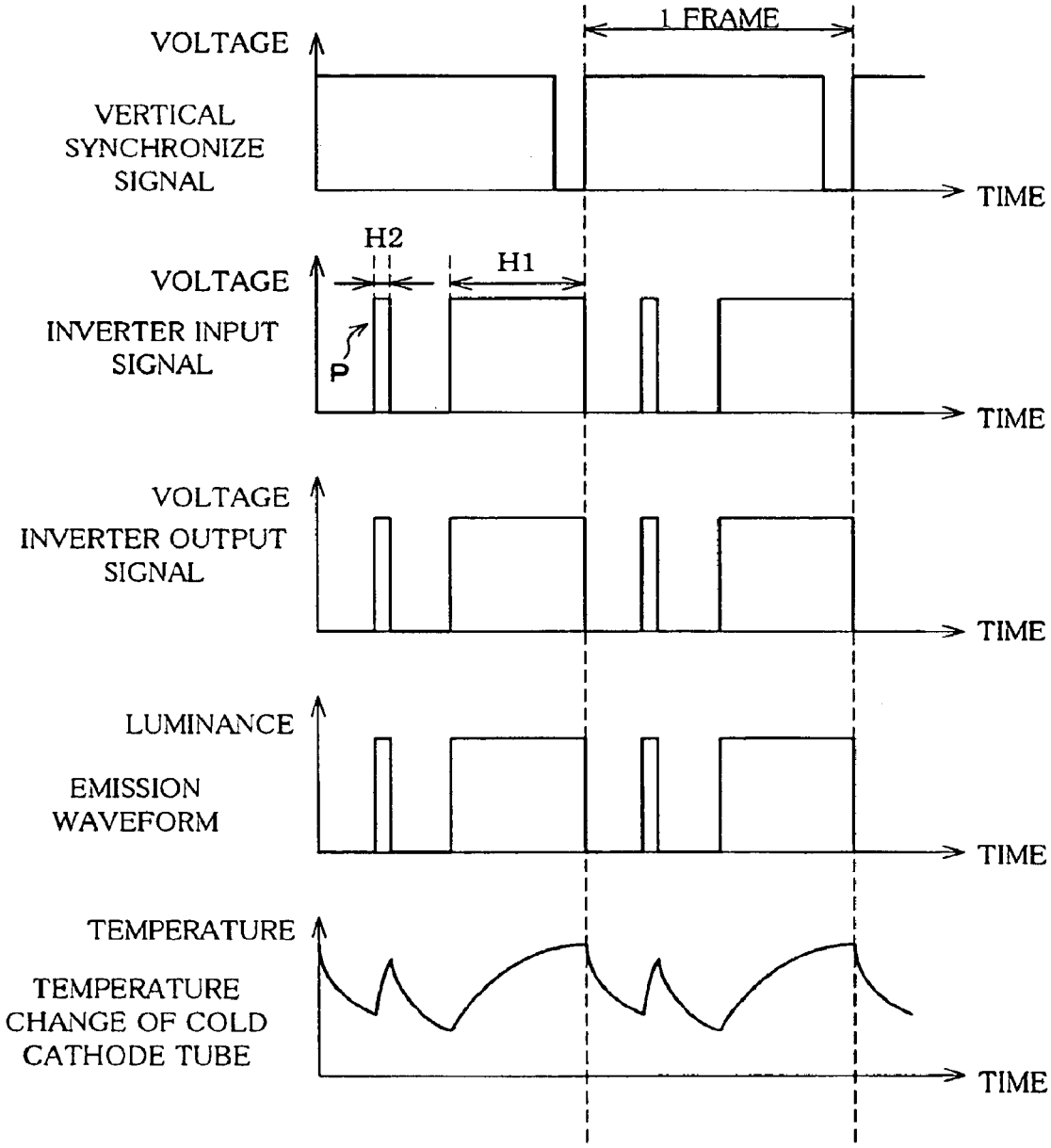
FIG. 45 is a waveform diagram showing examples of applied signal waveforms for overcoming problems caused by the signal waveforms of FIGS. 43 and 44, and an emission waveform and temperature change of an emitter with the applied signal waveforms.

Therefore, in the present embodiment, as shown in FIG. 45, the inverter control circuit 801 is adapted to incorporate a small pulse P in an OFF period of the inverter input signal (inverter driving signal), which is the OFF period of the cold cathode tube 803. The pulse width P has a time width H2 which is sufficiently shorter than a time width H1 of an ON period, which is the ON period of the cold cathode tube 803 (see inverter input signal in FIG. 45). Accordingly, the small pulse P is also incorporated in an OFF period of the inverter output signal applied to the cold cathode tube 803 from the inverter 802 (see inverter output signal in FIG. 45).

In this manner, by applying a high voltage with the small pulse P incorporated in an OFF period to the cold cathode tube 803, the cold cathode tube 803 emits light by the small pulse P during the OFF period of FIG. 43. This splits the OFF period into two, thus reducing the time width of the OFF period (see emission waveform of FIG. 45).

As a result, it is possible to reduce the extent of temperature drop of the cold cathode tube 803 during the OFF period. Further, considering a temperature change of the cold cathode tube 803 in one frame in total, because the extent of temperature drop of the cold cathode tube 803 during the OFF period can be reduced, the amplitude of temperature change in one frame can be made smaller than the case of FIG. 43 (see temperature change of cold cathode tube in FIG. 45).

As a result, it is possible to suppress lowering of luminance, which is caused by shortened life of the cold cathode tube 803 due to its temperature change, and lowered temperature stability of the cold cathode tube 803 during emission and thus lowered temperature.

Incidentally, the inverter control circuit 801 was also adapted to incorporate a pulse PP having a time width about the same as the time width H of the ON period, which is the ON period of the cold cathode tube 803, in the OFF period of the inverter input signal (inverter driving signal), which is the OFF period of the cold cathode tube 803. In this case, while it was possible to prevent shortening of life and lowering of luminance of the cold cathode tube 803 by the reduced time width which was attained by dividing the OFF period (see temperature change of cold cathode tube in FIG. 44), it was impossible to improve the performance of displaying a fast-moving image compared with the case of constant emission, because the period of luminance change became ½ frame in this case, instead of one frame (see emission waveform in FIG. 44).

It can be seen from this that, in order to improve performance of displaying a fast-moving image, the period of luminance change is required to be one frame, and the performance of displaying a fast-moving image can then be improved compared with the case of constant emission.

Thus, in the present embodiment, the time width H2 of the small pulse P is made sufficiently shorter than time width H1 of the ON period, which is the ON period of the cold cathode tube 803 (see inverter input signal and emission waveform in FIG. 45), so that the luminance of the cold cathode tube 803 changes by the period of one frame. In this way, it is possible to improve performance of displaying a fast-moving image compared with the case of constant emission, without losing a desirable display quality in a fast-moving image, which effect is obtained by the provision of an OFF period per one frame.

[Eighth Embodiment]

Figure 46:
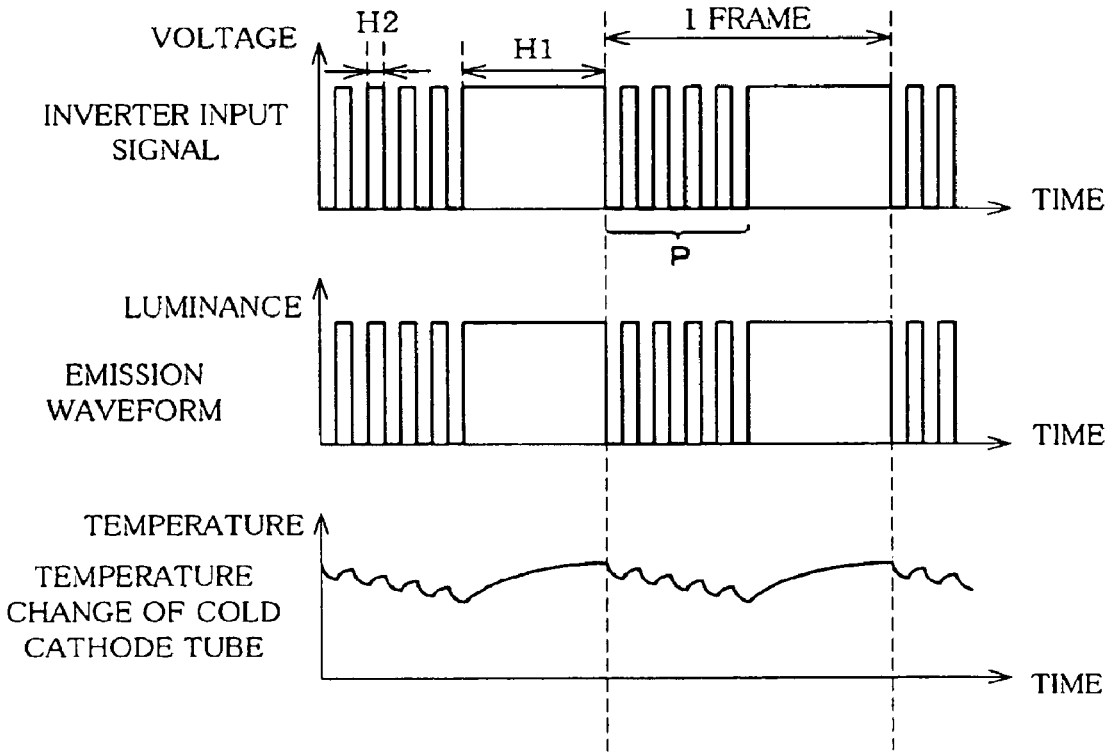
FIG. 46 is a waveform diagram showing another examples of applied signal waveforms for overcoming problems caused by the signal waveforms of FIGS. 43 and 44, and an emission waveform and temperature change of an emitter with the applied signal waveforms.

The following will describe still another embodiment of the present invention with reference to FIG. 46. Note that, elements having the same functions as those described in the drawings pertaining to the foregoing Seventh Embodiment are given the same reference numerals and explanations thereof are omitted here.

According to the present embodiment, in the liquid crystal display device of FIG. 42, the inventer control circuit 801 is adopted to incorporate four equal small pulses P in an OFF period of the inverter input signal (inverter driving signal), which is the OFF period of the cold cathode tube 803, as shown in FIG. 46. Each small pulse P has a time width H2 which is sufficiently smaller than a time width H1 of an ON period, which is the ON period of the cold cathode tube 803. Accordingly, the four small pulses P are also incorporated in the OFF period of the inverter output signal which is applied to the cold cathode tube 803 from the inverter 802.

In this manner, by applying a high voltage with the four small pulses P incorporated in an OFF period to the cold cathode tube 803, the cold cathode tube 803 emits light by the plurality small pulses P. This splits the OFF period into five, thus further reducing the time width of the OFF period (see emission waveform of FIG. 46).

As a result, it is possible to reduce the extent of temperature drop of the cold cathode tube 803 during the OFF period. Further, considering a temperature change of the cold cathode tube 803 in one frame in total, because the extent of temperature drop of the cold cathode tube 803 during the OFF period can be reduced, the amplitude of temperature change in one frame can be made smaller than the case of FIG. 43 (see temperature change of cold cathode tube in FIG. 46).

As a result, it is possible to suppress lowering of luminance, which is caused by shortened life of the cold cathode tube 803 due to its temperature change, and lowered temperature stability of the cold cathode tube 803 during emission and thus lowered temperature.

Further, in the present embodiment, even though four small pulses are incorporated in the OFF period of the inverter input signal, because the time width H2 of each small pulse P is made sufficiently shorter than time width H1 of the ON period, which is the ON period of the cold cathode tube 803 (see inverter input signal and emission waveform in FIG. 46), so that the luminance of the cold cathode tube 803 changes by the period of one frame, it is possible to improve performance of displaying a fast-moving image compared with the case of constant emission, without losing a desirable display quality in a fast-moving image, which effect is obtained by the provision of an OFF period per one frame.

[Ninth Embodiment]

Figure 47:
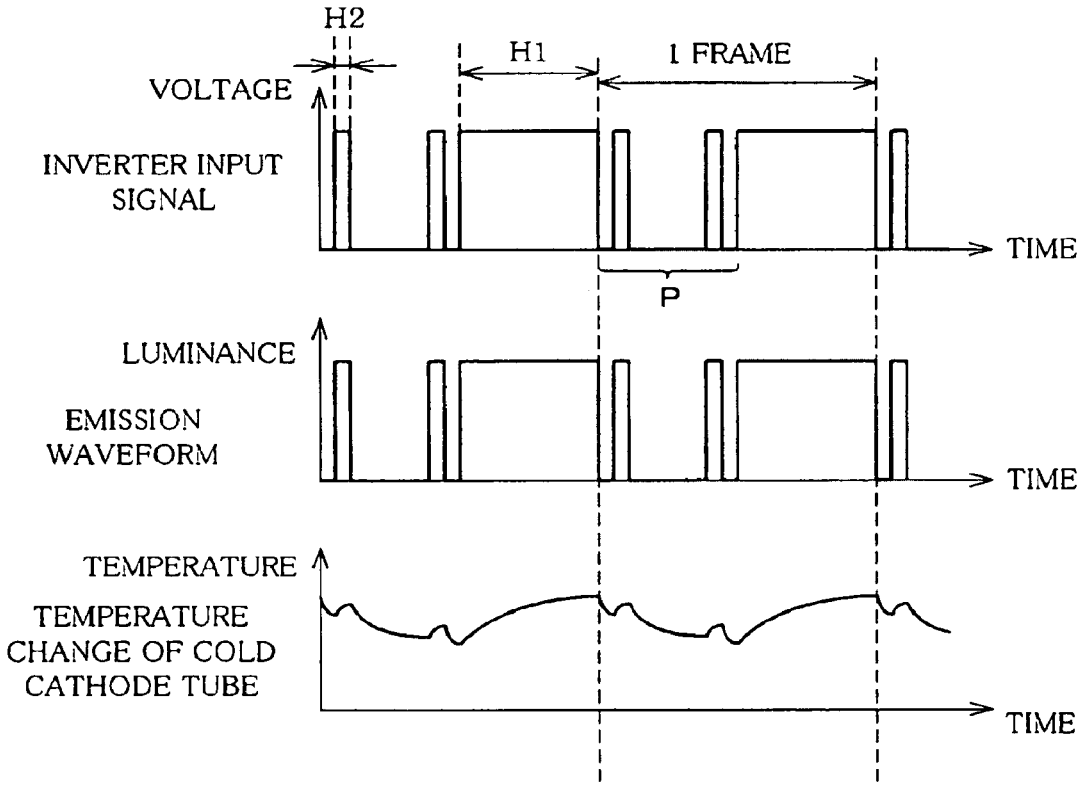
FIG. 47 is a waveform diagram showing yet another examples of applied signal waveforms for overcoming problems caused by the signal waveforms of FIGS. 43 and 44, and an emission waveform and temperature change of an emitter with the applied signal waveforms.

The following will describe yet another embodiment of the present invention with reference to FIG. 47. Note that, elements having the same functions as those described in the drawings pertaining to the foregoing Seventh Embodiment are given the same reference numerals and explanations thereof are omitted here.

According to the present embodiment, in the liquid crystal display device of FIG. 42, the inventer control circuit 801 is adopted to incorporate two small pulses P at the beginning and end of the OFF period in an OFF period of the inverter input signal (inverter driving signal), which is the OFF period of the cold cathode tube 803, as shown in FIG. 47. Each small pulse P has a time width H2 which is sufficiently smaller than a time width H1 of an ON period, which is the ON period of the cold cathode tube 803. Accordingly, the two small pulses P are also incorporated in the OFF period of the inverter output signal which is applied to the cold cathode tube 803 from the inverter 802.

In this manner, by applying a high voltage with the two small pulses P incorporated in an OFF period to the cold cathode tube 803, the cold cathode tube 803 emits light by the plurality small pulses P. This splits the OFF period into three, thus further reducing the time width of the OFF period (see emission waveform of FIG. 47).

As a result, it is possible to reduce the extent of temperature drop of the cold cathode tube 803 during the OFF period. Further, considering a temperature change of the cold cathode tube 803 in one frame in total, because the extent of temperature drop of the cold cathode tube 803 during the OFF period can be reduced, the amplitude of temperature change in one frame can be made smaller than the case of FIG. 43 (see temperature change of cold cathode tube in FIG. 47).

As a result, it is possible to suppress lowering of luminance, which is caused by shortened life of the cold cathode tube 803 due to its temperature change, and lowered temperature stability of the cold cathode tube 803 during emission and thus lowered temperature.

Further, in the present embodiment, even though two small pulses are incorporated in the OFF period of the inverter input signal, because the time width H2 of each small pulse P is made sufficiently shorter than time width H1 of the ON period, which is the ON period of the cold cathode tube 803 (see inverter input signal and emission waveform in FIG. 47), so that the luminance of the cold cathode tube 803 changes by the period of one frame, it is possible to improve performance of displaying a fast-moving image compared with the case of constant emission, without losing a desirable display quality in a fast-moving image, which effect is obtained by the provision of an OFF period per one frame.

[Tenth Embodiment]

Figure 48:
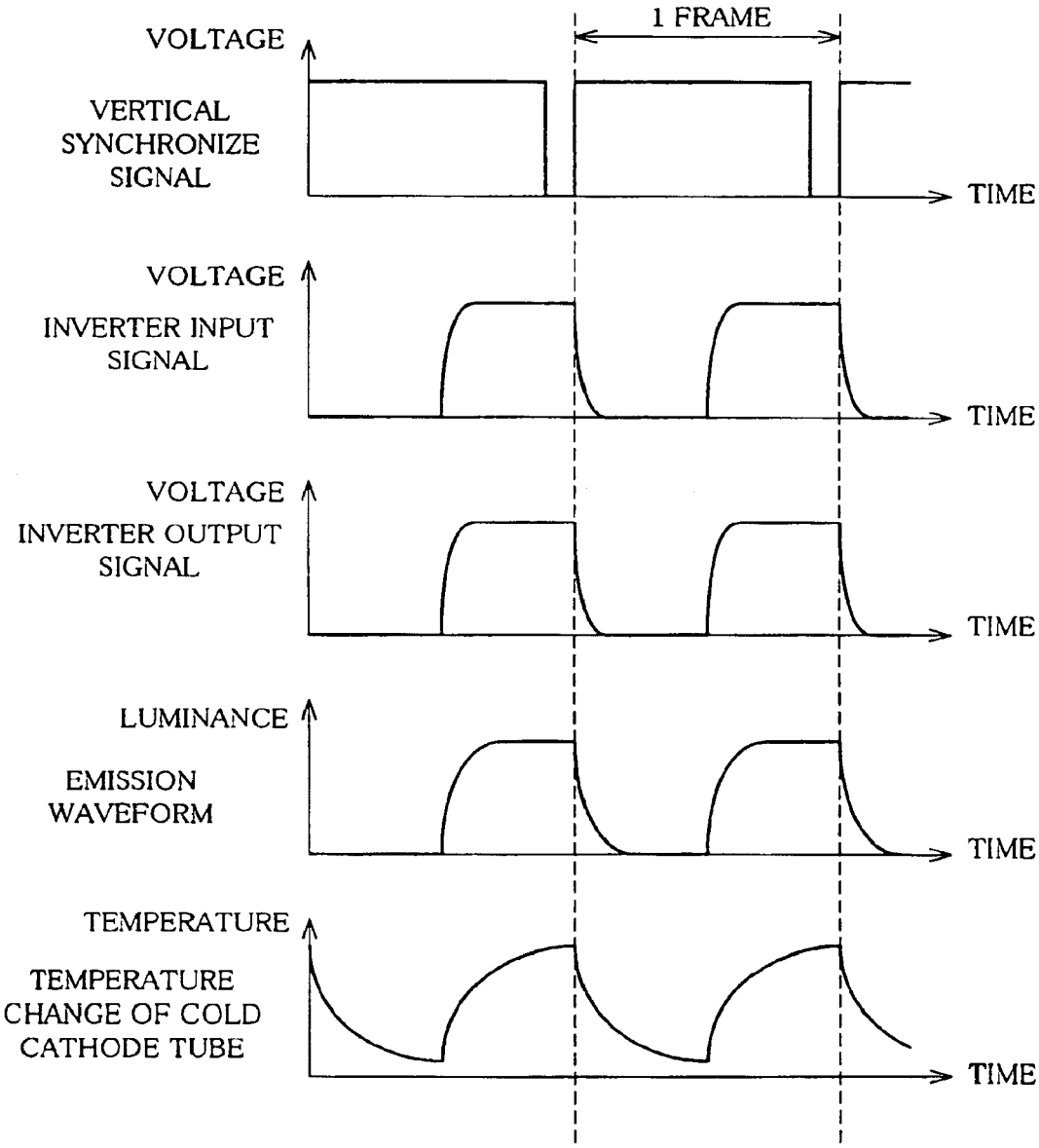
FIG. 48 is a waveform diagram showing another examples of applied signal waveforms, explaining operations of the liquid crystal display device, and an emission waveform and temperature change of an emitter with the applied signal waveforms.
Figure 49:
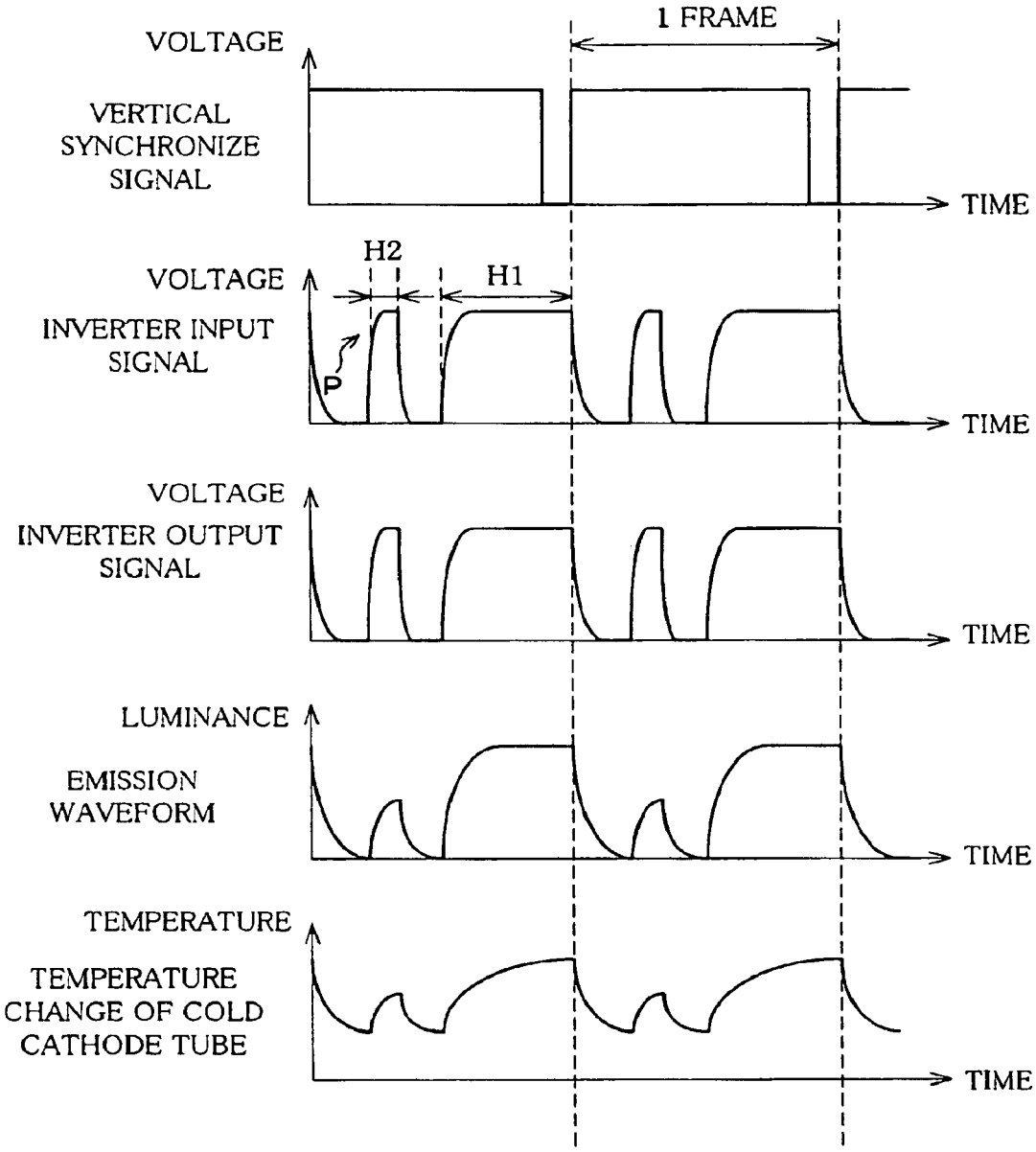
FIG. 49 is a waveform diagram showing examples of applied signal waveforms for overcoming problems caused by the signal waveforms of FIGS. 44 and 48, and an emission waveform and temperature change of an emitter with the applied signal waveforms.

The following will describe yet another embodiment of the present invention with reference to FIG. 48 and FIG. 49. Note that, elements having the same functions as those described in the drawings pertaining to the foregoing Seventh Embodiment are given the same reference numerals and explanations thereof are omitted here.

When the inverter output signal has a rectangular waveform as shown in FIG. 43, an electromagnetic radiation of high frequency is observed, which can be harmful to the human body. Further, when the driving signal of the rectangular wave is applied to the cold cathode tube 803, a current flows through the cold cathode tube 803 abruptly at the rise of emission, whereas the current of the cold cathode tube 803 is shut down abruptly at the fall of the cold cathode tube 803. This may cause a reverse current flow through the cold cathode tube 803, and such a current behavior is detrimental to life of the cold cathode tube 803.

In view of this drawback, according to the present embodiment, in the liquid crystal display device of FIG. 42, the inverter control circuit 801, as shown in FIG. 49, is adapted to incorporate a small pulse P in an OFF period of the inverter input signal (inverter driving signal), which is the OFF period of the cold cathode tube 803, in addition to slacking a rise and a fall of the waveform of the inverter input signal. The small pulse P has a time width H2 which is sufficiently shorter than a time width H1 of an ON period, which is the ON period of the cold cathode tube 803.

Accordingly, the small pulse P is also incorporated in the OFF period of the inverter output signal applied to the cold cathode tube 803 from the inverter 802 (see inverter output signal in FIG. 49), and the rise and fall of the waveform, making up the ON period, are slacked (see inverter output signal in FIG. 49).

In this manner, by applying a high voltage with the two small pulses P incorporated in an OFF period to the cold cathode tube 803, the cold cathode tube 803 emits light by the small pulse P during the OFF period of FIG. 48. This splits the OFF period into two, thus further reducing the individual time widths. FIG. 48 relates to the case where the inverter control circuit 801 of the liquid crystal display device of FIG. 42 is adapted only to slack the rise and fall of the waveform of the inverter input signal (inverter driving signal), showing main signals, and emission waveform and temperature change of the cold cathode tube 803 under this condition.

Thus, it is possible to reduce the extent of temperature drop of the cold cathode tube 803 during the OFF period. Further, considering a temperature change of the cold cathode tube 803 in one frame in total, because the extent of temperature drop of the cold cathode tube 803 during the OFF period can be reduced, the amplitude of temperature change in one frame can be made smaller than the case of FIG. 48 (see temperature change of cold cathode tube in FIG. 49).

As a result, it is possible to suppress lowering of luminance, which is caused by shortened life of the cold cathode tube 803 due to its temperature change, and lowered temperature stability of the cold cathode tube 803 during emission and thus lowered temperature.

Further, in the present embodiment, even though the small pulse are incorporated in the OFF period of the inverter input signal, because the time width H2 of the small pulse P is made sufficiently shorter than time width H1 of the ON period, which is the ON period of the cold cathode tube 803 (see inverter input signal and emission waveform in FIG. 49), so that the luminance of the cold cathode tube 803 changes by the period of one frame, it is possible to improve performance of displaying a fast-moving image compared with the case of constant emission, without losing a desirable display quality in a fast-moving image, which effect is obtained by the provision of an OFF period per one frame.

In this manner, by applying a high voltage with the slacked raise and fall to the cold cathode tube 803, there will be no abrupt current flow or sudden shut down of a current through the cold cathode tube 803, thus avoiding a reverse current flow through the cold cathode tube 803. This current behavior ensures preventing the detrimental effect to life of the cold cathode tube 803.

Further, since the inverter output signal applied to the cold cathode tube 803 has the slacked rise and fall, the high harmonic component can be reduced or relieved to effectively reduce the harmful electromagnetic wave to the human body, thereby overcoming the problem of electromagnetic wave.

Note that, the foregoing effects can also be realized by the waveforms other than the foregoing waveforms of the inverter input signals in the described embodiments, provided that the OFF period of the cold cathode tube 803 of one frame is divided into two or more, and the luminance of the cold cathode tube 803 is changed by the period of one frame.

Further, the foregoing described the case where ON/OFF of the emitter 804 is repeated in one frame. However, it is not necessarily required to completely switch OFF the emitter 804, and the same effect can also be obtained by dimming the emitter 804, i.e., by reducing luminance, instead of completely switching OFF the emitter 804.

That is, a gist of the present invention, in a conventional liquid crystal display device which is controlled to have a certain period of reduced luminance per one vertical period to flash or light the emitter, is to divide the period of reduced luminance into several parts within a range which satisfies the conditions for improving performance of displaying a fast-moving image whereby the luminance of the emitter is changed by the period of one vertical synchronize period, so as to suppress a temperature drop in the period of reduced luminance to reduce a cooling/heating cycle, and thus to reduce the extent of reduction of life and luminance of the emitter.

Further, the foregoing embodiments described the liquid crystal display devices with a single emitter. However, the present invention is not limited to this example, and is also applicable to the case where a plurality of emitting areas are provided in a scanning direction, which are successively scanned in synchronism with the vertical synchronize signal of the liquid crystal display device to emit light, while applying the voltage waveforms of the foregoing five embodiments to the emitters to cause emission of light.

Further, the foregoing embodiments described the case where the cold cathode tube was used for the emitter. However, the present invention is not just limited to this and is also applicable to the cases where the emitter is a light-emitting diode, an electroluminescence element, a hot cathode tube, a mercury lamp, a halogen lamp, or a laser.

Further, the foregoing liquid crystal display device of the present invention can also be described as being provided with two or more OFF periods for the driving signal of the illumination device (back-light) within one vertical synchronize period (one frame), so that luminance of the illumination device is changed by the period of one vertical synchronize period.

The liquid crystal display device of the present invention, in the liquid crystal display device having the emitter for illuminating pixels with light which is in accordance with a driving signal, may have an arrangement including emission control means for controlling the driving signal so that the rise and fall of an emission waveform are slacked per one vertical period.

According to this invention, the light emitted by the emitter undergoes change according to the driving signal before it illuminates the pixels to display predetermined information. Here, the driving signal applied to the emitter has a rectangular waveform and includes an OFF period. Thus, a viewer would see only a moment of high contrast as a persistent image, which is perceived as a clear image with good contrast.

However, when the driving signal has the rectangular waveform, an electromagnetic radiation of high frequency is observed, which can be harmful to the human body. Further, when the driving signal of the rectangular wave is applied to the emitter, a current flows through the emitter abruptly at the rise of emission, whereas the current of the emitter is shut down abruptly at the fall of the emitter. This may cause a reverse current flow through the emitter, and such a current behavior is detrimental to life of the emitter.

In view of this drawback, according to the foregoing invention, the emission control means controls the driving signal so that the rise and fall of the waveform of the emitter are slacked. By thus controlling the driving signal so that the waveform of the emitter is slacked in the vicinity of the rise and fall, there will no abrupt current flow or sudden shut down of a current through the emitter, thus preventing a reverse current flow through the emitter. This current behavior ensures preventing the detrimental effect to life of the emitter.

Further, since the driving signal applied to the emitter is controlled such that the waveform of the emitter is slacked in the vicinity of the rise and fall, the high harmonic component can be reduced or relieved to effectively reduce the harmful electromagnetic wave to the human body, thereby overcoming the problem of electromagnetic wave.

Further, since the driving signal applied to the emitter is controlled such that the waveform of the emitter is slacked in the vicinity of the rise and fall, there exists a period of reduced emission of the emitter per one vertical period. Thus, a viewer would see only a moment of high contrast as a persistent image, which is perceived as a clear image with good contrast, thus improving display quality of fast-moving images in particular.

In the foregoing liquid crystal display device, it is preferable that the emission control means slacks the rise and fall of the waveform of the driving signal which is applied to the emitter, so that the emission of the emitter gradually increases in the vicinity of the rise and gradually decreases in the vicinity of the fall.

In this case, because the rise and fall of the waveform of the driving signal are slacked, there will be no abrupt current flow through the emitter, or sudden shut down of a current in the emitter in the vicinity of the fall of emission, thus avoiding a reverse current flow through the emitter. As a result, it becomes possible to increase the life of the emitter, to reduce or relieve the problem of electromagnetic radiation, in which a high harmonic component is harmful to the human body, and to desirably improve display quality of a fast-moving image.

The emission control means may be adapted so that a raise and fall of an envelope of the waveform of the driving signal so as to gradually increase the emission of the emitter in the vicinity of the rise and gradually decrease the emission of the emitter in the vicinity of the fall.

The emission control means may be adapted so that the rise and fall of the waveform of the driving signal are essentially part of a sinusoidal wave.

The emission control means may be adapted so that the rise and fall of the envelope of the waveform of the driving signal are essentially part of a sinusoidal wave.

Another liquid crystal display device of the present invention, in a liquid crystal display device having an emitter for illuminating pixels with light which is in accordance with a driving signal, may have an arrangement including emission control means for controlling the driving signal so that the driving signal makes up a sinusoidal wave whose frequency essentially matches an inverse of a vertical period.

According to the foregoing invention, the light emitted by the emitter is varied according to the driving signal and illuminates the pixels to display desired information. In this case, by applying the driving signal having a rectangular waveform to the emitter, there exists an OFF period. Thus, a viewer would see only a moment of high contrast as a persistent image, which is perceived as a clear image with good contrast.

However, when the driving signal has the rectangular waveform, an electromagnetic radiation of high frequency is observed, which can be harmful to the human body. Further, when the driving signal of the rectangular wave is applied to the emitter, a current flows through the emitter abruptly at the rise of emission, whereas the current of the emitter is shut down abruptly at the fall of the emitter. This may cause a reverse current flow through the emitter, and such a current behavior is detrimental to life of the emitter.

In view of this drawback, according to the foregoing invention, the emission control means controls the driving signal so that the driving signal makes up a sinusoidal wave whose frequency essentially matches an inverse of a vertical period. By thus controlling the driving signal so that the driving signal makes up a sinusoidal wave whose frequency essentially matches an inverse of a vertical period (not conventional rectangular wave), there will be no abrupt current flow through the emitter, and the emission of the emitter is also changed to a sinusoidal wave whose frequency essentially matches an inverse of a vertical period. As a result, there will be no abrupt current flow or sudden shut down of a current in the emitter, or a reverse current flow through the emitter. This current behavior ensures preventing the detrimental effect to life of the emitter.

Further, because the driving signal applied to the emitter is controlled so that the driving signal makes up a sinusoidal wave whose frequency essentially matches an inverse of a vertical period, it is ensured to reduce or relieve the high harmonic component. As a result, the electromagnetic radiation, which can be harmful to the human body, can be greatly reduced, thus overcoming the problem of electromagnetic radiation.

Further, by the driving signal applied to the emitter, there exists a period of reduced emission of the emitter per one vertical period. Thus, a viewer would see only a moment of high contrast as a persistent image, which is perceived as a clear image with good contrast, thus improving display quality of fast-moving images in particular.

The driving signal may be controlled so that the driving signal makes up a sinusoidal wave whose envelope has a frequency which essentially matches an inverse of a vertical period.

The driving signal may be controlled so that the driving signal makes up a Gaussian distribution waveform with its repetitive period essentially matching a vertical period.

The driving signal may be controlled so that the driving signal makes up a Gaussian distribution waveform whose envelope has a repetitive period which essentially matches a vertical period.

The driving signal may be controlled so that the driving signal makes up a Lorentz distribution waveform with its repetitive period essentially matching a vertical period.

The driving signal may be controlled so that the driving signal makes up a Lorentz distribution waveform whose envelope has a repetitive period which essentially matches a vertical period.

The driving signal may be controlled so that the driving signal makes up a triangular wave whose frequency essentially matches an inverse of a vertical period.

The driving signal may be controlled so that the driving signal makes up a triangular wave whose envelope has a frequency which essentially matches an inverse of a vertical period.

The emitter is preferably the cold cathode tube, a light-emitting diode, an electroluminescence element, a hot cathode tube, a mercury lamp, a halogen lamp, or a laser.

An emitter driving method of the present invention may be adapted so that a rise and fall of the driving signal of the emitter in the liquid crystal display device are slacked.

According to this invention, the light emitted by the emitter of the liquid crystal display device is changed according to the driving signal. Here, when the driving signal has the rectangular waveform, an electromagnetic radiation of high frequency is observed, which can be harmful to the human body. Further, when the driving signal of the rectangular wave is applied to the emitter, a current flows through the emitter abruptly at the rise of emission, whereas the current of the emitter is shut down abruptly at the fall of the emitter. This may cause a reverse current flow through the emitter, and such a current behavior is detrimental to life of the emitter.

In view of this drawback, in the foregoing invention, the rise and fall of the driving signal are slacked. By thus slacking the driving signal of the emitter in the vicinity of the rise, there will no abrupt current flow through the emitter. Further, by slacking the driving signal of the emitter in the vicinity of the fall, there will be no sudden shut down of the current in the emitter, thus avoiding a reverse current flow through the emitter. This current behavior ensures preventing the detrimental effect to life of the emitter.

Further, because the driving signal applied to the emitter is controlled so that the waveform of the emitter is slacked in the vicinity of the rise and fall, it is ensured to reduce or relieve a high harmonic component. As a result, the electromagnetic radiation, which can be harmful to the human body, can be greatly reduced, thus overcoming the problem of electromagnetic radiation.

Further, by the driving signal applied to the emitter, there exists a period of reduced emission of the emitter. Thus, a viewer would see only a moment of high contrast as a persistent image, which is perceived as a clear image with good contrast, thus improving display quality of fast-moving images in particular.

The same function as above can be obtained when the rise and fall of an envelope of the driving signal, instead of the driving signal itself, is slacked.

In order to slack the waveform of the driving signal, it is preferable that the driving signal line according to the driving signal is grounded via a capacitor. In this case, an integrator circuit is created by the resistance of the driving signal line and the capacitor. The integrator circuit allows the driving signal of a rectangular wave to be slacked according to a time constant.

The same function as above can be obtained when the driving signal of the emitter of the liquid crystal display device is a periodic waveform which is in synchronism with a vertical synchronize signal, instead of the driving signal itself.

Alternatively, the same effect as above can be obtained when the envelope of the driving signal of the emitter of the liquid crystal display device is a periodic wave which is in synchronism with a vertical synchronize signal.

It is preferable that the rise and fall of the periodic waveform make up part of a sinusoidal wave. Alternatively, the periodic waveform may be essentially a sinusoidal wave.

In this case, there will be no abrupt current flow through the emitter, and the emission of the emitter also changes periodically according to the vertical synchronize signal. As a result, there will be no abrupt current flow or sudden shut down of a current in the emitter, or a reverse current flow through the emitter. This current behavior ensures preventing the detrimental effect to life of the emitter.

In particular, when the rise and fall of the periodic waveform make up part of a sinusoidal wave, or when the periodic waveform is essentially a sinusoidal wave, the high harmonic component can be reduced or relieved with certainty. As a result, the electromagnetic radiation, which can be harmful to the human body, can be greatly reduced, thus overcoming the problem of electromagnetic radiation.

Further, by the driving signal applied to the emitter, there exists a period of reduced emission of the emitter. When such an emission driving method is applied to the liquid crystal display device, a viewer would see only a moment of high contrast as a persistent image, which is perceived as a clear image with good contrast, thus improving display quality of fast-moving images in particular.

The periodic waveform is not just limited to a sinusoidal wave, and it may be a triangular wave. Alternatively, the periodic waveform may be essentially a repetition of a Gaussian distribution waveform. Further alternatively, the periodic waveform may be essentially a repetition of a Lorentz distribution waveform.

The emitter of the present invention may be adapted to receive a driving signal with the slacked rise and fall.

According to this invention, the light emitted by the emitter of the liquid crystal display device is changed according to the driving signal. Here, when the driving signal has the rectangular waveform, an electromagnetic radiation of high frequency is observed, which can be harmful to the human body. Further, when the driving signal of the rectangular wave is applied to the emitter, a current flows through the emitter abruptly at the rise of emission, whereas the current of the emitter is shut down abruptly at the fall of the emitter. This may cause a reverse current flow through the emitter, and such a current behavior is detrimental to life of the emitter.

In view of this drawback, in the foregoing invention, the emitter receives the driving signal with the slacked rise and fall. By thus slacking the driving signal of the emitter in the vicinity of the rise, there will no abrupt current flow through the emitter. Further, by slacking the driving signal of the emitter in the vicinity of the fall, there will be no sudden shut down of the current in the emitter, thus avoiding a reverse current flow through the emitter. This current behavior ensures preventing the detrimental effect to life of the emitter.

Further, because the driving signal applied to the emitter is controlled so that the waveform of the emitter is slacked in the vicinity of the rise and fall, it is ensured to reduce or relieve a high harmonic component. As a result, the electromagnetic radiation, which can be harmful to the human body, can be greatly reduced, thus overcoming the problem of electromagnetic radiation.

Further, by the driving signal applied to the emitter, there exists a period of reduced emission of the emitter. Thus, a viewer would see only a moment of high contrast as a persistent image, which is perceived as a clear image with good contrast, thus improving display quality of fast-moving images in particular.

The same function as above can also be obtained with the emitter which receives a driving signal having an envelope with the slacked rise and fall. Alternatively, the emitter may receive a driving signal having a periodic waveform which is in synchronism with a vertical synchronize signal. Further alternatively, the emitter may receive a driving signal having an envelope of the periodic waveform which is in synchronism with a vertical synchronize signal.

It is preferable that the rise and fall of the periodic waveform are part of a sinusoidal wave. The periodic waveform may be essentially a sinusoidal wave.

In this case, there will be abrupt current flow through the emitter, and the emission of the emitter makes up part of a sinusoidal wave, or the periodic waveform is changed as if it were essentially a sinusoidal wave. Thus, it is ensured to reduce or relieve the high harmonic component. As a result, the electromagnetic radiation, which can be harmful to the human body, can be greatly reduced, thus overcoming the problem of electromagnetic radiation.

Further, by the driving signal applied to the emitter, there exists a period of reduced emission of the emitter. When such an emission driving method is applied to the liquid crystal display device, a viewer would see only a moment of high contrast as a persistent image, which is perceived as a clear image with good contrast, thus improving display quality of fast-moving images in particular.

The periodic waveform is not just limited to a sinusoidal wave, and it may be a triangular wave. Alternatively, the periodic waveform may be essentially a repetition of a Gaussian distribution waveform. Further alternatively, the periodic waveform may be essentially a repetition of a Lorentz distribution waveform.

A liquid crystal display device of the present invention, in a liquid crystal display device which is provided with a period of reduced luminance of illuminated light on pixels per one vertical period, may have an arrangement including an emitter for independently emitting light of at least one color among three primary colors of light.

According to this invention, light illuminates the pixels to display desired information. Here, by the provision of a period of reduced period of illuminated light on the pixels per one vertical period, a viewer would see only a moment of high contrast as a persistent image, which is perceived as a clear image with good contrast.

However, the emitter which is commonly employed is of a white type, which contains fluorescent materials of at least three colors corresponding to the three primary colors of light. This causes a coloring phenomenon of image contours in a fast-moving image in particular, which results in poor image quality. This is due to color-dependent different response times of the emitter, with the resulting different phases of emission waveforms.

In view of this drawback, in the foregoing invention, there is provided an emitter which independently emits light of at least one of the three primary colors of light. By adjusting phases of emission waveforms from this emitter, the phases of the emission waveforms of the three primary colors can be brought closer together. This makes it possible to relieve the coloring phenomenon of image contours in a fast-moving image, which was caused when the emitter of a white type was used, thus greatly improving display quality also in a fast-moving image.

In the present invention, it is preferable that the emitter for independently emitting light of at least one color emits only green among the three primary colors. In common fluorescent materials, a response time required for the emission or dimming of green is the longest among the three primary colors, followed by red and blue.

Therefore, by independently providing the emitter which emits only green, it is possible to bring the phase of an emission waveform of green closer to those of blue and red.

Namely, among emission waveforms of the three primary colors of light, that of green shows the slowest change of waveform. Thus, by independently providing the emitter which emits only green, the phase of the emission waveform of green from the emitter can be adjusted to be brought closer to those of the other two primary colors of light. The other two primary colors may be emitted from another single emitter, or from separate emitters which are individually provided for these colors. By providing a separate emitter for each primary color, the respective phases can be adjusted more accurately to be brought closer together.

Further, in the present invention, the emitter which independently emits at least one color emits only blue among the three primary colors of light. In common fluorescent materials, a response time required for the emission or dimming of green is the longest among the three primary colors, followed by red and blue.

Thus, even though some emission efficiency will be lost, the response time required for the emission or dimming of green becomes substantially equal to the response time of red, and only that of blue becomes short. Therefore, by independently providing the emitter which emits only blue, the phase of the emission waveform of blue can be brought closer to those of green and red.

Therefore, by independently providing the emitter which emits only green, the phase of the emission waveform of green can be brought closer to those of blue and red.

That is, it is equally preferable that the emitter which independently emits at least one color emits only blue among the three primary colors. This is because the fluorescent material of blue has the shortest response time, and the response time of a fluorescent material of green can be made substantially equal to that of red by developing a new material.

The other two primary colors may be emitted from another single emitter, or from separate emitters which are individually provided for these colors. In the latter case, by allocating separate emitters for different primary colors, and by independently controlling them, the respective phases can be adjusted more accurately to be brought closer together.

It is preferable to further provide emission control means for controlling at least one of a period in which luminance of light is not reduced and an amplitude of luminance of the light in the emitter. By controlling the period in which luminance of the light is not reduced, the waveform width of the emission waveform can be controlled, and the respective phases of the emission waveforms can be brought closer together more accurately. Further, the emission timings can also be adjusted by controlling an amplitude of luminance of the light, so as to bring the phases of the respective waveforms closer together. The emission timings can be adjusted even more accurately by controlling both the period in which luminance of light is not reduced and the amplitude of luminance of the light.

Another liquid crystal display device of the present invention may have an arrangement including a plurality of cold cathode tubes, containing fluorescent materials, for illuminating pixels with light which is in accordance with driving signals; and emission control means for controlling the driving signals so that changes in luminance of the plurality of cold cathode tubes with respect to time substantially occur in the vicinity of rise time and fall time per one vertical period, wherein: at least one of the plurality of cold cathode tubes contains only a fluorescent material of one color among three primary colors of light, and the driving signal applied to this cold cathode tube is controlled by the emission control means.

According to this invention, light illuminates pixels to display desired information. Here, the emission control means controls the driving signal so that the changes in luminance of the cold cathode tubes with respect to time for the light which illuminates the pixels occur in the vicinity of a rise time or a fall time per one vertical period. Further, the emission control means controls the driving signal so that the luminance of light which illuminates the pixels is reduced in the vicinity of the rise and fall per one frame. By thus providing a period of reduced luminance of light, a viewer would see only a moment of high contrast as a persistent image, which is perceived as a clear image with good contrast.

However, the cold cathode tubes commonly contain fluorescent materials of at least three colors for emitting green, red, and blue. The fluorescent materials emit fluorescent light by the ultraviolet light which was released from mercury which was excited by the discharge in the cold cathode tubes. When the cold cathode tubes are lit or flashed in pulses, the phases of the waveforms of the respective colors become different (emitting period of each color with respect to UV radiation is different because response times for ON and OFF of the emission of the fluorescent material are different for each color). By this difference in phase of the emission waveforms, the coloring phenomenon of image contours is observed in a fast-moving image, and image quality suffered as a result.

According to the foregoing invention, at least one of the cold cathode tubes contain a fluorescent material of only one of the three primary colors of light, and the emission control means controls the driving signal which is applied to the cold cathode tubes, thus making it possible to adjust the phases of the emission waveforms of the respective colors to bring them closer together. As a result the coloring phenomenon of image contours in a fast-moving image can be relieved, thus greatly improving display quality in a fast-moving image.

It is preferable that two cold cathode tubes are provided, one of which containing a fluorescent material of only green among the three primary colors of light, and the other containing fluorescent materials of red and blue among the three primary colors of light.

Among the three primary colors of light, green, in particular, has a slow rise and fall in the emission waveform. Thus, by independently providing the cold cathode tube containing a fluorescent material of only green, and the cold cathode tube containing fluorescent materials of red and blue, and by controlling the driving signals of the respective cold cathode tubes by the emission control means, it becomes possible to more accurately adjust the phase of the emission waveform of the cold cathode tube which shows the slowest change of the emission waveform (cold cathode tube containing a fluorescent material of green) and the phase of the emission waveform of the cold cathode tube containing fluorescent materials of red and blue, so as to bring them closer together. As a result, it is possible to relieve the coloring phenomenon of image contours in a fast-moving image, thereby further improving display quality.

Further, according to the foregoing invention, it is also preferable that two cold cathode tubes are provided, one of which contains fluorescent materials of green and red among the three primary colors of light, and the other containing a fluorescent material of only blue among the three primary colors of light.

The fluorescent materials commonly used are selected based on emission efficiency and emission spectrum, and there are more types of fluorescent materials of green compared with blue and red. Thus, ignoring a slight reduction in emission efficiency, the response time of green for emission or dimming can be shortened, by suitably selecting the fluorescent material, to the time which corresponds to the response time of most red fluorescent materials.

Thus, by independently providing the cold cathode tube containing fluorescent materials of green and red, and the cold cathode tube containing a fluorescent material of only blue, and by controlling the driving signals of the respective cold cathode tubes by the emission control means, it becomes possible to more accurately adjust the phase of the emission waveform of the cold cathode containing fluorescent materials of green and red and the phase of the emission waveform of the cold cathode tube containing a fluorescent material of only blue, so as to bring them closer together. As a result, it is possible to relieve the coloring phenomenon of image contours in a fast-moving image, thereby further improving display quality.

That is, a response time for emission or dimming is particularly short for blue in the emission waveform. Thus, by independently providing blue and the other colors in separate cold cathode tubes, and by independently controlling them, the emission waveform of blue and those of the other colors can be substantially matched. As a result, it is possible to relieve the coloring phenomenon of image contours in a fast-moving image.

It is preferable that the cold cathode tubes comprise first through third cold cathode tubes, wherein the first cold cathode tube contains a fluorescent material of only green among the three primary colors of light, and the second cold cathode tube contains a fluorescent material of only red among the three primary colors of light, and the third cold cathode tube contains a fluorescent material of only blue among the three primary colors of light.

According to this invention, compared with the case with the two cold cathode tubes, by independently controlling the respective driving signals of the three cold cathode tubes by the emission control means, the phases of the emission waveforms of the three primary colors can be brought closer together more accurately, thereby relieving the coloring phenomenon of image contours in a fast-moving image with more certainty, and further improving display quality.

In order to elucidate the discussions of the cold cathode tubes and their emission timings in the present invention, the following definitions are given. Without losing generalization, the first cold cathode tube contains a fluorescent material(s) of one or two colors having a relatively longer response time for emission and dimming, and the second cold cathode tube contains a fluorescent material(s) of one or two colors having a relatively shorter response time for emission and dimming. Further, if provided, the third cold cathode tube contains a fluorescent material with the shortest response time, which is not contained in either the first cold cathode tube or the second cold cathode tube. That is, since the response times of the fluorescent materials of the three primary colors generally become shorter from green, red, and to blue in this order, the following combinations of the fluorescent tubes of the present invention are possible, as shown in Table 1 below. Obviously the order the fluorescent materials are actually contained does not pose any problem as long as they are controlled according to the subject of the present invention.

TABLE 1

| CASE | FIRST COLD CATHODE TUBE | SECOND COLD CATHODE TUBE | THIRD COLD CATHODE TUBE |
|---|---|---|---|
| 1 | GREEN | RED, BLUE | NONE |
| 2 | GREEN, RED | BLUE | NONE |
| 3 | GREEN | RED | BLUE |

Figure 16:
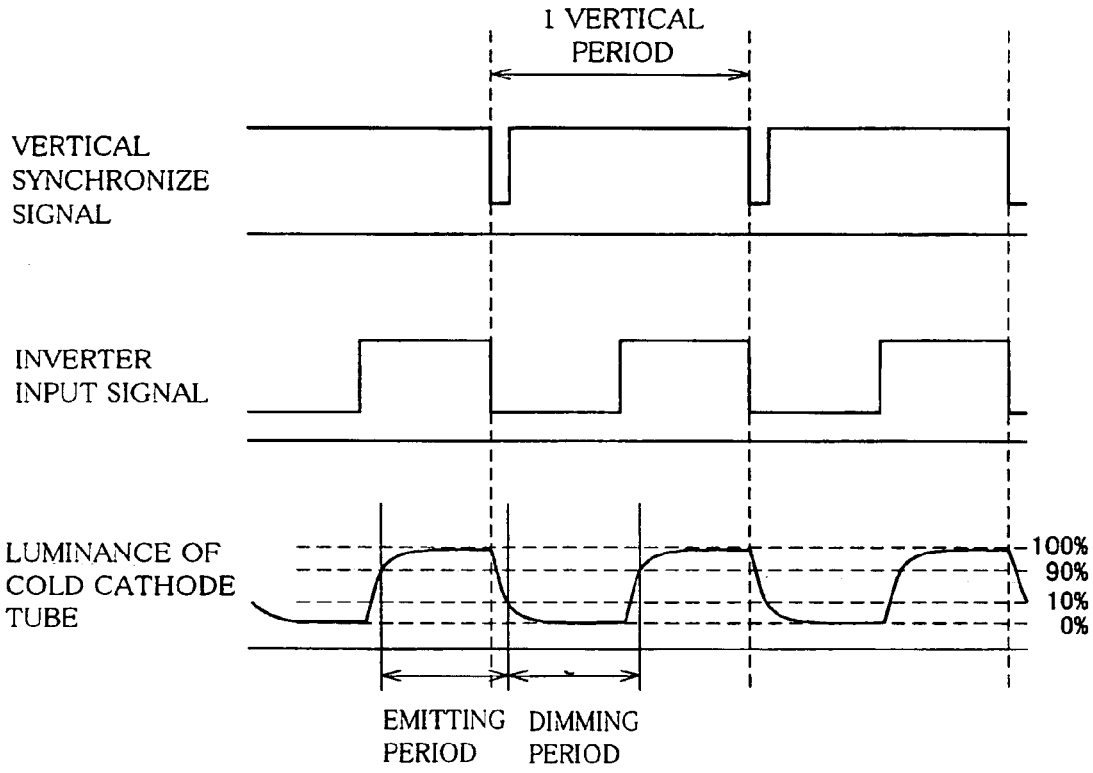
FIG. 16 is an explanatory drawing for defining an emission timing and a dimming timing in conjunction with an inverter input signal.

The following defines the emission timing and dimming timing in conjunction with the inverter input signal timing. FIG. 16 shows a typical model of the inverter input signal and emission waveform. With reference to FIG. 16, the emitting period, the dimming period, the emission timing, the dimming timing, and the vertical period will be defined.

Namely, the emitting period is a period from 90% luminance to 10% luminance with respect to minimum and maximum luminance, and a period excluding this period is the dimming period. It should be noted here that 90% and 10% are arbitrary values which are temporarily set for convenience of explanation, and other values, for example, 50%, 20%, and 80% can also be used appreciably, and do not affect the scope of the invention in any ways. Further, the emission timing and the dimming timing are defined as the start of the emitting period and the start of the dimming period, respectively.

Further, by "switching ON (OFF) one of the cold cathode tubes at a timing earlier (later) than the other cold cathode tube", it is meant to indicate a quantity of change of emission timings as opposed to the conventional case where the timings of driving signals with respect to the cold cathode tubes are the same, and it does not mean comparing ON (OFF) periods of the plurality of cold cathode tubes. Note that, "dimming" includes a state of zero emission intensity, i.e., the OFF state.

In the foregoing liquid crystal display device, in order to relieve the coloring phenomenon of image contours in a fast-moving image with certainty, and to improve display quality, it is preferable that the emission control means controls the driving signals of the respective cold cathode tubes at the following timings.

Namely, the emission control means controls the driving signals so that the first cold cathode tube emits light at an earlier timing than the other cold cathode tube(s).

Further, the emission control means controls the driving signals so that the first cold cathode tube dims at an earlier timing than the other cold cathode tube(s).

Further, the emission control means controls the driving signals so that the first cold cathode tube, the second cold cathode tube, and the third cold cathode tube emit light in this order.

Further, the emission control means controls the driving signals so that the first cold cathode tube, the second cold cathode tube, and the third cold cathode tube dim in this order.

Further, the emission control means controls the driving signals so that the third cold cathode tube emits light at a later timing than the other cold cathode tube(s).

Further, the emission control means controls the driving signals so that the third cold cathode tube dims at a later timing than the other cold cathode tube(s).

An illumination device of the present invention is for illuminating pixels of a liquid crystal display device, and may have an arrangement wherein luminance of the illumination device includes an emitting period and a dimming period of a certain phase with respect to a vertical synchronize signal, and the dimming period is in a range of 10% to 90% of one vertical period, the illumination device independently controlling the emitting period and the dimming period of an emitter of at least one of three primary colors of light.

When the dimming period is less than 10% of one vertical period, an area of good contrast cannot be used selectively. On the other hand, when the dimming period exceeds 90% of one vertical period, the luminance of the entire device is lowered and an image cannot be obtained desirably. Therefore, in the foregoing illumination device, the dimming period is set within a range of 10% to 90% of one vertical period. This allows an area of good contrast to be selectively used, and an image can be obtained desirably without lowering luminance of the entire device.

The dimming period is preferably in a range of 20% to 70% of a vertical period. With a dimming period exceeding 70% of a vertical period, a performance of displaying a moving image which can match up against that of CRTs can be expected, and therefore further dimming is not necessary since luminance will be lost in doing so. Further, with a 20% dimming period with respect to common constant lighting, one can clearly appreciate an improvement in moving image display performance. Further, compared with 1 candela (cd), with a dimming period of 20%, one can clearly appreciate an improvement in moving image display performance.

The emitter is preferably the cold cathode tube, an electroluminescence, or a hot cathode tube. Such emitters are widely used and superior in terms of productivity and cost.

The emitter preferably emits only green among the three primary colors of light. The emitter may emit only blue among the three primary colors. Generally, a response of green is the slowest, and that of blue the fastest. Thus, by correcting the emitter whose response time deviates most (i.e., emitter whose phase has an emitting period of most deviation), a desirable display with a simple structure can be realized.

The emitter preferably includes a first cold cathode tube which contains a fluorescent material having a relatively longer response time among the three primary colors, and a second cold cathode tube which contains a fluorescent material having a relatively shorter response time. Currently, the cold cathode tube is most superior among various emitters in terms of cost and productivity in industrial applications. Thus, by correcting the cold cathode tubes by dividing them into two groups: one making up a group of emitters with a relatively longer response time (larger phase deviation); and the other making up a group with a relatively shorter response time (smaller phase deviation), it is possible to realize a practical display with superior cost and productivity.

It is preferable that the first cold cathode tube contains a fluorescent material of green, and the second cold cathode tube contains fluorescent materials of red and blue. The first cold cathode tube may contain fluorescent materials of red and blue, and the second cold cathode tube may contain a fluorescent material of blue.

In general, among the fluorescent materials, a response of green is the slowest, and that of blue the fastest. Thus, by correcting the emitter whose response time deviates most (i.e., emitter whose phase has an emitting period of most deviation), a desirable display with a simple structure can be realized.

It is preferable that the emitter includes a first cold cathode tube which contains a fluorescent material with a relatively longer response time among the three primary colors, and a second cold cathode tube which contains a fluorescent material with a response time of an intermediate length, and a third cold cathode tube which contains a fluorescent material with a relatively shorter response time. In this case, because the three primary colors are divided into the three cold cathode tubes, the emitting periods of the respective colors can be matched more accurately, thus realizing a most desirable display.

Preferably, an inverter for driving the emitter is provided, wherein a phase, amplitude, or pulse width of an input signal with respect to the inverter is modulated, so as to independently control the emitting period and the dimming period.

In order to match the emitting periods, the following three factors are considered. Namely, start time and end time of the emitting period, duration of the emitting period, and luminance profile at the start and end of the emitting period. The phase modulation controls a start time of the emitting period, and the pulse modulation controls duration of the emitting period and the end time of this emitting period. The amplitude modulation controls luminance profile at the start and end of the emitting period. Among these factors, the start time has the largest effect, followed by the end time and luminance profile in this order.

The emitting period of the first cold cathode tube is preferably controlled independently and to substantially match the emitting period of the second or third cold cathode tube. The emitting period of the second or third cold cathode tube may be controlled independently and to substantially match the emitting period of the first cold cathode tube.

In principle, it is preferable for the loyal reproduction of an intended image that the emitter starts and ends the emitting period according to the control signal with no waiting time. However, a zero response time in reality is unattainable. Further, an effort to set forward the phase may results in the use of a high voltage circuit or a phase adjusting circuit, which were not required conventionally.

It is therefore more practical to substantially match the emitting periods of the cold cathode tubes by correcting the emitters whose phases are relatively ahead (second and third cold cathode tubes). In this case, it is practical and effective to substantially match the emitting periods of the cold cathode tubes by actively correcting the emitter with a longer response time and a larger phase deviation. Such a correction may be carried out, for example, by delaying the phase. A circuit for delaying the phase are often realized by an adjusting circuit of a relatively simple structure, thus avoiding a complex structure.

It is preferable that the emitting periods of the first, second, and third cold cathode tubes are independently controlled and to substantially match each other. By independently controlling the three cold cathode tubes, it is ensured that a most desirable display is obtained.

It is preferable that the first cold cathode tube contains a fluorescent material of only green. The first cold cathode tube may contain fluorescent materials of green or red. When providing two cold cathode tubes, the emitter with the largest phase deviation should be independently controlled. That is, generally, a response of the fluorescent material of green is the slowest, and that of blue the fastest, and therefore by sealing a fluorescent material of one of these colors, the phase deviation can be reduced with certainty. The emitting period of either of the emitter of one color or the emitter of two colors may be controlled to obtain the foregoing desirable effects, provided that their emitting periods substantially match.

It is preferable that the cold cathode tubes are provided on an edge of an illumination unit which is covered with a photoconductor, and illuminate an entire surface of the liquid crystal display device with an equal phase. In this case, the illumination light is supplied from the cold cathode tubes which are provided on the edge of illumination unit, through the photoconductor, and to the liquid crystal display device.

Here, the emitting periods of illumination light corresponding to the entire pixels coincide. It is therefore crucial to decide an area in the screen in which the emitting period is set to start. A display area in which the emitting periods are matched immediately after it was scanned by the liquid crystal display device shows a display of the previous one vertical period because the response of the liquid crystal is not complete. Generally, the timing is preferably within a time period between the end of liquid crystal display in the vicinity of the center of the liquid crystal display device and the start of scanning in this area. This provides the most desirable display at the center of the display. According to the foregoing structure, the timing can be changed depending on the use of the liquid crystal display device.

It is preferable that the emitters are divided into a plurality of areas having emitting periods of different phases with respect to the vertical synchronize signal, and the emitters having the emitting periods of the same phase make up a group of emitters to illuminate the same area of the liquid crystal display device, and the areas of different illumination areas are almost uniform in size, and the phases are shifted at substantially equal intervals in order along the scanning direction, and the phase difference divides one vertical period into equal parts.

In the illumination device of a direct type, the emitters are divided into a plurality of areas having emitting periods of different phases with respect to the vertical synchronize signal, and the emitters having the emitting periods of the same phase make up a group of emitters to illuminate the same area of the liquid crystal display device, and the areas of different illumination areas are almost uniform in size, and the phases are shifted at substantially equal intervals in order along the scanning direction, and the phase different divides one vertical period into equal parts. It is therefore possible to maintain a constant relation between the scanning timing of the liquid crystal display device and the phase of the emitting periods of the illumination area irrespective of the display device. Thus, it becomes possible to match the emitting periods with the time zone near the time of completion of the liquid crystal in any display area. As a result, a display with good contrast is possible in all display areas.

The number of groups of emitters is preferably in a range of 4 and 48. The number is emitter groups less than 4 results in more phase shifts with respect to scanning of the liquid crystal display device, whereas the number of emitter groups larger than 48 requires nearly 100 cold cathode tubes (at least 48×2=96), which is not practical in terms of packaging and cost.

An image display device of the present invention may have an arrangement including: a plurality of display elements, making up a screen, for modulating light according to image data which is applied while being scanned; and an illuminating section for illuminating the display elements, wherein: when those of the display elements having the same scanning time make up a display element band, the display element band is grouped into display element groups in order of earlier scanning time and to include at least one display element band in one display element group, and the illuminating section includes a plurality of illuminating elements, at least one of which is provided for each display element group, and each illuminating element illuminates the display elements per the display element group while undergoing change between first luminance and second luminance which is darker than the first luminance, at a period of one frame time of the screen and at a timing of change which is different in each display element group, and between the illuminating elements are provided a partition member for parting adjacent illuminating elements.

According to this arrangement, since a partition member for parting adjacent illuminating elements is provided between the illuminating elements, the light from one illuminating element, by being shielded by the partition member, does not reach the display element group which is assigned to the adjacent illuminating element. Thus, it is possible to prevent the light from one illuminating element from reaching the display element group other than the display element group (display area) to be illuminated by this light. Thus, considering one specific display area in an image panel such as a liquid crystal display panel, only one illuminating element displays this display area. Therefore, it is only required to drive this illuminating element with a short pulse time width to illuminate the display elements by the sufficiently short pulse time width, without being affected by the light from other illuminating elements. As a result, it becomes possible to illuminate each emitting area with a practically and sufficiently short pulse time width, thereby improving display quality by eliminating, for example, image persistence in a fast-moving image.

Further, an image display device of the present invention may have an arrangement including: a plurality of display elements, making up a screen, for modulating light according to image data which is applied while being scanned; and an illuminating section for illuminating the display elements, wherein: when those of the display elements having the same scanning time make up a display element band, the display element band is grouped into display element groups in order of earlier scanning time and to include at least one display element band in one display element group, and the illuminating section includes a plurality of illuminating elements, at least one of which is provided for each display element group, and a reflecting plate for reflecting light from the illuminating elements in a direction toward the display elements, and each illuminating element illuminates the display elements per the display element group while undergoing change between first luminance and second luminance which is darker than the first luminance, at a period of one frame time of the screen and at a timing of change which is different in each display element group, and the reflecting plate has concave portions in which the illuminating elements are disposed.

According to this arrangement, since the reflecting plate has concave portions in which the illuminating elements are disposed, the light from one illuminating element, by being shielded by the concave portions, does not reach the display element group which is assigned to the adjacent illuminating element. Thus, it is possible to prevent the light from one illuminating element from reaching the display element group other than the display element group (display area) to be illuminated by this light. Thus, considering one specific display area in an image panel such as a liquid crystal display panel, only one illuminating element displays this display area. Therefore, it is only required to drive this illuminating element with a short pulse time width to illuminate the display elements by the sufficiently short pulse time width, without being affected by the light from other illuminating elements. As a result, it becomes possible to illuminate each emitting area with a practically and sufficiently short pulse time width, thereby improving display quality by eliminating, for example, image persistence in a fast-moving image.

Here, for example, luminance of the illuminating section may be changed in synchronism with scanning of the display elements per screen. Further, for example, the illuminating section may be adapted to include a plurality of illuminating elements (emitting areas) in the scanning direction, wherein the plurality of emitting areas are successively scanned to flash or dim in synchronism with the vertical synchronize signal of the image display device.

Further, the image display device of the present invention may have an arrangement including a plurality of signal lines and a plurality of scanning lines which are disposed orthogonal to each other, a signal line driver circuit for applying display data to each signal line, and a scanning line driver circuit for scanning each scanning line.

Further, an illumination device of the present invention for illuminating display elements of a display device of a shutter type which includes display elements for switching ON/OFF transmission of light according to display data, may have an arrangement wherein: the illumination device includes a plurality of illuminating elements which undergo change between first luminance and second luminance which is darker than the first luminance within one vertical period while being scanned, so as to illuminate the display elements, and the illuminating elements are grouped into illuminating element groups to include at least one illuminating element in one illuminating element group, and a timing of change of luminance of each illuminating element is different in each illuminating element group, and the illuminating element groups are divided so that illuminating elements of adjacent illuminating element groups illuminate display elements in different areas of the display device of a shutter type.

Further, a driving method of the illumination device according to the present invention, using the foregoing illumination device, may be adapted so that luminance of the illuminating elements is changed between the first luminance and the second luminance within one vertical period, and a timing of change of luminance has a certain phase with respect to a scanning timing of display elements which are illuminated by each illuminating element.

Here, as the term is used herein, the "phase" refers to a proportion of time with respect to the time of one vertical period. Further, considering that a vertical period is constant, "having a certain phase" is the same as saying "having a certain time difference". Further, "the timing of change of luminance has a certain phase with respect to a scanning timing of display elements illuminated by each illuminating element" is meant to indicate, taking the example of illuminating elements L1 and L2 which belong to the illuminating element group G1 as shown in FIGS. 35(*a*) and 35(*b*) and FIG. 36, that a difference between the respective scanning timings of the display elements (corresponding to one or more scanning lines) illuminated by the illuminating elements L1 and L2, and the timing at which the illuminating elements L1 and L2 change from the second luminance to the first luminance is constant in any one vertical period (frame). For example, in the case of the illuminating element group G1, and those display elements which are scanned first in the display elements which are illuminated by the illuminating element group G1, the time difference between the two is tb, and it can be said that, when one frame period is f, the phase is tb/f in any frame. Further, as shown in FIG. 27, in any of the illuminating element groups, the phase can be maintained at tb/f, while the timings of luminance change are only shifted by td subsequently from the illuminating element group G1.

According to the foregoing arrangement, because the illuminating elements are divided into illuminating groups, the light from one illuminating element is shielded by the divided structure and does not reach the display elements which are assigned to the adjacent illuminating element. Thus, it is possible to prevent the light from one illuminating element from reaching the display elements other than the display elements to be illuminated by this light. Thus, considering one specific display area in an image panel such as a liquid crystal display panel, only those illuminating elements which are switched ON or OFF at the same timing illuminate this display area. Therefore, it is only required to drive these illuminating elements with a short pulse time width to illuminate the display elements by the sufficiently short pulse time width, without being affected by the light from other illuminating elements. As a result, it becomes possible to illuminate each emitting area with a practically and sufficiently short pulse time width, thereby improving display quality by eliminating, for example, image persistence in a fast-moving image.

Further, the illumination device of the present invention, in the foregoing arrangement, may be adapted so that the display device of a shutter type is a liquid crystal display device.

According to this arrangement, the display device of a shutter type is a liquid crystal display device. Thus, in addition to the effects by the foregoing arrangements, a display quality of a moving image can be improved, even when using a display device which employs a liquid crystal element having a slower response speed than CRTs (cathode ray tubes).

The display devices of a shutter type such as the liquid crystal display devices are considered to be intrinsically inferior to display devices such as the CRTs with respect to their performance of displaying moving images. This is chiefly due to the difference between the display device of a hold type which keeps displaying a particular image for one vertical period, and the display device of an impulse type in which only a part of one vertical period contributes to display. It is therefore effective to realize the illumination device which is placed behind a shutter, by a flashing illumination device of a scanning type flashes light according to scanning timings of display. Such a device is realized by a plurality of divided illuminating element groups which flash light at different timings. Each illuminating element group has at least one illuminating element, and illuminating elements which belong to the same illuminating element group flash light at the same timing. This allows the display device of a shutter type to display an image in impulse. However, to realize the illuminating element groups, it is not sufficient to simply dispose illuminating elements which flash light one after another. This is because the emission of an illuminating element in an illuminating element group, by radiation and reflection, illuminates display elements (pixels) of an area which should be kept dark, with the result that the effect of impulse is diminished. Such diminishing effect of impulse can be suppressed by adopting the divided structure which allows illumination of only an intended area for the illumination device.

The emission timings of the illuminating element groups are set according to the display states of the display elements (pixels) which are disposed above the illumination device. That is, taking a liquid crystal panel as an example, it is preferable that the illuminating elements are switched ON after a video signal is applied to a certain display element (i.e., after the display element is scanned), waiting until the liquid crystal shows predetermined alignment according to the video signal. Although various factors come into play, such as a response time of the liquid crystal, and luminance required for the display device, it is preferable, for example, that the illuminating elements are switched ON after an elapsed ½ frame time from the time of scan, and switched OFF at the next scan.

Evidently, the illumination device has a purpose of brightening the display device. When the response of the liquid crystal is fast enough (i.e., response time of the liquid crystal is short enough), the display device can be brightened, even when luminance of the illuminating elements themselves is not satisfactory high, by switching ON the illuminating elements after an elapsed time, shorter than the ½ frame time, after the display elements are scanned. Further, when luminance of the illuminating elements are high, the display device can be made brighter thereby, and therefore, in this case, it is preferable that, when the response of the liquid crystal is slow (i.e., when the response time of the liquid crystal is long), the illuminating elements are switched ON after an elapsed time longer than the ½ frame time with respect to the scanning time, so that display quality of a moving image can be improved. Further, when the response time of the liquid crystal is slow, and the luminance of the illuminating elements themselves is not satisfactorily high, the display device can be made brighter by switching ON the illuminating elements after an elapsed time shorter than the ½ frame time with respect to the scanning time, whereas display quality of a moving image can be improved by switching ON the illuminating elements after an elapsed time longer than the ½ frame time with respect to the scanning time. The ON time may be decided according to the response time of the liquid crystal, or, considering that it is not necessarily required in a normal moving image display that response is completely finished before ON time, the ON time may be in view of other factors such as luminance (brightness) of the illuminating elements. Note, however, that in order to perform a desirable moving image display as CRTs, the ON period is preferably no longer than ½ one vertical period.

Further, the illumination device of the present invention, in the foregoing arrangement, may have an arrangement wherein the illuminating element groups are divided by a partition member which is provided between the illuminating element groups.

According to this arrangement, a partition member for parting adjacent illuminating element groups is provided between the illuminating elements. Thus, the light from the illuminating elements are blocked by the partition member and does not reach display elements which are assigned to an adjacent illuminating element group. As a result, in addition to the effects by the foregoing arrangement, it is possible to improve display quality of a moving image with a simpler structure.

Further, the illumination device of the present invention, in the foregoing arrangement, may have an arrangement wherein the illuminating element groups are divided by a reflecting plate for reflecting emitted light of the illuminating elements of the respective illuminating element groups toward a specific upper area.

According to this arrangement, the illuminating element groups are divided by a reflecting plate for reflecting emitted light of the illuminating elements of the respective illuminating element groups toward a specific upper area. Thus, the light from the illuminating elements are blocked by the reflecting plate and does not reach display elements which are assigned to an adjacent illuminating element group. As a result, in addition to the effects by the foregoing arrangement, it is possible to improve display quality of a moving image with a simpler structure.

The simplest of such a divided structure would be to provide a non-transparent wall between the illuminating element groups, so that the light emitted from one illuminating element group does not reach adjacent illuminating element groups and the display elements to be illuminated by the adjacent illuminating elements.

Further, it is also effective to converge the light from the illuminating elements by modifying the structure of the reflecting plate which is provided beneath the illuminating elements, so that only the display elements (pixels) of a specific area to be illuminated by these illuminating elements are illuminated. In order to ensure the effect of dividing the illuminating element groups, it is preferable that among the total quantity of light of the illuminating elements of one illuminating element group, a quantity of light which enters the adjacent illuminating element groups and the display elements to be illuminated by these adjacent illuminating elements is not more than ½.

Further, the illumination device of the present invention may have an arrangement including a plurality of illuminating groups which undergo changes between a relatively bright first luminance state and a second luminance state within one vertical period while being scanned, wherein the timing of change is different in each group, and at least one illuminating element is provided for each group, and adjacent illuminating groups are divided by a structure for predominantly illuminating different areas.

Further, the illumination device of the present invention, in the foregoing arrangement, may have an arrangement wherein the display device of a shutter type is a liquid crystal display device.

Further, the illumination device of the present invention may be adapted so that the structure for dividing the illuminating groups is a partition member.

Further, the illumination device of the present invention may be adapted so that the structure for dividing the illuminating groups is a reflecting structure for reflecting emitted light of the illuminating elements of the respective illuminating groups toward a specific upper area.

Further, driving method of the illumination device of the present invention may be adapted so that one frame time (one vertical period) is divided into a relatively brighter first luminance state and a second luminance state in the illumination device having the foregoing arrangements, wherein the period is provided at a certain phase with respect to a scanning timing of each illuminating area.

Further, an image display device of the present invention may have an arrangement including: a plurality of display elements, making up a screen, for modulating light according to image data which is applied while being scanned; and an illuminating section for illuminating the display elements, wherein: when those of the display elements having the same scanning time make up a display element band, the display element band is grouped into display element groups in order of earlier scanning time and to include at least one display element band in one display element group, and the illuminating section illuminates the display elements per the display element group while undergoing change between first luminance and second luminance which is darker than the first luminance and brighter than an OFF state, at a period of one vertical period of the screen and at a timing of change which is different in each display element group.

According to this arrangement, the illuminating section undergoes changes between first luminance and second luminance which is darker than the first luminance. Further, the timing of change is different in each display element group. As a result, each display element group changes its state from a second ON state of the second luminance, e.g., a state which is more dim than a normal state, and a first ON state of the first luminance, e.g., a normal ON state. As a result, the illuminating state of each display element changes between a normal ON state and a dim state by the unit of a vertical period.

Thus, instead of repeating ON and OFF of the emitter at the frame frequency, the emitter is changed between an ON state for displaying the display elements, and a dim state which is weaker than the ON state and not completely OFF. In effect, luminance is changed between the first luminance and the second luminance, which is weaker than the first luminance, thus effectively preventing damage to the emitter and suppressing shortening of life of the emitter.

Further, because there is no OFF period, there is no significant reduction in display luminance.

Further, during the ON period of the second luminance, the response of the display element, i.e., the transmission state of light undergoing change to a state according to the image data will not be noticeable on a displayed image, thus preventing a noticeable blurred image, such as streaking, also in a fast-moving image.

As a result, a desirable display quality can be obtained also in a fast-moving image, and it is possible to effectively prevent shortening of life and display luminance of the emitters.

Here, for example, the illuminating section may be adapted to include a plurality of illuminating elements for illuminating the display elements in a shared manner, wherein each illuminating element illuminates a plurality of display elements having the same or different scanning times. Further, for example, the illuminating section may be adapted so that its luminance is changed in synchronism with scanning of the display elements per screen. Further, for example, the illuminating section may be adapted to include a plurality of emitting areas (illuminating elements) in a scanning direction, wherein the emitting areas are successively scanned to dim in synchronism with the vertical synchronize signal of the image display device.

Further, the image display device of the present invention may be adapted to include, for example, a plurality of signal lines and scanning lines which are disposed orthogonal to each other, a signal line driver circuit for applying display data to each signal line, and a scanning line driver circuit for scanning each scanning line.

Further, the image display device of the present invention, in addition to the foregoing arrangement, may be adapted so that the illuminating section sets the second luminance in each display element group at least from the time when a display element band A having the earliest scanning time is scanned, to the time 1/10 of one vertical period is elapsed.

According to this arrangement, the illuminating section sets the second luminance in each display element group at least from the time when a display element band A having the earliest scanning time is scanned, to the time 1/10 of one vertical period is elapsed. In this way, the second luminance is ensured from the time of scan of the display element band A to the time 1/10 of one vertical period is elapsed, whereas in the other times, the luminance stays at the second luminance for a while and changes to the first luminance, or changes instantly to the first luminance and then back to the second luminance again. Here, the results of experiment showed that any of these cases was effective in preventing lowering of entire luminance, without streaking in a fast-moving image. Thus, by only making sure that the first 1/10 of one vertical period is the second luminance, it is possible to set luminance in a variety of ways according to other conditions while maintaining display quality. As a result, in addition to the effects by the foregoing arrangement, the degree of freedom in designing the image display device can be increased.

Further, the image display device of the present invention, in addition to the foregoing arrangement, may be adapted so that the illuminating section sets the second luminance in each display element group at least from the time after an elapsed 1/10 time period of one vertical period from the time a display element band A having the earliest scanning time is scanned, to the time another 1/10 time period of one vertical period is elapsed.

According to this arrangement, the illuminating section sets the second luminance in each display element group at least from the time after an elapsed 1/10 time period of one vertical period from the time a display element band A having the earliest scanning time is scanned, to the time another 1/10 time period of one vertical period is elapsed. In this way, the second luminance is ensured from the time after an elapsed 1/10 time period of one vertical period from the time a display element band A is scanned, to the time another 1/10 time period of one vertical period is elapsed. In the other times, for example, in a period up to the first 1/10, the luminance may be at the second luminance continuously from the time of scan of the display element band A, or may by at the first luminance at the time of scan of the display element band A and then is changed to the second luminance after the elapsed 1/10 of one vertical period. Likewise, the luminance is either the first luminance or the second luminance after the elapsed 2/10 of one vertical period. Here, the results of experiment showed that any of these cases was effective in preventing lowering of entire luminance, without streaking in a fast-moving image. Thus, by only making sure that the first 1/10 to 2/10 of one vertical period is the second luminance, it is possible to set luminance in a variety of ways according to other conditions while maintaining display quality. As a result, in addition to the effects by the foregoing arrangement, the degree of freedom in designing the image display device can be increased.

Further, the image display device of the present invention, in addition to the foregoing arrangement, in each display element group, may be adapted so that the display elements are illuminated at the second luminance from the time at least the display element band A having the earliest scanning time is scanned, to the time, at most, the response of the display elements of the display element band A is finished.

As a result, within a predetermined time period at the maximum from scanning of the display elements of the display element group, to the time the response of the display element (change in transmission state or reflection state of light to a state according to image data) is finished, the luminance of at least this display element group becomes the second luminance. Thus, since the light is illuminated at the darker second luminance for a predetermined time period within a period before the response of the display elements is finished, a display during the response does not become noticeable, and a noticeable blurred image such as streaking can be prevented further effectively also in a fast-moving image. Thus, in addition to the effects by the foregoing arrangement, it becomes possible to obtain a further desirable display quality in a fast-moving image, while effectively preventing shortening of life and luminance of the emitters.

Further, for example, the emitters may be adapted so that they are switched ON at the first luminance, which is brighter than the second luminance, immediately after, or shortly after the change to the sate according to the image data is substantially complete. Further, for example, the emitters may be adapted so that the change to the second luminance occurs before the next scan of the display elements.

Further, the emitters of the present invention may be adapted to include a period of emitting light at a first luminance level and a period of emitting light at a second luminance level within a vertical period, the first luminance level and the second luminance level being different from each other and brighter than an OFF state.

Further, the emitters of the present invention, in addition to the foregoing arrangement, may be adapted to comprise a cold cathode tube.

Further, the emitters of the present invention, in addition to the foregoing arrangement, may be adapted to comprise a light-emitting diode element.

Further, the emitters of the present invention, in addition to the foregoing arrangement, may be adapted to comprise an electroluminescence element.

Further, the emitters of the present invention, in addition to the foregoing arrangement, may be adapted to comprise a hot cathode tube.

Further, the emitters of the present invention, in addition to the foregoing arrangement, may be adapted to comprise a mercury lamp.

Further, the emitters of the present invention, in addition to the foregoing arrangement, may be adapted to comprise a halogen lamp.

Further, the emitters of the present invention, in addition to the foregoing arrangement, may be adapted to comprise a laser.

Further, a driving method of the emitters of the present invention may have an arrangement wherein a first driving signal and a second driving signal are inputted into an emitter at different timings within a vertical period, so that luminance of the emitter becomes different when the emitter receives the first driving signal and when the emitter receives the second driving signal, and that the luminance by the first driving signal and the luminance by the second driving signal are brighter than an OFF state.

Further, a liquid crystal display device of the present invention, in a liquid crystal display device which includes an emitter for illuminating pixels with light which is in accordance with a driving signal, may have an arrangement including: emission control means for controlling the driving signal so that one vertical synchronize period includes two or more of separate periods of reduced luminance of the emitter, and that luminance of the emitter is changed by a period of one vertical synchronize period.

According to this invention, the light from the emitter is changed according to the driving signal to illuminate the pixels to display desired information. Here, by applying the driving signal which includes a period of reduced luminance of the emitter within one vertical synchronize period, a viewer would see only a moment of high contrast as a persistent image, which is perceived as a clear image with good contrast, thus improving display quality of fast-moving images in particular.

However, when the emitter has a period of reduced luminance and the ON period within one vertical synchronize period, a cooling/heating cycle having a period of one vertical synchronize signal is generated, which shortens life of the cold cathode tube. Further, by the cooling/heating cycle, there occurs a large temperature difference between ON time, at which temperature of the emitter is lowest, and OFF time, at which temperature of the emitter is highest. This makes it difficult to maintain the environmental temperature of the emitter constant, and luminance is lowered as a result.

In view of this drawback, according to the foregoing invention, the emission control means controls the driving signal so that two or more periods of reduced luminance are separately provided for the emitter within one vertical synchronize period. By thus dividing a period of reduced luminance of one vertical synchronize period into at least two parts, a temperature drop of the emitter in the period of reduced luminance can be reduced. Further, considering the temperature change of the emitter in one vertical synchronize period in total, by the reduced temperature drop of the emitter in the period of reduced luminance, the amplitude of temperature change of the emitter can be reduced. As a result, it becomes easier to maintain the environmental temperature of the emitter constant, thus suppressing lowering of luminance.

Incidentally, it was found that the effect of obtaining a desirable display quality in a fast-moving image by the provision of the period of reduced luminance is lost, even when control is carried out with two or more separate periods of reduced luminance of the emitter, if luminance of the emitter does not change at the period of one vertical synchronize period.

Therefore, according to the foregoing invention, the emission control means controls the driving signal so that the emitter has two or more separate periods of reduced luminance in one vertical synchronize period, and that the luminance of the emitter changes at the period of one vertical synchronize period. By this control where luminance of the emitter changes at the period of one vertical synchronize period, a desirable display quality can be obtained in a fast-moving image.

Further, the emission control means may be adapted to incorporate a small pulse in the driving signal of a certain period of reduced luminance, which is provided per one vertical synchronize period, so as to divide the period of reduced luminance. That is, the OFF period of the driving signal, which is the period of reduced luminance of the emitter, may be divided by inserting a small pulse therein, so as to provide two or more OFF periods.

Further, in a liquid crystal display device of the present invention, the emission control means may be further adapted to slack a rise and a fall of a waveform of the driving signal. It is preferable by thus slacking the rise and fall of the waveform of the driving signal to gradually increase emission of the emitter in the vicinity of the rise, and to gradually decrease it in the vicinity of the fall.

When the driving signal is a rectangular waveform, an electromagnetic radiation of high frequency is observed, which can be harmful to the human body. Further, by applying the driving signal of a rectangular wave to the emitter, a current flows abruptly through the emitter at the rise of emission, and the current of the emitter is suddenly shut down at the fall of emission, which may cause a reverse current flow through the emitter. Such a behavior of current is detrimental to life of the emitter.

Thus, in the foregoing invention, the emission control means controls the driving signal so that the rise and fall of the waveform of the driving signal are slacked. By this control, there will be no abrupt current flow through the emitter at the rise of emission, nor will there be a sudden current shut down in the emitter at the fall of emission, thus preventing also a reverse current flow through the emitter.

Thus, it is ensured preventing significant shortening of life of the emitter to extend life of the emitter, as well as reducing or relieving the influence of electromagnetic radiation, where the high harmonic component can be harmful to the human body, thus overcoming the problem of electromagnetic radiation.

Further, an illumination device of the present invention, in an illumination device which includes an emitter for emitting light which is in accordance with a driving signal, and which periodically changes luminance of the emitter, may have an arrangement including emission control means for controlling the driving signal so that one period includes two or more separate periods of reduced luminance of the emitter.

According to this illumination device, the emission control means controls the driving signal so that the emitter includes two or more separate periods of reduced luminance within a period. Thus, by installing the illumination device, for example, in a liquid crystal display device, to operate at the period of one vertical synchronize period, the same effects as those by the liquid crystal display device of the present invention can be obtained.

The emitter is preferably a cold cathode tube, a light emitting diode, an electroluminescence element, a hot cathode tube, a mercury lamp, a halogen lamp, or a laser.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. An image display device, comprising:

a plurality of display elements, making up a screen, for modulating light according to image data which is applied while being scanned; and an illuminating section for illuminating the display elements, wherein:

when those of said display elements having the same scanning time make up a display element band, said display element band is grouped into display element groups in order of earlier scanning time so that each display element group includes at least one display element band, said illuminating section includes a plurality of illuminating elements grouped, in accordance with the display element groups the illuminating elements illuminate, into illuminating element groups so that each illuminating element group includes at least one illuminating element, and the illuminating elements respectively illuminate the display elements in such a manner that each illuminating element group respectively illuminates a display element group in a second luminance in a period from Time P to Time (P+tb), and illuminates in a first luminance in a period from the Time (P+tb) to Time (P+f), the second luminance being darker than the first luminance, where tb is a predetermined time, f is one vertical period, and the Time P is a time at which a display element band having an earliest scanning time in the display element group the illuminating element group illuminates is scanned.

2. The image display device as set forth in claim 1, comprising a partition member, between said illuminating elements, for parting adjacent illuminating elements.

3. The image display device as set forth in claim 1, comprising a reflecting plate for reflecting light from the illuminating elements in a direction toward the display elements.

4. The image display device as set forth in claim 3, wherein said reflecting plate has concave portions in which the illuminating elements are disposed.

5. The image display device as set forth in claim 1, wherein the second luminance is brighter than an OFF state.

6. The image display device as set forth in claim 1, wherein the second luminance is equal to an OFF state in terms of brightness.

7. The image display device as set forth in claim 1, wherein said illuminating section illuminates in the second luminance from the Time P to a time when 1/10 of one vertical period is elapsed since the Time P.

8. The image display device as set forth in claim 1, wherein said illuminating section illuminates in the second luminance from the Time P to a time when 2/10 of one vertical period is elapsed since the Time P.

9. The image display device as set forth in 1, wherein said illuminating section illuminates in the second luminance from the Time P to a time when 5/10 of one vertical period is elapsed since the Time P.

10. The image display device as set forth in claim 1, wherein said illuminating section illuminates in the first luminance throughout a period from the Time (P+tb) to the Time (P+f).

11. The image display device as set forth in claim 1, wherein a plurality of the illuminating elements belong to each illuminating element group.

12. An image display device, comprising:

a plurality of display elements, making up a screen, for modulating light according to image data which is applied while being scanned; and an illuminating section for illuminating the display elements, wherein:

when those of said display elements having the same scanning time make up a display element band, said display element band is grouped into display element groups in order of earlier scanning time so that each display element group includes at least one display element band, said illuminating section includes a plurality of illuminating elements grouped, in accordance with the display element groups the illuminating elements illuminate, into illuminating element groups so that each illuminating element group includes at least one illuminating element, and the illuminating section illuminates the display elements in such a manner that each illuminating element group respectively illuminates a display element group in a second luminance at least in a period from (i) a time when 1/10 of f is elapsed since Time P to (ii) a time when 2/10 of f is elapsed since the Time P, and illuminates in a first luminance in a period from the time when 2/10 of f is elapsed since the Time P, to Time (P+f), the second luminance being darker than the first luminance, where f is one vertical period, and Time P is a time at which a display element band having an earliest scanning time in the display element group is scanned.

13. The image display device as set forth in claim 12, wherein the second luminance is brighter than an OFF state.

14. The image display device as set forth in claim 12, wherein the second luminance is equal to an OFF state in terms of brightness.

15. The image display device as set forth in claim 12, wherein said illuminating section illuminates in the first luminance throughout a period from the Time (P+tb) to the Time (P+f).

16. The image display device as set forth in claim 12, wherein a plurality of the illuminating elements belong to each illuminating element group.

17. An illumination device comprising:

an illuminating section for illuminating display elements of an image display device including the display elements, making up a screen, for modulating light according to image data which is applied while being scanned wherein, when those of said display elements having the same scanning time make up a display element band, said display element band is grouped into display element groups in order of earlier scanning time so that each display element group includes at least one display element band, wherein:

said illuminating section includes a plurality of illuminating elements grouped, in accordance with the display element groups the illuminating elements illuminate, into illuminating element groups so that each illuminating element group includes at least one illuminating element, and the illuminating elements respectively illuminate the display elements in such a manner that each illuminating element group respectively illuminates a display element group in a second luminance in a period from Time P to Time (P+tb), and illuminates in a first luminance in a period from the Time (P+tb) to Time (P+f), the second luminance being darker than the first luminance, where tb is a predetermined time, f is one vertical period, and the Time P is a time at which a display element band having an earliest scanning time in the display element group the illuminating element group illuminates is scanned.

18. The illumination device as set forth in claim 17, wherein the illuminating element groups are divided so that illuminating elements of adjacent illuminating element groups illuminate display elements in different areas of the image display device.

19. The illumination device as set forth in claim 17, wherein comprising a partition member, provided between the illuminating element groups, for dividing the illuminating element groups.

20. The illumination device as set forth in claim 17, comprising a reflecting plate, dividing the illuminating element groups, for reflecting emitted light of the illuminating elements of the respective illuminating element groups toward a specific upper area.

21. The illumination device as set forth in claim 17, wherein said image display device is a liquid crystal display device.

22. The illumination device as set forth in claim 21, wherein said illuminating section illuminates in the second luminance from the Time P to a time when 1/10 of one vertical period is elapsed since the Time P.

23. The illumination device as set forth in claim 21, wherein said illuminating section illuminates in the second luminance from the Time P to a time when 2/10 of one vertical period is elapsed since the Time P.

24. The illumination device as set forth in claim 21, wherein said illuminating section illuminates in the second luminance from the Time P to a time when 5/10 of one vertical period is elapsed since the Time P.

25. The illumination device as set forth in claim 17, wherein the second luminance is brighter than an OFF state.

26. The illumination device as set forth in claim 17, wherein the second luminance is equal to an OFF state in terms of brightness.

27. The illumination device as set forth in claim 17, wherein said illuminating section illuminates in the first luminance throughout a period from the Time (P+tb) to the Time (P+f).

28. The illumination device as set forth in claim 17, wherein a plurality of the illuminating elements belong to each illuminating element group.

29. A driving method of an illumination device, comprising:

said illumination device including an illuminating section for illuminating display elements of an image display device including the display elements, making up a screen, for modulating light according to image data which is applied while being scanned wherein, when those of said display elements having the same scanning time make up a display element band, said display element band is grouped into display element groups in order of earlier scanning time so that each display element group includes at least one display element band, said illuminating section including a plurality of illuminating elements grouped, in accordance with the display element groups the illuminating elements illuminate, into illuminating element groups so that each illuminating element group includes at least one illuminating element, and the illuminating elements respectively illuminating the display elements in such a manner that each illuminating element group respectively illuminates a display element group in a second luminance in a period from Time P to Time (P+tb), and illuminates in a first luminance in a period from the Time (P+tb) to Time (P+f), the second luminance being darker than the first luminance, where tb is a predetermined time, f is one vertical period, and the time P is a time at which a display element band having an earliest scanning time in the display element group the illuminating element group illuminates is scanned.

30. The driving method as set forth in claim 29, wherein the second luminance is brighter than an OFF state.

31. The driving method as set forth in claim 29, wherein the second luminance is equal to an OFF state in terms of brightness.

32. The driving method as set forth in claim 29, wherein said illuminating section illuminates in the second luminance from the Time P to a time when 1/10 of one vertical period is elapsed since the Time P.

33. The driving method as set forth in claim 29, wherein said illuminating section illuminates in the second luminance from the Time P to a time when 2/10 of one vertical period is elapsed since the Time P.

34. The driving method as set forth in claim 29, wherein said illuminating section illuminates in the second luminance from the Time P to a time when 5/10 of one vertical period is elapsed since the Time P.

35. The driving method as set forth in claim 29, wherein said illuminating section illuminates in the first luminance throughout a period from the Time (P+tb) to the Time (P+f).

36. The image display device as set forth in claim 29, wherein a plurality of the illuminating elements belong to each illuminating element group.

* * * * *